US012654074B2

(12) United States Patent
Carr et al.

(10) Patent No.: US 12,654,074 B2
(45) Date of Patent: Jun. 16, 2026

(54) GOLF CLUB HEAD INCLUDING AN INSERT

(71) Applicant: Acushnet Company, Fairhaven, MA (US)

(72) Inventors: Kyle A. Carr, Carlsbad, CA (US); Grant M. Martens, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 276 days.

(21) Appl. No.: 18/503,334

(22) Filed: Nov. 7, 2023

(65) Prior Publication Data

US 2024/0082654 A1 Mar. 14, 2024

Related U.S. Application Data

(63) Continuation-in-part of application No. 18/499,542, filed on Nov. 1, 2023, which is a continuation-in-part of application No. 17/940,841, filed on Sep. 8, 2022, now Pat. No. 12,036,448.

(51) Int. Cl.

| | |
|---|---|
| ***A63B 53/04*** | (2015.01) |
| ***A63B 53/06*** | (2015.01) |
| ***A63B 53/08*** | (2015.01) |

(52) U.S. Cl.

CPC ..... *A63B 53/0433* (2020.08); *A63B 53/047* (2013.01); *A63B 53/08* (2013.01); *A63B 2053/0479* (2013.01); *A63B 2053/0491* (2013.01)

(58) Field of Classification Search

CPC ..... A63B 53/0433; A63B 53/047

USPC ..... 473/344, 345

See application file for complete search history.

(56) References Cited

U.S. PATENT DOCUMENTS

| | | | |
|---|---|---|---|
| 819,900 | A | 5/1906 | Martin |
| 1,705,997 | A | 3/1929 | Quynn |
| 2,968,486 | A | 1/1961 | Walton |
| 3,084,940 | A | 4/1963 | Cissel |
| 3,166,320 | A | 1/1965 | Onions |

(Continued)

FOREIGN PATENT DOCUMENTS

| | | | | |
|---|---|---|---|---|
| CA | 2795716 A1 | * | 10/2011 | ..... A63B 53/04 |
| CN | 203763803 U | * | 8/2014 | ..... A63B 60/00 |

(Continued)

OTHER PUBLICATIONS

U.S. Appl. No. 18/503,339, filed Nov. 7, 2023, Carr et al.

(Continued)

*Primary Examiner* — Alvin A Hunter
(74) *Attorney, Agent, or Firm* — Mike S. Kim

(57) ABSTRACT

A golf club head including an insert is disclosed herein. In accordance with the presently disclosed technology, the golf club head may include a body. The body may include a face, a crown, a first sole portion, a leading edge, a second sole portion, a trailing edge, and a sole opening between the first sole portion and the second sole portion. The golf club head may include an insert to fit into the sole opening that includes a sole insert and a frontal sole insert. The sole insert may be detachably connected to the sole portion, and the frontal sole insert may be in contact with at least a faceward surface of the sole insert. The frontal sole insert may separate the sole insert from the face.

18 Claims, 38 Drawing Sheets

(56) References Cited

U.S. PATENT DOCUMENTS 4,027,885 A 6/1977 Rogers
4,398,965 A 8/1983 Campau
4,754,974 A 7/1988 Kobayashi
5,054,784 A 10/1991 Collins
D323,035 S 1/1992 Yang
5,092,599 A 3/1992 Okumoto et al.
5,205,560 A 4/1993 Hoshi et al.
5,221,086 A 6/1993 Antonious
5,346,216 A 9/1994 Aizawa
5,419,556 A 5/1995 Take
D366,508 S 1/1996 Hutin
5,492,327 A 2/1996 Biafore, Jr.
5,511,786 A 4/1996 Antonious
D372,512 S 8/1996 Simmons
5,584,770 A 12/1996 Jensen
D377,509 S 1/1997 Katayama
5,616,088 A 4/1997 Aizawa et al.
5,632,695 A 5/1997 Hlinka
D382,612 S 8/1997 Oyer
D394,688 S 5/1998 Fox
5,772,527 A 6/1998 Liu
D397,750 S 9/1998 Frazetta
D403,037 S 12/1998 Stone et al.
D405,488 S 2/1999 Burrows
5,993,329 A 11/1999 Shieh
6,042,486 A 3/2000 Gallagher
6,048,278 A 4/2000 Meyer et al.
6,319,149 B1 * 11/2001 Lee ..... A63B 53/04 473/409
6,348,013 B1 2/2002 Kosmatka
6,354,961 B1 3/2002 Allen
6,368,232 B1 4/2002 Howard et al.
6,390,932 B1 5/2002 Kosmatka et al.
6,454,664 B1 9/2002 Long
6,506,129 B2 1/2003 Chen
6,530,847 B1 3/2003 Antonious
6,592,468 B2 * 7/2003 Vincent ..... A63B 53/047 473/345
6,602,149 B1 8/2003 Jacobson
D482,089 S 11/2003 Burrows
D482,090 S 11/2003 Burrows
D482,420 S 11/2003 Burrows
D484,208 S 12/2003 Burrows
6,663,506 B2 12/2003 Nishimoto et al.
6,679,786 B2 1/2004 McCabe
D486,542 S 2/2004 Burrows
6,695,715 B1 2/2004 Chikaraishi
6,719,645 B2 4/2004 Kouno
6,743,118 B1 6/2004 Soracco
6,783,465 B2 8/2004 Matsunaga
6,811,496 B2 * 11/2004 Wahl ..... A63B 53/047 473/345
D501,036 S 1/2005 Burrows
D501,903 S 2/2005 Tanaka
6,855,068 B2 2/2005 Antonious
D504,478 S 4/2005 Burrows
6,887,165 B2 5/2005 Tsurumaki
D506,236 S 6/2005 Evans et al.
D508,274 S 8/2005 Burrows
6,979,270 B1 12/2005 Allen
D520,585 S 5/2006 Hasebe
D523,104 S 6/2006 Hasebe
7,097,572 B2 8/2006 Yabu
7,140,974 B2 11/2006 Chao et al.
7,156,750 B2 1/2007 Nishitani et al.
D536,402 S 2/2007 Kawami
7,211,006 B2 5/2007 Chang
7,226,366 B2 6/2007 Galloway
7,241,230 B2 7/2007 Tsunoda
7,244,189 B1 7/2007 Stobbe
D552,701 S 10/2007 Ruggiero et al.
7,294,064 B2 11/2007 Tsurumaki et al.
7,318,782 B2 1/2008 Imamoto et al.
7,344,452 B2 3/2008 Imamoto et al.
7,347,795 B2 3/2008 Yamagishi et al.
7,396,293 B2 * 7/2008 Soracco ..... A63B 60/54 473/332
7,438,649 B2 10/2008 Ezaki et al.
7,470,201 B2 12/2008 Nakahara et al.
7,500,924 B2 3/2009 Yokota et al.
7,530,901 B2 5/2009 Imamoto et al.
7,530,903 B2 5/2009 Imamoto et al.
7,572,193 B2 8/2009 Yokota
7,582,024 B2 * 9/2009 Shear ..... A63B 60/52 473/332
7,585,233 B2 9/2009 Horacek et al.
7,682,264 B2 3/2010 Hsu et al.
D616,952 S 6/2010 Oldknow
7,857,711 B2 12/2010 Shear
7,896,753 B2 3/2011 Boyd et al.
8,206,241 B2 * 6/2012 Boyd ..... A63B 53/047 473/332
8,235,841 B2 8/2012 Stites et al.
8,235,844 B2 8/2012 Albertsen et al.
8,241,143 B2 8/2012 Albertsen et al.
8,241,144 B2 8/2012 Albertsen et al.
8,366,565 B2 2/2013 Tavares et al.
8,403,771 B1 3/2013 Rice et al.
8,435,134 B2 5/2013 Tang et al.
8,517,860 B2 8/2013 Albertsen et al.
8,529,368 B2 9/2013 Rice et al.
8,591,351 B2 11/2013 Albertsen et al.
8,641,555 B2 2/2014 Stites et al.
8,668,599 B1 * 3/2014 Cackett ..... A63B 60/00 473/335
8,708,838 B2 * 4/2014 Ferguson ..... A63B 53/0466 473/335
8,827,831 B2 9/2014 Burnett et al.
8,834,289 B2 9/2014 de la Cruz et al.
8,834,290 B2 9/2014 Bezilla et al.
8,876,631 B2 * 11/2014 Cackett ..... A63B 53/04 473/335
8,956,242 B2 * 2/2015 Rice ..... A63B 60/54 473/332
8,961,332 B2 2/2015 Galvan et al.
8,986,133 B2 3/2015 Bennett et al.
8,998,746 B2 4/2015 Boyd et al.
9,044,653 B2 * 6/2015 Wahl ..... A63B 60/52
9,101,808 B2 8/2015 Stites et al.
9,211,448 B2 12/2015 Bezilla et al.
9,320,949 B2 4/2016 Golden et al.
9,409,067 B2 8/2016 de la Cruz et al.
9,421,433 B2 8/2016 Martens et al.
9,492,722 B2 * 11/2016 Taylor ..... A63B 60/52
9,498,688 B2 11/2016 Galvan et al.
9,561,408 B2 2/2017 Bezilla et al.
9,561,410 B2 2/2017 Bennett et al.
9,636,552 B2 5/2017 Cleghorn et al.
9,636,559 B2 5/2017 de la Cruz et al.
9,662,545 B2 * 5/2017 Beach ..... A63B 60/52
9,675,850 B2 6/2017 Bennett et al.
9,682,293 B2 6/2017 Bennett et al.
9,700,765 B2 7/2017 Frame et al.
9,776,057 B2 * 10/2017 Rice ..... A63B 53/0466
9,839,817 B1 * 12/2017 Johnson ..... A63B 60/00
9,839,820 B2 12/2017 Bennett et al.
10,099,092 B2 10/2018 Morin
10,463,933 B2 * 11/2019 Mata ..... A63B 53/047
10,532,255 B2 * 1/2020 Wester ..... A63B 60/00
10,646,756 B2 * 5/2020 Beach ..... A63B 60/00
10,806,978 B2 * 10/2020 Golden ..... A63B 53/06
10,874,916 B2 * 12/2020 Willett ..... A63B 53/0466
11,033,788 B1 * 6/2021 Hobbs ..... A63B 53/047
11,420,098 B2 * 8/2022 Honea ..... A63B 60/54
11,691,055 B2 * 7/2023 Cleghorn ..... A63B 53/0466 473/349
2002/0055396 A1 5/2002 Nishimoto et al.
2002/0068645 A1 * 6/2002 Vincent ..... A63B 53/047 473/338
2002/0183134 A1 12/2002 Allen et al.
2003/0013545 A1 * 1/2003 Vincent ..... A63B 53/047 473/332

(56) References Cited

U.S. PATENT DOCUMENTS

2003/0032499 A1* 2/2003 Wahl ..... A63B 53/047 473/334
2003/0220154 A1 11/2003 Anelli
2004/0176183 A1 9/2004 Tsurumaki
2004/0192463 A1 9/2004 Tsurumaki
2005/0049081 A1 3/2005 Boone
2006/0084525 A1 4/2006 Imamoto
2006/0189407 A1* 8/2006 Soracco ..... A63B 53/0466 473/345
2007/0026961 A1 2/2007 Hou
2007/0049415 A1* 3/2007 Shear ..... A63B 53/0466 473/349
2007/0049416 A1* 3/2007 Shear ..... A63B 53/0466 473/349
2007/0049417 A1* 3/2007 Shear ..... A63B 53/0466 473/349
2007/0082751 A1 4/2007 Lo et al.
2009/0062032 A1 3/2009 Boyd
2010/0029404 A1* 2/2010 Shear ..... A63B 60/52 473/345
2011/0151997 A1* 6/2011 Shear ..... A63B 60/00 473/332
2012/0142447 A1 6/2012 Boyd et al.
2012/0196701 A1* 8/2012 Stites ..... A63B 53/06 473/324
2014/0057739 A1* 2/2014 Stites ..... A63B 60/00 473/346
2014/0080633 A1* 3/2014 Bezilla ..... A63B 53/04 473/342
2014/0179461 A1* 6/2014 Cackett ..... A63B 60/02 473/342
2014/0228150 A1* 8/2014 Shear ..... A63B 60/52 473/329
2015/0080146 A1* 3/2015 Rice ..... A63B 60/54 473/328
2015/0133233 A1 5/2015 Bezilla et al.
2015/0190688 A1 7/2015 Bennett et al.
2016/0101328 A1* 4/2016 Luttrell ..... A63B 53/0466 473/342
2016/0107048 A1* 4/2016 Shear ..... A63B 53/04 473/345
2017/0028273 A1* 2/2017 Rice ..... A63B 60/54
2017/0151472 A1* 6/2017 Beach ..... A63B 60/00
2017/0282020 A1* 10/2017 Shear ..... A63B 60/00
2017/0296885 A1* 10/2017 Oldknow ..... A63B 53/06
2018/0021639 A1* 1/2018 Rice ..... A63B 60/54 473/328
2018/0078833 A1* 3/2018 Johnson ..... A63B 53/0466
2019/0083866 A1* 3/2019 Shear ..... A63B 53/0466
2019/0192926 A1* 6/2019 Willett ..... A63B 53/06
2019/0201754 A1* 7/2019 Hoffman ..... A63B 60/02
2019/0201755 A1* 7/2019 Rice ..... A63B 60/54
2019/0240547 A1* 8/2019 Johnson ..... A63B 60/00
2019/0366164 A1* 12/2019 Wahl ..... A63B 60/52
2020/0030670 A1* 1/2020 Mata ..... A63B 53/047
2020/0306600 A1* 10/2020 Wester ..... A63B 60/52
2021/0128992 A1* 5/2021 Honea ..... A63B 53/047
2022/0233924 A1* 7/2022 Woodward ..... A63B 53/0416
2023/0024044 A1* 1/2023 Cleghorn ..... A63B 53/0408
2023/0285813 A1* 9/2023 Cleghorn ..... A63B 53/0408

FOREIGN PATENT DOCUMENTS

EP 3466500 A1 * 4/2019 ..... A63B 53/06
JP 1259876 10/1989
JP 411042302 2/1999
JP 2002-52099 2/2002
JP 2003-93554 4/2003
JP 2004-351054 12/2004
JP 2004-351173 12/2004
JP 2014180555 A * 9/2014 ..... A63B 53/02
JP 6341701 B2 * 6/2018 ..... A63B 60/52
WO WO-0243819 A2 * 6/2002 ..... A63B 60/02

OTHER PUBLICATIONS

U.S. Appl. No. 18/503,344, filed Nov. 7, 2023, Martens et al.
English language translation of JP Patent Publication No. 2002-52099A (full text).

* cited by examiner

GOLF CLUB HEAD INCLUDING AN INSERT

CROSS REFERENCE TO RELATED APPLICATIONS

This application is a continuation-in-part (CIP) of U.S. patent application Ser. No. 18/499,542, filed Nov. 1, 2023, which is a CIP of U.S. patent application Ser. No. 17/940,841, filed Sep. 8, 2022, the disclosure of which is incorporated by reference in its entirety.

TECHNICAL FIELD

The present invention relates to a golf club irons with an improved sole portion, and, more specifically, a golf club iron having a slot adjacent to the striking face of the iron.

BACKGROUND

The flight characteristics of a golf ball after being struck by a golf club are dependent not only on the swing of the golf club but also on the golf club itself. For example, flight characteristics of the golf ball, such as fades, draws, launch angles, ball spin, speed, and the like, are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these weights need to be both strategically placed relative to the striking face, and properly designed. As such, improvements to weight inserts for golf club irons are desired.

Although weight inserts are crucial in helping improve the CG and MOI of the golf club head, another way to further improve the performance of a golf club head is by increasing the compliance of the golf club head upon impact with a golf ball. U.S. Pat. No. 8,986,133 to Bennett et al. illustrates how compliance can improve the performance of a metalwood type golf club.

U.S. Pat. No. 9,044,653 to Wahl illustrates the addition of a slot in an iron to improve the compliance of the golf club head, but fails to maximize the performance capabilities of such a slot by optimizing its placement as well as adding fillers.

SUMMARY

In an aspect, the technology relates to an iron-type golf club head including: a striking face having a lower leading edge; an upper topline edge opposite to the lower leading edge; a sole extending from the lower leading edge to a trailing edge rearward and distal to the lower leading edge; a back portion positioned rearward of the striking face and between the trailing edge and the upper topline edge; a slot formed in the sole adjacent to the striking face; and a weight insert disposed within the slot.

The slot has a front edge defined at the bottom surface of the sole adjacent to the striking face; a back edge defined at the bottom surface of the sole opposite the front edge towards the back portion; a proximal edge adjacent to a heel side of the golf club head; and a distal edge adjacent to the toe side of the golf club head. One or more sidewalls extend upwardly from the slot edges to further define the slot configuration. An insert can be placed inside the slot to add weight to the face portion of the golf club head in an attempt to move the center of gravity forward and/or downward relative to the same golf club head without the insert.

The slot can have various lengths and widths, and can be positioned at various distances from the striking face. Although specified in more detail below and in the accompanying drawings, in general, the slot generally has an elongated configuration in which the length is measured from the proximal edge to the distal edge in the direction of the heel to toe of the golf club. The width of the slot is smaller than the length and is generally measured from the front edge to the back edge in the front to back direction. The height of the slot is generally measured from the sole in the upward direction toward the topline edge.

In general, the slot can have a length of about 20 mm to about 85 mm. The slot can have a width of about 1 mm to about 13 mm. In an example of the present invention, the slot is maintained within the region of the striking face (in the x-direction). In another example of the present invention, the slot can enter into the toe portion of the golf club head. In another example of the present invention, the slot can extend upwardly into the toe portion of the golf club head. In another example, the slot can extend upwardly into the toe portion and curve rearwardly toward the back portion of the golf club head.

The slot is also characterized by its distance from the striking face, and more specifically, the distance from the front edge of the slot to an inner wall of the striking surface. The distance of the front edge of the slot to the inner wall of the striking face is generally 8 mm or less.

The insert is generally configured to fit inside the slot. As such, the length, width and bottom profile of the insert is substantially the same as that of the slot. The height of the insert, however, is not necessarily constrained by the profile or outline of the slot at the sole. In one example of the present invention, the height of the insert as measured from the bottom of the insert to the top of the insert can be uniform. In general, the height of the insert is less than about 5 mm. Preferably, the height of the insert is about 1 mm to about 4.5 mm.

In another example of the present invention, the insert defines a non-uniform height, meaning that the insert has a different height at different locations along the insert. For example, the insert can have a first height at a central portion that is less than a second height of the insert at an end portion. In another example, the central portion of the insert can be recessed relative to a perimeter rim portion of the insert causing a height at the perimeter rim to be greater than a height measured at the recessed central portion.

It is believed the position and configuration of the insert improves the ball speed, including when the ball is hit off-center, increases distance with increased backspin, and increases the coefficient of restitution compared with similar golf club heads without the insert described herein. This configuration may also provide a weaker loft and better peak height. Providing an insert in the slot at the location disclosed adds mass to promote deflection in the slot.

Embodiments of the presently disclosed technology may include golf club heads. In accordance with some aspects of the presently disclosed technology, a golf club head may include a body. The body may include an interior cavity, a face, and a sole. The sole may include a leading edge, a leading edge slot, a central region, and a trailing edge. The leading edge may be defined as a boundary between the face and the sole. The leading edge slot may be rearward of the face. The leading edge slot may be located immediately rearward of the leading edge. The central region may be rearward of the leading edge slot. The trailing edge may be rearward of the central region. The golf club head may include a leading edge insert to fit into the leading edge slot. The leading edge insert may be a different material than the body. The leading edge insert may include an insert body forming a part of the sole in an installed position, and an insert channel. The insert channel may be oriented toward the interior cavity of the body.

In embodiments, a slot width of the leading edge slot may be greater than a slot depth of the leading edge slot.

In embodiments, the insert body may include a face portion to engage a rear surface of the face.

In embodiments, the leading edge insert may include a rib extending from an interior surface of the insert body to the face portion.

In embodiments, the installed position may be defined by fully inserting the leading edge insert into the leading edge slot.

In embodiments, in the installed position, an exterior surface of the leading edge insert may be flush with surrounding regions of the sole.

In embodiments, the leading edge slot may include a rear slot wall extending vertically upward from the sole. The leading edge insert may include a retaining component to help secure the leading edge insert to the leading edge slot.

In accordance with some aspects of the presently disclosed technology, a golf club head may include a body. The body may include a face and a sole. The sole may include a leading edge, a leading edge slot, a central region, and a trailing edge. The leading edge may be defined as a boundary between the face and the sole. The leading edge slot may be rearward of the face. The central region may be rearward of the leading edge slot. The trailing edge may be rearward of the central region. The golf club head may include a leading edge insert to fit into the leading edge slot. The leading edge insert may include an insert body forming a part of the sole in an installed position, and an insert channel. The insert channel may be oriented toward an interior cavity of the body.

In embodiments, the leading edge slot may be within 1.0 mm of the face.

In embodiments, an insert width of the leading edge insert may be greater than an insert depth of the leading edge insert.

In embodiments, the leading edge slot may include a rear slot wall extending upward into the interior cavity of the body. The insert body may include a retaining component to secure the insert body to the rear slot wall into the installed position.

In embodiments, the installed position may be defined by fully inserting the leading edge insert into the leading edge slot.

In embodiments, in the installed position, an exterior surface of the leading edge insert may be flush with surrounding regions of the sole.

In embodiments, the leading edge insert may further include a rear portion. The insert body may include a first material. The rear portion may include a second material different from the first material.

In accordance with some aspects of the presently disclosed technology, a golf club head may include a body. The body may include a face and a sole. The sole may include a leading edge slot. The golf club head may include a leading edge insert to fit into the leading edge slot. The leading edge insert may include an insert body, a central layer, and a top layer. The insert body may include a first material. A bottom of the insert body may form a part of the sole in an installed position. The central layer may include a second material different from the first material. The central layer may be positioned above the insert body. The top layer may include the first material. The top layer may be positioned above the central layer.

In embodiments, the first material may include a polymer. The second material may include a metal.

In embodiments, the insert body may include first supporting members. The central layer may include second supporting members. The top layer may include third supporting members. The first supporting members, the second supporting members, and the third supporting members may include a first material.

In embodiments, the leading edge insert may further include an insert channel oriented toward an interior cavity of the body.

In embodiments, the leading edge slot may be located immediately rearward of the leading edge.

Embodiments of the presently disclosed technology may include golf club heads. In accordance with some aspects of the presently disclosed technology, a golf club head may include a body. The body may include a face, a crown, a first sole portion, a leading edge, a second sole portion, a trailing edge, and a sole opening. The crown may extend backward from a top of the face. The first sole portion may extend backward from a bottom of the face a first sole distance. The leading edge may be defined as a first boundary between the face and the first sole portion. The second sole portion may extend forward from a back of the crown a second sole distance. The trailing edge may be defined as a second boundary between the back and the second sole portion. The sole opening may be between the first sole portion and the second sole portion exposing an interior cavity of the golf club head. The golf club head may include an insert to fit into the sole opening. The insert may include a sole insert and a frontal sole insert. The sole insert may be detachably connected to the second sole portion. The sole insert may cover at least a part of the second sole portion. The frontal sole insert may be in contact with at least a faceward surface of the sole insert. The frontal sole insert may separate the sole insert from the face In embodiments, the second sole portion may be substantially planar. The second sole portion may be offset above the first sole portion by an offset distance. The frontal sole insert may separate the second sole portion from the face.

In embodiments, the first sole portion may include a vertical portion separated from the face by a first distance. The vertical portion may extend from the first sole portion within the interior cavity to the crown.

In embodiments, the frontal sole insert may be in contact with a backward surface of the vertical portion. The frontal sole insert may separate the sole insert and the second sole portion from the vertical portion.

In embodiments, the second sole portion may include a sole through hole to receive a first part of a fastener. The sole insert may include an insert through hole to receive a second part of the fastener. The golf club head may further include the fastener.

In embodiments, a top surface of the sole insert may be substantially planar.

In embodiments, the sole insert may include a first sole piece. The first sole piece may include a variable thickness.

In embodiments, the sole insert may include a weight.

In embodiments, the weight may be integrated into the sole insert.

In embodiments, the sole insert may include a post hole. The frontal sole insert may include a post to fit into the post hole.

In embodiments, the frontal sole insert may be removably couplable to the sole insert.

In accordance with some aspects of the presently disclosed technology, a golf club head may include a body. The body may include a face, a crown, a first sole portion, a second sole portion, and a sole opening. The crown may extend backward from a top of the face. The first sole portion may extend backward from a bottom of the face a first sole distance. The first sole portion may be substantially planar. The second sole portion may extend forward from a back of the crown a second sole distance. The second sole portion may be substantially planar. The second sole portion may be offset above the first sole portion by an offset distance. The sole opening may be between the first sole portion and the second sole portion exposing an interior cavity of the golf club head. The golf club head may include an insert to fit into the sole opening. The insert may include a sole insert and a frontal sole insert. The sole insert may be detachably connected to the second sole portion. The sole insert may cover at least a part of the second sole portion. The frontal sole insert may be in contact with at least a faceward surface of the sole insert. The frontal sole insert may separate the sole insert from the face.

In embodiments, the first sole portion may include a vertical portion separated from the face by a first distance. The vertical portion may extend from the first sole portion within the interior cavity to the crown.

In embodiments, the frontal sole insert may be in contact with a rearward surface of the vertical portion. The frontal sole insert may separate the sole insert and the second sole portion from the vertical portion.

In embodiments, the second sole portion may include a sole through hole to receive a first part of a fastener. The sole insert may include an insert through hole to receive a second part of the fastener. The golf club head may further include the fastener.

In embodiments, a top surface of the sole insert may be substantially planar.

In embodiments, the sole insert may include a first sole piece. The first sole piece may include a variable thickness.

In embodiments, the sole insert may include a weight.

In embodiments, the weight may be integrated into the sole insert.

In accordance with some aspects of the presently disclosed technology, a golf club head may include a body. The body may include a face, a crown, a first sole portion, a second sole portion, and a sole opening. The crown may extend backward from a top of the face. The first sole portion may extend backward from a bottom of the face a first sole distance. The second sole portion may extend forward from a back of the crown a second sole distance. The second sole portion may be offset above the first sole portion by an offset distance. The sole opening may be between the first sole portion and the second sole portion exposing an interior cavity of the golf club head. The golf club head may include an insert to fit into the sole opening. The insert may include a sole insert and a frontal sole insert. The sole insert may be detachably connected to the second sole portion. The sole insert may cover at least a part of the second sole portion. The sole insert may include a post hole. The frontal sole insert may be in contact with at least a faceward surface of the sole insert. The frontal sole insert may separate the sole insert and the second sole portion from the face. The frontal sole insert may include a post to fit into the post hole.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Figure 1:
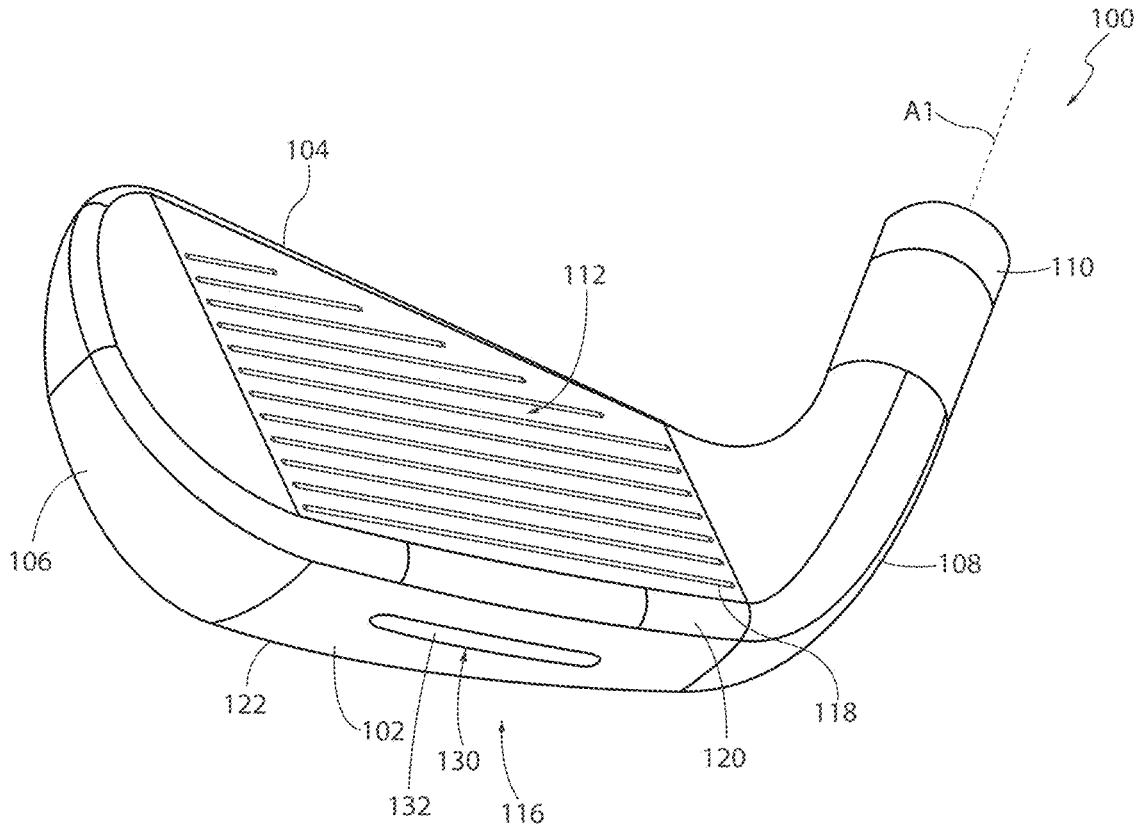
FIG. 1 of the accompanying drawings shows a perspective view of a golf club head in accordance with an exemplary embodiment of the present invention.

These and other features of the presently disclosed technology, as well as the methods of operation and functions of the related elements of structure and the combination of parts, may be clearer upon consideration of the following detailed description and the claims with reference to these drawings, all of which form a part of this specification, with like reference numerals designating corresponding parts in the various figures. It is to be expressly understood that these drawings are for illustration purposes and description and are not intended to be limiting. It should be noted that for clarity and ease of illustration these drawings are not necessarily made to scale. As used in the specification and in the claims, the singular form of "a", "an", and "the" may include plural referents unless the context clearly dictates otherwise.

DETAILED DESCRIPTION OF THE INVENTION

In embodiments, the detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention. Furthermore, various inventive features are described below and each can be used independently of one another or in combination with other features.

Figure 2:
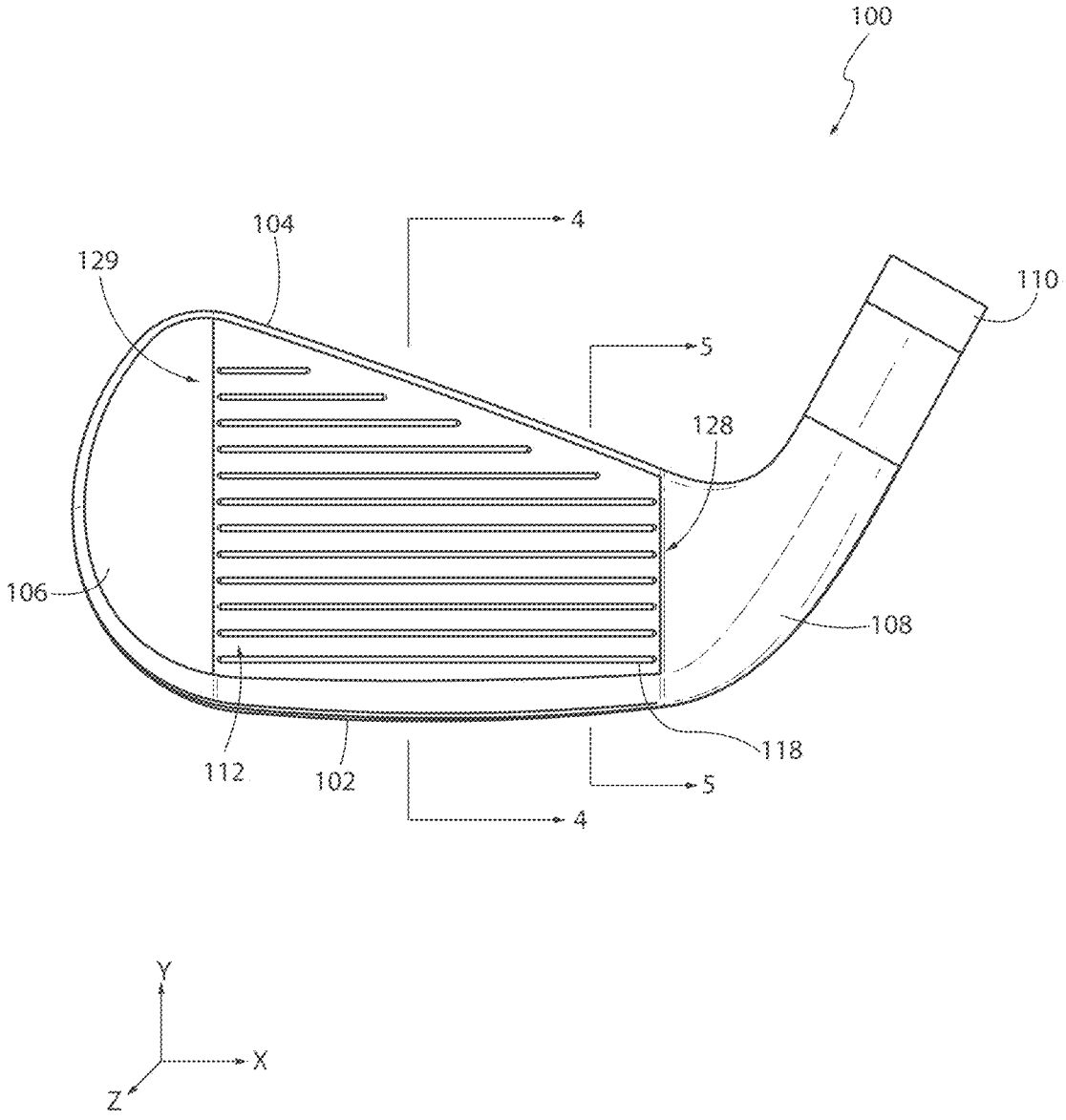
FIG. 2 of the accompanying drawings shows a front elevation view of an embodiment of the golf club head shown in FIG. 1.
Figure 3:
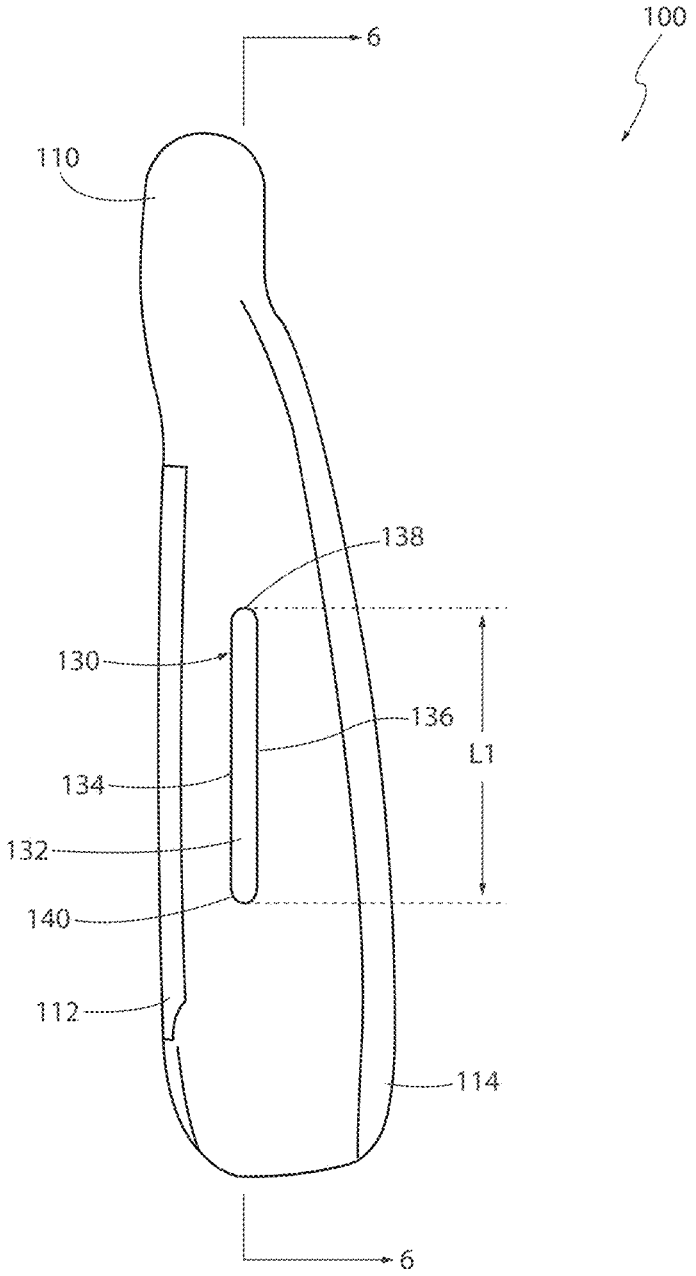
FIG. 3 of the accompanying drawings shows a bottom plan view of an embodiment of the golf club head shown in FIG. 1.

With reference to FIGS. 1-6, the golf club head 100 can be any of the various irons (including wedges and hybrids) used in the game of golf, such as the 3 iron, 4 iron, 5 iron, 6 iron, 7 iron, 8 iron, 9 iron, the pitching wedge, sand wedge, and the like. As shown in FIGS. 1-3, the golf club head 100 can generally have a sole 102; a topline 104 opposite the sole 102; a toe portion 106 adjacent to the sole 102 and the topline 104; a heel portion 108 opposite the toe portion 106 and adjacent to the sole 102 and the topline 104; a striking face 112 adjacent to the sole 102, topline 104, toe portion 106, and heel portion 108; a back portion 114 opposite the striking face 112 and adjacent to the sole 102, topline 104, toe portion 106, and heel portion 108; and a hosel 110 adjacent to the heel portion 108 and topline 104. The hosel 110 defines a longitudinal shaft axis A1 and is configured to receive a shaft. The striking face 112 can further be characterized with a plurality of horizontal scorelines 118, which helps control the spin of a golf ball that comes in contact with the striking face 112 of the golf club head 100.

For ease of description, the striking face portion 112 will be referred to as the front side of the golf club head 100. As such, the striking face portion 112 is located at a frontal portion of the golf club head 100. As a result, the back portion 114 is located behind the striking face portion 112; the topline 104 is located at an upper portion of the golf club head 100; the heel portion 108 is located at a proximal end of the golf club head 100; the toe portion 106 is located at a distal end of the golf club head 100 opposite the heel portion 108; and the sole 102 is located at a lower portion of the golf club head 100 opposite the topline 104. An axis of origin 12 is provided (for reference only for ease and clarity of description) indicating the x-y-z direction relative to the golf club head 100 in the examples provided.

Figure 4:
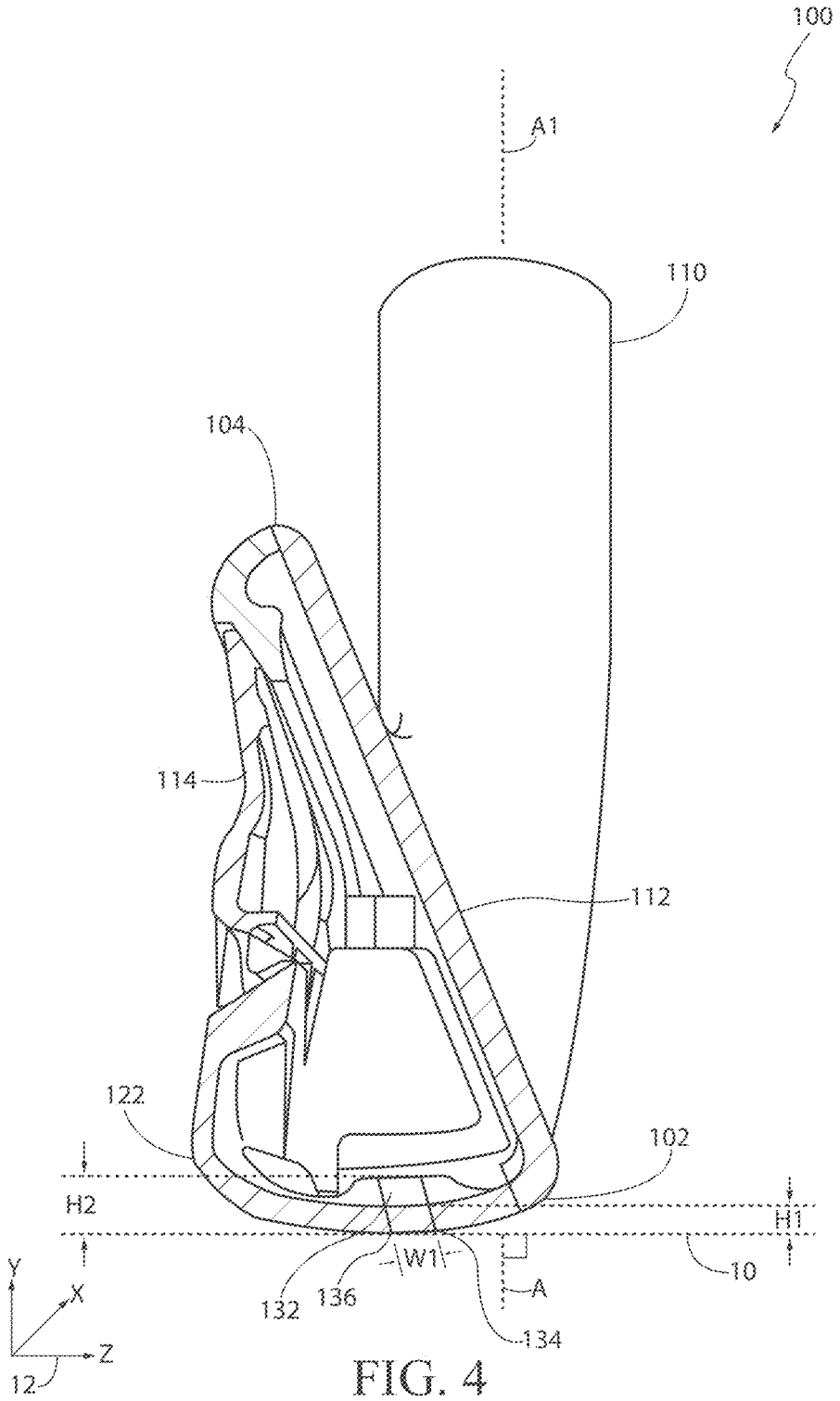
FIG. 4 of the accompanying drawings shows a cross section from a toe side view of an embodiment of the golf club head shown in FIG. 2 taken along line 4-4.

The golf club head 100 comprises a leading edge 120 located approximately where the striking face 112 meets the sole 102; a trailing edge 122 adjacent to the back portion 114 and the sole 102; and the sole 102 in between the leading edge 120 and the trailing edge 122. The leading edge 120 can be defined in the current application as approximately the most forward edge of the golf club head 100 (in the z-direction), with the hosel 110 in an upright 90 degree (perpendicular) position from a ground plane 10 (in the front-to-back, z-axis direction) as shown in FIG. 4. (The ground plane 10 is an imaginary plane located and in contact with the lowest portion of the golf club head 100, and mimics the surface of the ground upon which the golf ball would lie.) This leading edge 120 is then defined as approximately the forward most edge along the z-axis (as indicated by the axis of origin 12) generally where the striking face 112 meets the sole 102.

The trailing edge 122 is defined as approximately the most rearward edge of the sole portion 102 of the golf club head 100 (in the z-direction), again with the hosel 110 in a 90 degree (perpendicular) position from the ground plane 10 (in the front-to-back, z-axis direction), generally where the sole 102 and the back portion 114 meet.

Figure 5:
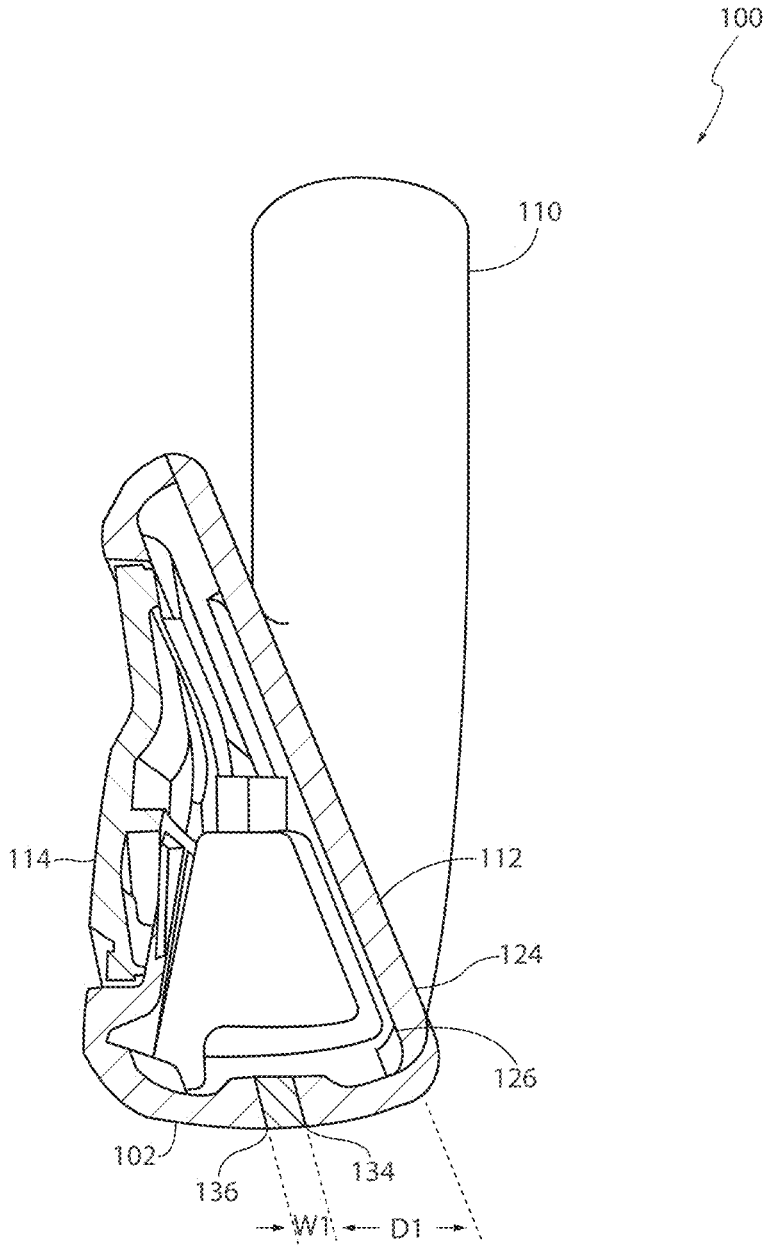
FIG. 5 of the accompanying drawings shows a cross section from a toe side view of an embodiment of the golf club head shown in FIG. 2 taken along line 5-5.

The invention of the present application incorporates a strategically positioned slot 130 on the sole 102 of the golf club head 100 to improve the performance of the golf club head 100. The slot 130 houses a weighted insert 132. Golf clubs with sole inserts typically position the inserts about the center of the sole in the z direction (front-to-back direction). In the invention of the present application, however, the slot 130 (and therefore, the weighted insert 132) is moved forward towards the striking surface 112. As shown in FIG. 5, the striking surface 112 is defined by an outer wall 124, which actually contacts the golf ball, and an inner wall 126 opposite the outer wall 124 and internal to the golf club head 100, thereby providing thickness to the striking surface 112.

The slot 130 is characterized as having a front edge 134, and back edge 136 opposite the front edge 134 and towards the back relative to the front edge 134, a proximal edge 138 adjacent the heel-side of the golf club head 100, and a distal edge 140 adjacent to the toe-side of the golf club head 100. The slot 130 has a width W1 as measured from the front edge 134 to the back edge 136 (see, FIG. 4), and a length L1 as measured from the proximal edge 138 to the distal edge 140 (see, FIG. 3). The distance D1 of the slot 130 from the striking surface 112 is determined as the shortest distance from the front edge 134 of the slot 130 to a plane defined by the inner wall 126 of the striking surface 112 (see, FIG. 5).

The distance D1 of the front edge 134 of the slot 130 to the plane of the inner wall 126 of the striking surface 112 can be about 0 mm to about 8.0 mm. A distance D1 of 0 mm means that the inner wall 126 of the striking surface 112 is in line with or can make up the front edge 134 of the slot 130. In some embodiments, the distance D1 of the front edge 134 of the slot 130 to the plane of inner wall 126 of the striking surface 112 can be less than about 6.0 mm. In some embodiments, the distance D1 of the front edge 134 of the slot 130 to the plane of the inner wall 126 of the striking surface 112 can be less than about 4.0 mm. Preferably, the distance D1 of the front edge 134 of the slot 130 to the plane of the inner wall 126 of the striking surface 112 is less than about 3.5 mm. For example, the distance D1 of the front edge 134 of the slot 130 to the plane of the inner wall 126 of the striking surface 112 can be 3.4 mm or less, 3.3 mm or less, 3.2 mm, 3.1 mm, 3.0 mm, or less. More preferably, the distance D1 of the front edge 134 of the slot 130 to the plane of the inner wall 126 of the striking surface 112 is about 2.5 mm or less. Most preferably, the distance D1 of the front edge 134 of the slot 130 to the plane of the inner wall 126 of the striking surface 112 is about 2.0 mm or less. Preferably, the distance D1 of the slot 130 to the striking surface 112 is generally a uniform distance throughout the length L1 of the slot 130.

Figure 6:
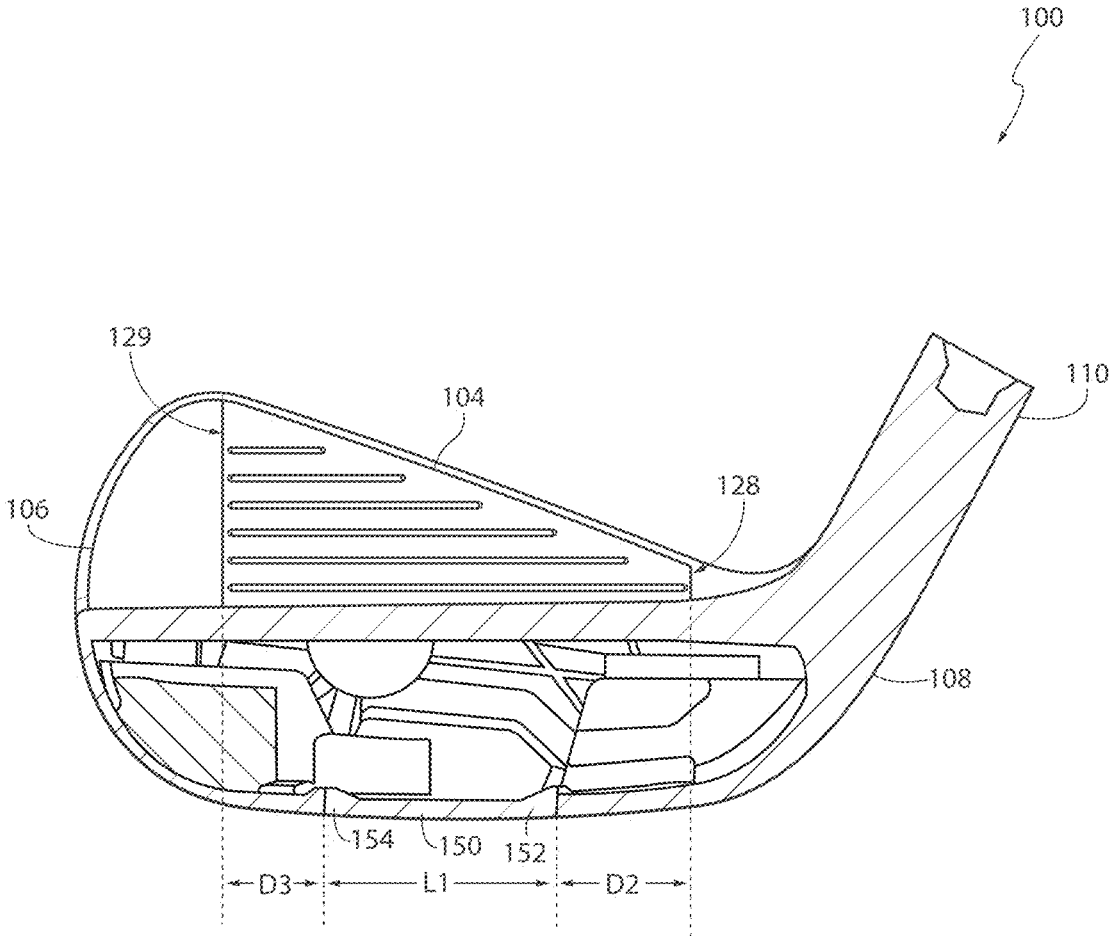
FIG. 6 of the accompanying drawings shows a cross section from a front side view of an embodiment of the golf club head shown in FIG. 3 taken along line 6-6.

As shown in FIG. 6, the slot 130 can also be characterized by its distance from the proximal end 128 (or heel end) of the striking surface 112 (which is essentially where the bottom scoreline 118 ends at the heel portion 108), and its distance from the distal end 129 (or toe side) of the striking surface 112 (which is essentially where the bottom scoreline 118 ends at the toe portion 106). The distance D2 from the slot 130 to the proximal end 128 is defined as the shortest distance from the proximal edge 138 of the slot 130 to a y-z plane defined by the proximal end 128 of the striking face 112. The distance D2 from the proximal edge 138 of the slot 130 to the y-z plane of the proximal end 128 of the striking surface 112 can be about 5 mm to about 25 mm. Preferably, the distance D2 from the proximal edge 138 of the slot 130 to the y-z plane of the proximal end 128 of the striking surface 112 can be about 10 mm to about 20 mm. More preferably, the distance D2 from the proximal edge 138 of the slot 130 to the y-z plane of the proximal end 128 of the striking surface 112 can be about 12 mm to about 16 mm.

Similarly, distance D3 from the slot 130 to the distal end 129 of the striking surface 112 is defined as the shortest distance from the distal edge 140 of the slot 130 to a y-z plane defined by the distal end 129 of the striking surface 112. The distance D3 from the distal edge 140 of the slot 130 to the y-z plane of the distal end 129 of the striking surface 112 can be about 5 mm to about 25 mm. Preferably, the distance D3 from the distal edge 140 of the slot 130 to the y-z plane of the distal end 129 of the striking surface 112 can be about 10 mm to about 20 mm. More preferably, the distance D3 from the distal edge 140 of the slot 130 to the y-z plane of the distal end 129 of the striking surface 112 can be about be about 12 mm to about 16 mm.

The slot 130 can also be characterized by its width W1 as measured from the front edge 134 to the back edge 136. The width W1 of the slot 130 can be about 1.0 mm to about 4.0 mm. Preferably, the width W1 of the slot 130 can be about 1.5 mm to about 3.5 mm. More preferably, the width W1 of the slot 130 can be about 2.0 mm to about 3.0 mm.

The slot 130 can further be characterized by its length L1 as measured from the proximal edge 138 to the distal edge 140. In the preferred embodiment, the slot 130 is generally stadium shape having a generally straight front edge 134 and a generally straight back edge 136 with a curved proximal edge 138 and a curved distal edge 140. However, the slot 130 can have other shapes, such as rectangular, oval, and other elongated shapes. The length L1 of the slot 130 can be about 20 mm to about 40 mm. Preferably, the length L1 of the slot 130 can be about 25 mm to about 35 mm. More preferably, the length L1 of the slot 130 can be about 27 mm to about 32 mm.

The insert 132 is shaped and dimensioned to fit inside the slot 130, and can be characterized by its shape. From a bottom plan view as shown in FIG. 3, the insert 132 can be generally stadium or pill shaped having elongated sides and curved ends, like the slot 130, although other shapes can also be used, such as rectangle, oval, and the like. From a front side elevation view as shown in FIG. 6, the insert 132 can be comprised of a main body 150 portion terminating at opposing proximal end portion 152 and distal end portion 154. The length L2 of the insert 132 is measured from the proximal end portion 152 to the distal end portion 154, and the height H1 of the insert 132 is measured from a bottom surface of the insert 132 to a top surface of the insert 132.

In some embodiments the height of the insert H1 as measured from a bottom surface to a top surface can be uniform throughout the entire length L2 of the insert 132. As such, inserts 132 with a uniform height H1 can range from about 1 mm to about 5 mm. Preferably, the height H1 of the insert 132 is less than about 5 mm. More preferably, the height H1 of the insert 132 is less than about 4 mm. Most preferably, the height H1 of the insert 132 is less than about 3 mm.

In the preferred embodiment, the insert 132 can have a non-uniform height H1. For example, the proximal end portion 152 and distal end portion 154 of the insert 132 can be raised relative to the main body 150 so that the height H1 of the body 150, which makes up a central portion of the insert 132 is less than the heights H2, H3 of the proximal and distal end portions 152, 154. As such, as the insert 132 progresses from the central portion of the body 150 towards the proximal end portion 152 and the distal end portion 154, the height of the insert 132 can gradually increase, remain flat then gradually increase after a specific point, or remain flat and abruptly increase (step up) at the proximal end portion 152 and distal end portion 154. In some embodiments, the central portion may be recessed, thereby creating a narrow channel in the central portion surrounded by a raised rim (see, e.g., FIG. 11).

For inserts 132 with non-uniform height, the height H1 of the body 150 of the insert 132 can be about 1.0 mm to about 2.5 mm. Preferably, the height H1 of the body 150 of the insert 132 can be about 1.3 mm to about 2.3 mm. More preferably, the height H1 of the body 150 of the insert 132 can be about 1.6 mm to about 2.0 mm. The heights H1, H2 at the proximal end portion 152, the distal end portion 154, or a perimeter rim surrounding the body 150, can each be about 2.0 mm to about 4.0 mm. Preferably, the heights H1, H2 at the proximal end portion 152 and distal end portions 154 can each be about 2.5 mm to about 3.5 mm. More preferably, the heights H1, H2 at the proximal end portion 152 and distal end portions 154 can each be about 2.8 mm to about 3.2 mm.

The overall length L2 of the insert 132 as measured from the proximal end portion 152 to the distal end portion 154 is substantially similar to the length L1 of the slot 130. As such, the overall length L2 of the insert 132 can be about 20 mm to about 40 mm. Preferably, the overall length L2 of the insert 132 can be about 25 mm to about 35 mm. More preferably, the overall length L2 of the insert 132 can be about 27 mm to about 32 mm.

The length L3 of the main body portion 150 of the insert 132 (e.g., the uniformly flat portion of the insert 132 in between the proximal end portion 152 and distal end portion 154 as shown in FIG. 6) can be about 13 mm to about 25 mm. Preferably, the length L3 of the main body portion 150 of the insert 132 can be about 15 mm to about 23 mm. More preferably, the length L3 of the main body portion 150 of the insert 132 can be about 17 mm to about 21 mm.

Figure 7:
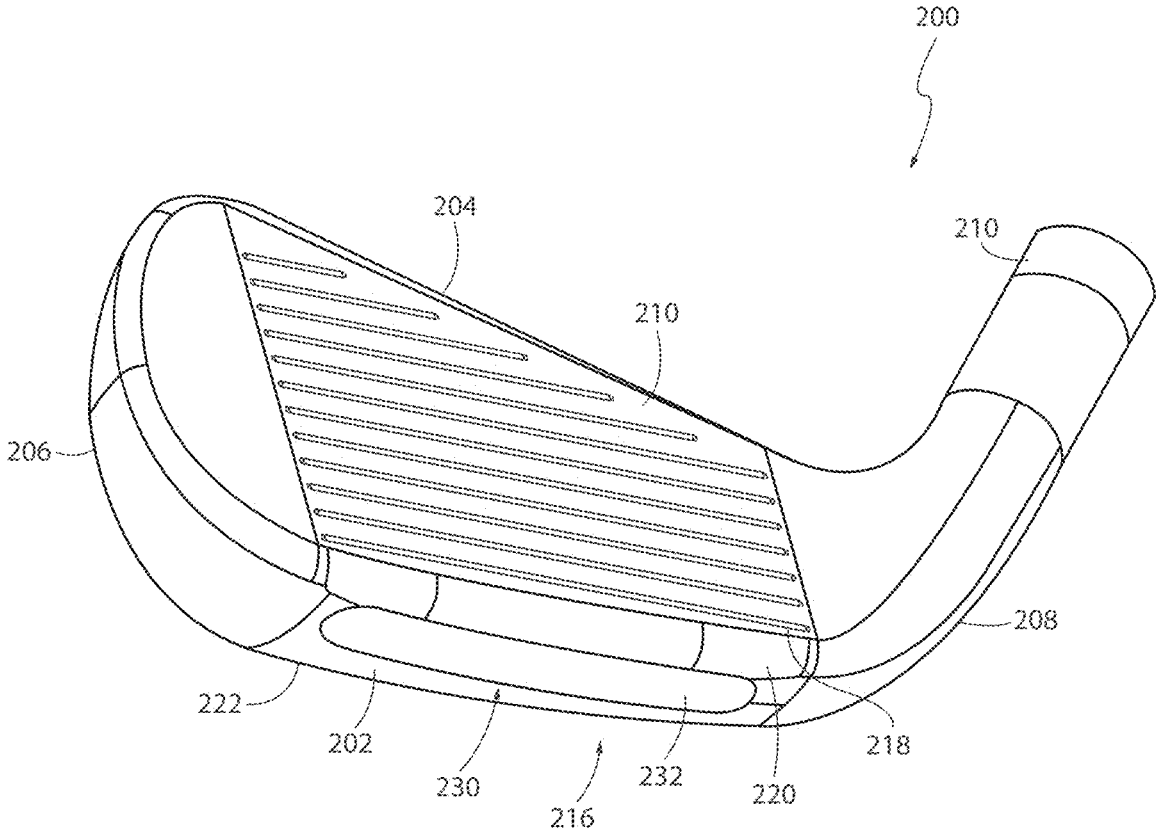
FIG. 7 of the accompanying drawings shows a perspective view of another embodiment of a golf club head in accordance with an exemplary embodiment of the present invention.
Figure 8:
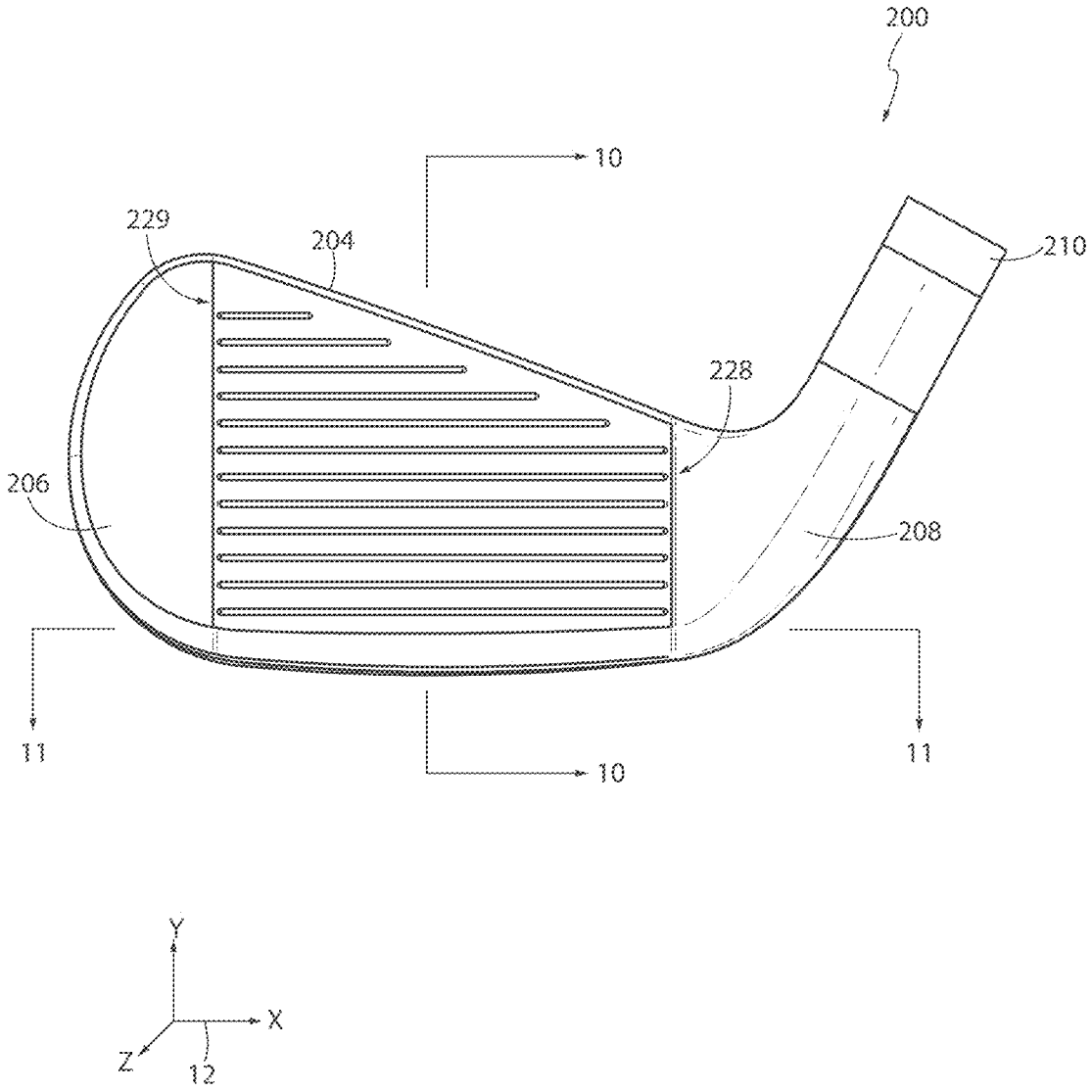
FIG. 8 of the accompanying drawings shows a front elevation view of an embodiment of the golf club head shown in FIG. 7.
Figure 9:
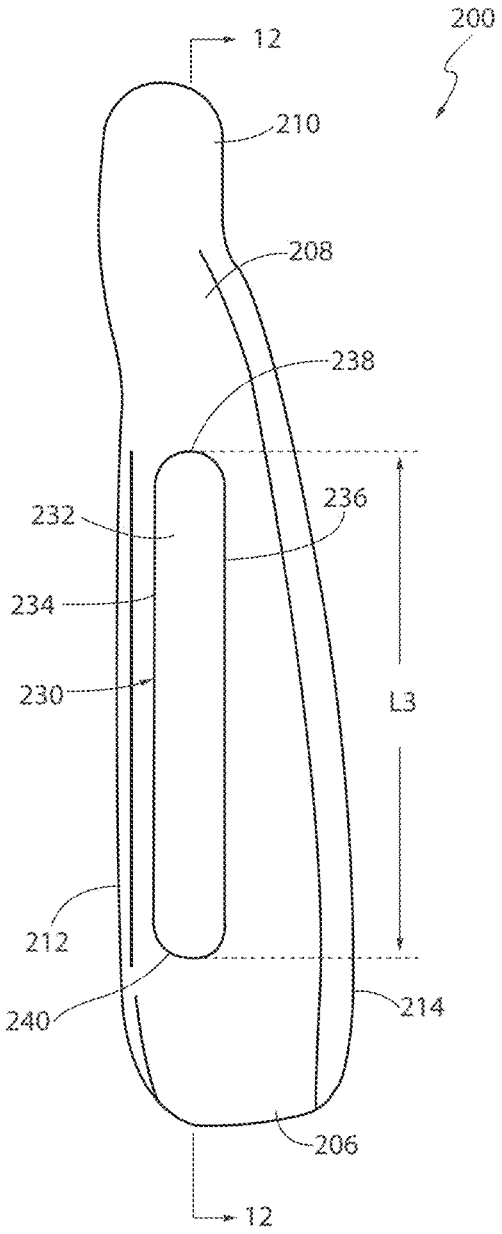
FIG. 9 of the accompanying drawings shows a bottom plan view of an embodiment of the golf club head shown in FIG. 7.

With reference to FIGS. 7-12, in another embodiment of the present invention, the golf club head 200 can have the same general configuration as the golf club head 100 shown in the embodiments of FIGS. 1-6. As such, the golf club head 200, as shown in FIGS. 7-9, can generally have a sole 202; a topline 204 opposite the sole 202; a toe portion 206 adjacent to the sole 202 and the topline 204; a heel portion 208 opposite the toe portion 206 and adjacent to the sole 202 and the topline 204; a striking face 212 adjacent to the sole 202, topline 204, toe portion 206, and heel portion 208; a back portion 214 opposite the striking face 212 and adjacent to the sole 202, topline 204, toe portion 206, and heel portion 208; and a hosel 210 adjacent to the heel portion 208 and topline 204. The hosel 210 defines a longitudinal shaft axis A2 and is configured to receive a shaft. The striking face 212 can further be characterized with a plurality of horizontal scorelines 218.

The striking face portion 212 is located at a frontal portion of the golf club head 200. As a result, the back portion 214 is located opposite the striking face portion 212; the topline 204 is located at an upper portion of the golf club head 200; the heel portion 208 is located at a proximal end of the golf club head 200; the toe portion 206 is located at a distal end of the golf club head 200 opposite the heel portion 208; and the sole 202 is located at a lower portion of the golf club head 200 opposite the topline 204. An axis of origin 12 is provided (for reference only for ease and clarity of description) indicating the x-y-z direction relative to the golf club head 200 in the examples provided.

Figure 10:
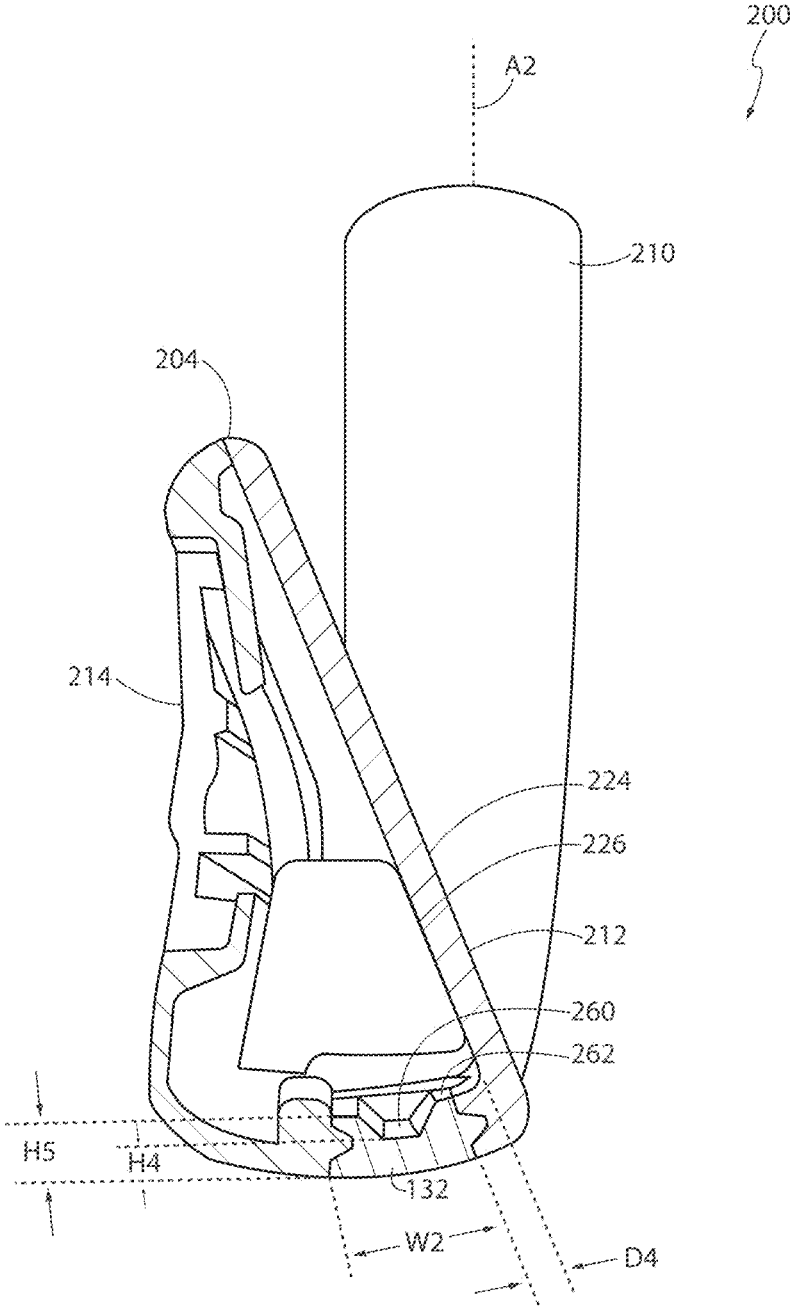
FIG. 10 of the accompanying drawings shows a cross section from a toe side view of an embodiment of the golf club head shown in FIG. 8 taken along line 10-10.

The golf club head 200 further comprises a leading edge 220 located approximately where the striking face 212 meets the sole 202; a trailing edge 222 adjacent to the back portion 214 and the sole 202; and the sole 202 in between the leading edge 220 and the trailing edge 222. The leading edge 220 can be defined in the current application as approximately the most forward edge of the golf club head 200 (in the z-direction), with the hosel 210 in an upright 90 degree (perpendicular) position from a ground plane 10 (in the front-to-back, z-axis direction) as shown in FIG. 10. This leading edge 220 is then defined as approximately the forward most edge along the z-axis (as indicated by the axis of origin 12) generally where the striking face 212 meets the sole 202.

The trailing edge 222 can be defined as approximately the most rearward edge of the sole portion 202 of the golf club head 200 (in the z-direction), again with the hosel 210 in a 90 degree (perpendicular) position from the ground plane 10 (in the front-to-back, z-axis direction), generally where the sole portion 202 and the back portion 214 meet.

The invention of the present application incorporates a strategically positioned slot 230 on the sole 202 of the golf club 200 head to improve the performance of the golf club head 200. The slot 230 houses a weighted insert 232. In the invention of the present application, however, the slot 230 (and therefore, the weighted insert 232) is moved forward towards the striking surface 212 compared to traditional golf clubs with inserts. As shown in FIG. 10, the striking surface 212 is defined by an outer wall 224, which actually contacts the golf ball, and an inner wall 226 behind the outer wall 224 and internal to the golf club head 200, thereby providing thickness to the striking surface 212.

As shown in FIG. 9, the slot 230 is characterized as having a front edge 234, back edge 236 opposite the front edge 234 and towards the back relative to the front edge 234, a proximal edge 238 adjacent the heel-side of the golf club head 200, and a distal edge 240 adjacent to the toe-side of the golf club head 200. The slot 230 has a width W2 as measured from the front edge 234 to the back edge 236, and a length L4 as measured from the proximal edge 238 to the distal edge 240. The distance D4 of the slot 230 from the striking surface 212 is determined as the shortest distance from the front edge 234 of the slot 230 to a plane defined by the inner wall 226 of the striking surface 212.

As shown in FIG. 10, the distance D4 of the front edge 234 of the slot 230 to a plane defined by the inner wall 226 of the striking surface 212 can be about 0 mm to about 8.0 mm. A distance D4 of 0 mm means that the inner wall 226 of the striking surface 212 is in line with or makes up the front edge 234 of the slot 230. In some embodiments, the distance D4 of the front edge 234 of the slot 230 to the plane of the inner wall 226 of the striking surface 212 can be less than about 6.0 mm. In some embodiments, the distance D4 of the front edge 234 of the slot 230 to the plane of the inner wall 226 of the striking surface 212 can be less than about 4.0 mm. Preferably, the distance D4 of the front edge 234 of the slot 230 to the plane of the inner wall 226 of the striking surface 212 is less than about 3.5 mm. For example, the distance D4 of the front edge 234 of the slot 230 to the plane of the inner wall 226 of the striking surface 212 can be about 3.4 mm, 3.3 mm, 3.2 mm, or less. More preferably, the distance D4 of the front edge 234 of the slot 230 to the plane of the inner wall 226 of the striking surface 212 can be about 2.5 mm or less. Most preferably, the distance D4 of the front edge 234 of the slot 230 to the plane of the inner wall 226 of the striking surface 212 can be about 2.0 mm or less. Preferably, the distance D4 of the slot 230 to the striking surface 212 is generally a uniform distance throughout the length L4 of the slot 230.

Figure 11:
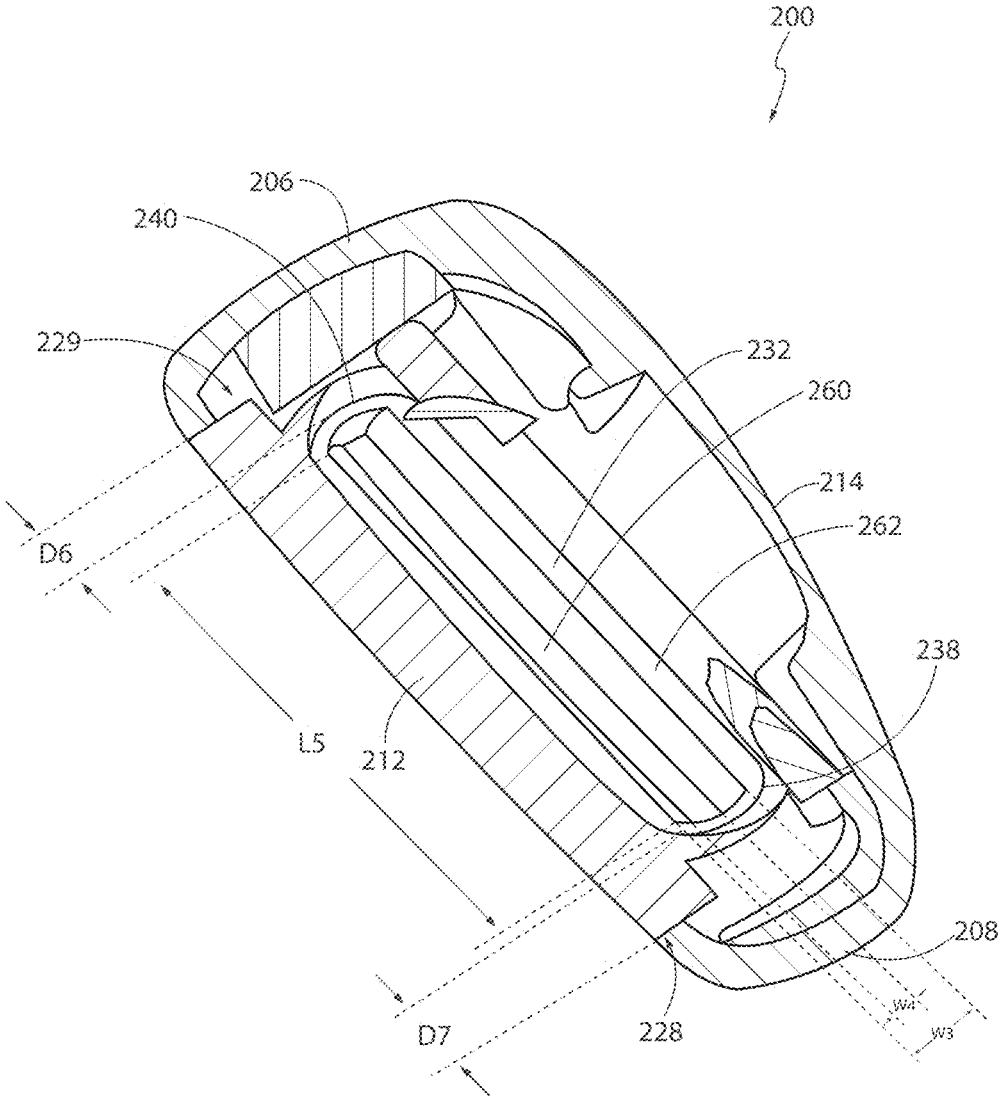
FIG. 11 of the accompanying drawings shows a cross section from a top plan view of an embodiment of the golf club head shown in FIG. 8 taken along line 11-11.
Figure 12:
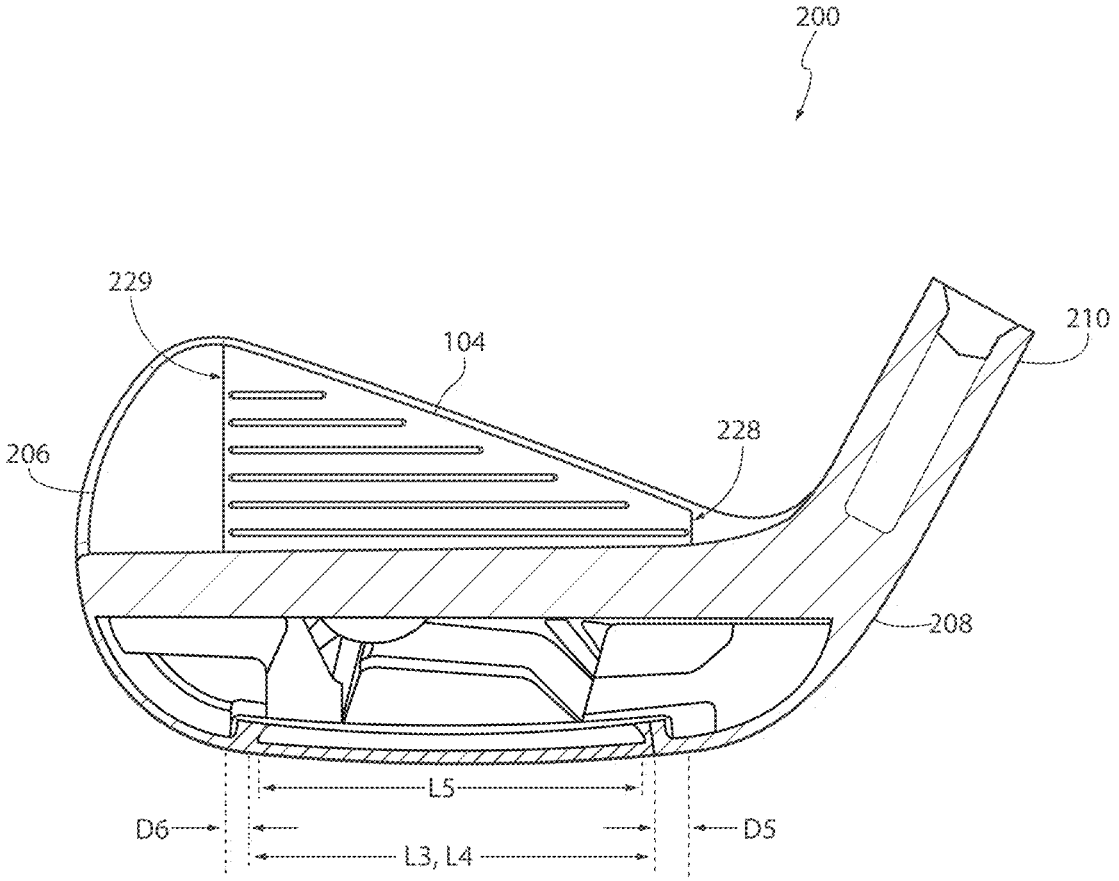
FIG. 12 of the accompanying drawings shows a cross section from a front elevation view of an embodiment of the golf club head shown in FIG. 9 taken along line 12-12.

As shown in FIG. 11, the slot 230 can also be characterized its distance from the proximal end 228 (or heel end) of the striking surface 212 (which is essentially where the bottom scoreline 218 ends at the heel portion 208), and its distance from the distal end 229 (or toe side) of the striking surface 212 (which is essentially where the bottom scoreline 218 ends at the toe portion 206). The distance D5 of the slot 230 to the proximal end 228 is defined as the shortest distance from the proximal edge 238 to a y-z plane defined by the proximal end 228 of the striking surface 212. The distance D5 from the proximal edge 238 of the slot 230 to the y-z plane defined by the proximal end 228 of the striking surface 212 can be about 3.4 mm to about 4.6 mm. Preferably, the distance D5 from the proximal edge 238 of the slot 230 to the y-z plane defined by the proximal end 228 of the striking surface 212 can be about 3.6 mm to about 4.4 mm. More preferably, the distance D5 from the proximal edge 238 of the slot 230 to the y-z plane defined by the proximal end 228 of the striking surface 212 can be about 3.8 mm to about 4.2 mm.

Similarly, the distance D6 of the slot 230 to the distal end 229 is defined as the shortest distance from the distal edge 240 of the slot 230 to a y-z plane defined by the distal end 229 of the striking surface 212. The distance D6 from the distal edge 240 of the slot 230 to the y-z plane of the distal end 229 of the striking surface 212 can be about 3.4 mm to about 4.6 mm. Preferably, the distance D6 from the distal edge 240 of the slot 230 to the y-z plane of the distal end 229 of the striking surface 212 can be about 3.6 mm to about 4.4 mm. More preferably, the distance D6 from the distal edge 240 of the slot 230 to the y-z plane of the distal end 229 of the striking surface 212 can be about 3.8 mm to about 4.2 mm.

The slot 230 can also be characterized by its width W2 as measured from the front edge 234 to the back edge 236. The width W2 of the slot 230 can be about 4.0 mm to about 13.0 mm. Preferably, the width W2 of the slot 230 can be about 6.0 mm to about 11.0 mm. More preferably, the width W2 of the slot 230 can be about 8.0 mm to about 9.0 mm.

The slot 230 can further be characterized by its length L4 as measured from the proximal edge 238 to the distal edge 240. In the preferred embodiment, the slot 230 is generally stadium shape having a generally straight front edge 234 and a generally straight back edge 236 with a curved proximal edge 238 and a curved distal edge 240. However, the slot 230 can have other shapes, such as rectangular, oval, and other elongated shapes. The length L4 of the slot 230 can be about 40 mm to about 55 mm. Preferably, the length L4 of the slot 230 can be about 43 mm to about 52 mm. More preferably, the length L4 of the slot 230 can be about 46 mm to about 50 mm.

The insert 232 is shaped and dimensioned to fit inside the slot 230, and can be characterized by its shape. From a bottom plan view as shown in FIG. 9, the insert 232 can be generally stadium or pill shaped having straight, elongated sides and curved ends, like the slot 230, although other shapes can also be used, such as rectangle, oval, and the like. In some embodiments, the insert 132 can have a uniform height as measured from a bottom surface of the insert 232 to a top surface of the insert 232. In the preferred embodiment, as shown in FIGS. 10 and 11, the insert 232 can have a non-uniform height. In other words, different portions of the insert 232 can have different heights. For example, the terminal ends of the insert 132 can have a greater height than a central portion 260 of the insert 232. In some embodiments, the central portion 260 of the insert 132 can be recessed. A recessed central portion 260 results in a height H4 of the recessed central portion 260 of the insert 232 to be smaller than a height H5 of an outer rim portion 262 of the insert 232. The central recessed portion 260 is not required to be centered within the insert 232, rather it refers to being located towards the center area relative to the perimeter edges of the insert 232.

As such, the insert 232 of the preferred embodiment can have two heights, a first height H4 as measured from the bottom of the insert 232 to the recessed central portion 260 (i.e. the thickness of the recessed central portion 260), and a second height H5 of the insert 232 as measured from the bottom of the insert 232 to the top of the rim 262 of the insert 232. The height H4 of the recessed central portion 26 can be about 1.0 mm to about 2.5 mm. Preferably, the height H4 of the recessed central portion 260 of the insert 132 can be about 1.3 mm to about 2.3 mm. More preferably, the height H4 of the recessed central portion 260 of the insert 132 can be about 1.6 mm to about 2.0 mm. The height H5 of the rim 262 of the insert 232 can be about 2.0 mm to about 4.0 mm. Preferably, the height H5 of the rim 262 can be about 2.5 mm to about 3.5 mm. More preferably, the height H5 of the rim 262 can be about 2.8 mm to about 3.2 mm.

The overall length L5 of the insert 232 is substantially similar to the length L4 of the slot 230 into which the insert 232 is to be inserted. As such, the overall length L5 of the insert 232 can be about 40 mm to about 55 mm. Preferably, the overall length L5 of the insert 232 can be about 43 mm to about 52 mm. More preferably, the overall length L5 of the insert 232 can be about 46 mm to about 50 mm.

The length L6 of the recessed central portion 260 of the insert 232 can be about 39 mm to about 51 mm. Preferably, the length L6 of the recessed central portion 260 of the insert 232 can be about 41 mm to about 49 mm. More preferably, the length L6 of the recessed central portion 260 of the insert 232 can be about 43 mm to about 47 mm. The wall surrounding the recessed portion can be a vertical wall, a ramped wall, a curved wall, a stepped wall, and the like, as the wall descends from the rim 262 to the recessed central portion 260. As such, the width W3 as measured from the inner edge of the rim 262 can be larger than the width W4 of the recessed central portion 260. For example, the width W3 of the inner edge of the rim 262 can be about 3.0 mm to about 6.0 mm. Preferably, the width W3 of the inner edge of the rim 262 can be about 3.5 mm to about 5.5 mm. More preferably, the width W3 of the inner edge of the rim 262 can be about 4.0 mm to about 5.0 mm. The width W4 of the recessed central portion 260 of the insert 232 can be about 1.0 mm to about 3.0 mm. Preferably, the width W4 of the recessed central portion 260 of the insert 232 can be about 1.5 mm to about 2.5 mm. More preferably, the width W4 of the recessed central portion 260 of the insert 232 can be about 1.8 mm to about 2.2 mm.

In any of the embodiments disclosed herein, it may be desirable to facilitate fixture of the insert inside its respective slot. For example, as shown in FIG. 10, the insert 232 may comprise a protrusion 264. In the embodiment shown in FIG. 10, the protrusion 264 is a forward protrusion (toward the striking face 212) from the front side of the insert 232. However, the protrusion 264 can also be a rearward protrusion (towards the back portion 214) from the back side of the insert 232, a lateral protrusion (towards the heel 208 or the toe 206) from the toe side or heel side of the insert 232, or any combination thereof. Alternatively, the insert 232 can have an indentation 266 on the front, back or sides, or any combination thereof. By way of example only, FIG. 10 shows a forward protrusion 264 on the front side of the insert 232 with a rear indentation 266 on the back side of the insert 232. Where there is a protrusion 264 or indentation 266 on the insert 232, there can be a corresponding protrusion or indentation in the slot 230 to mate with the insert 232. Although the protrusion 264 and indentation 266 have been disclosed with the present embodiment, the concept can be applied to any embodiment disclosed herein.

Figure 13:
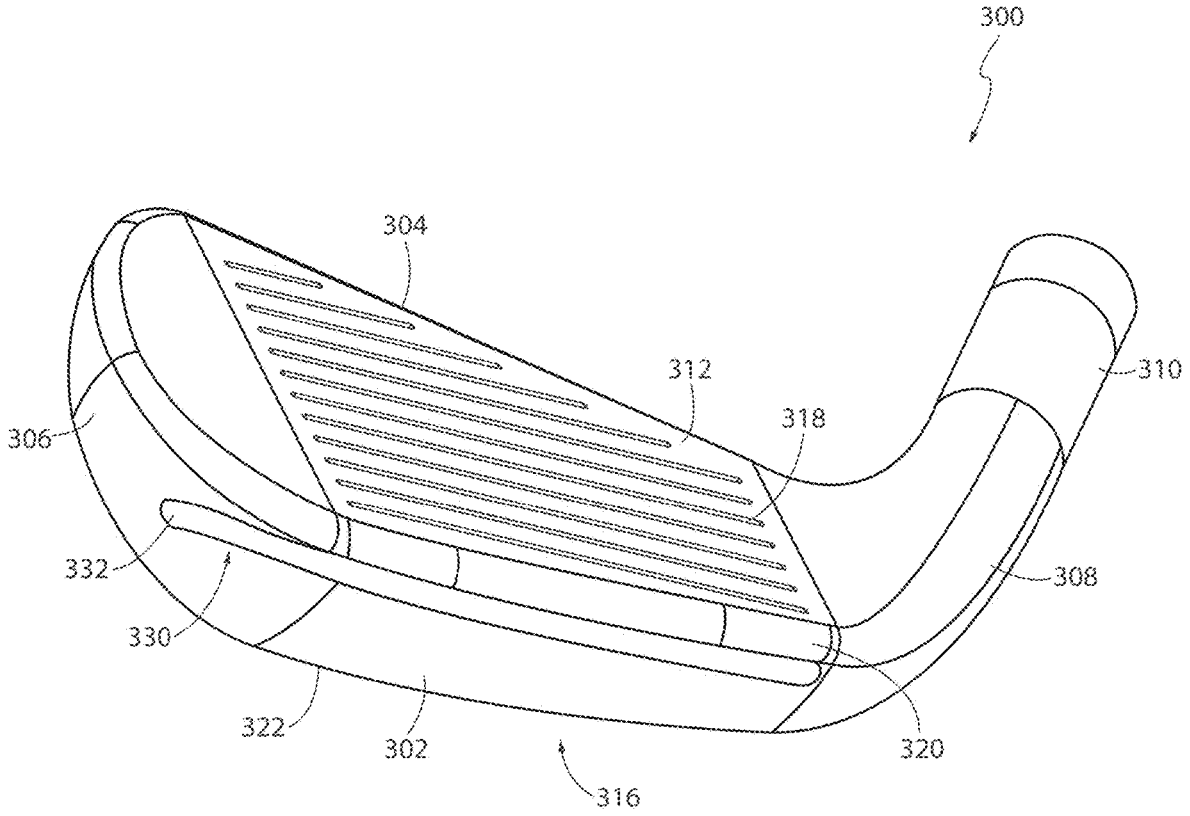
FIG. 13 of the accompanying drawings shows a perspective view of another embodiment of a golf club head in accordance with an exemplary embodiment of the present invention.
Figure 14:
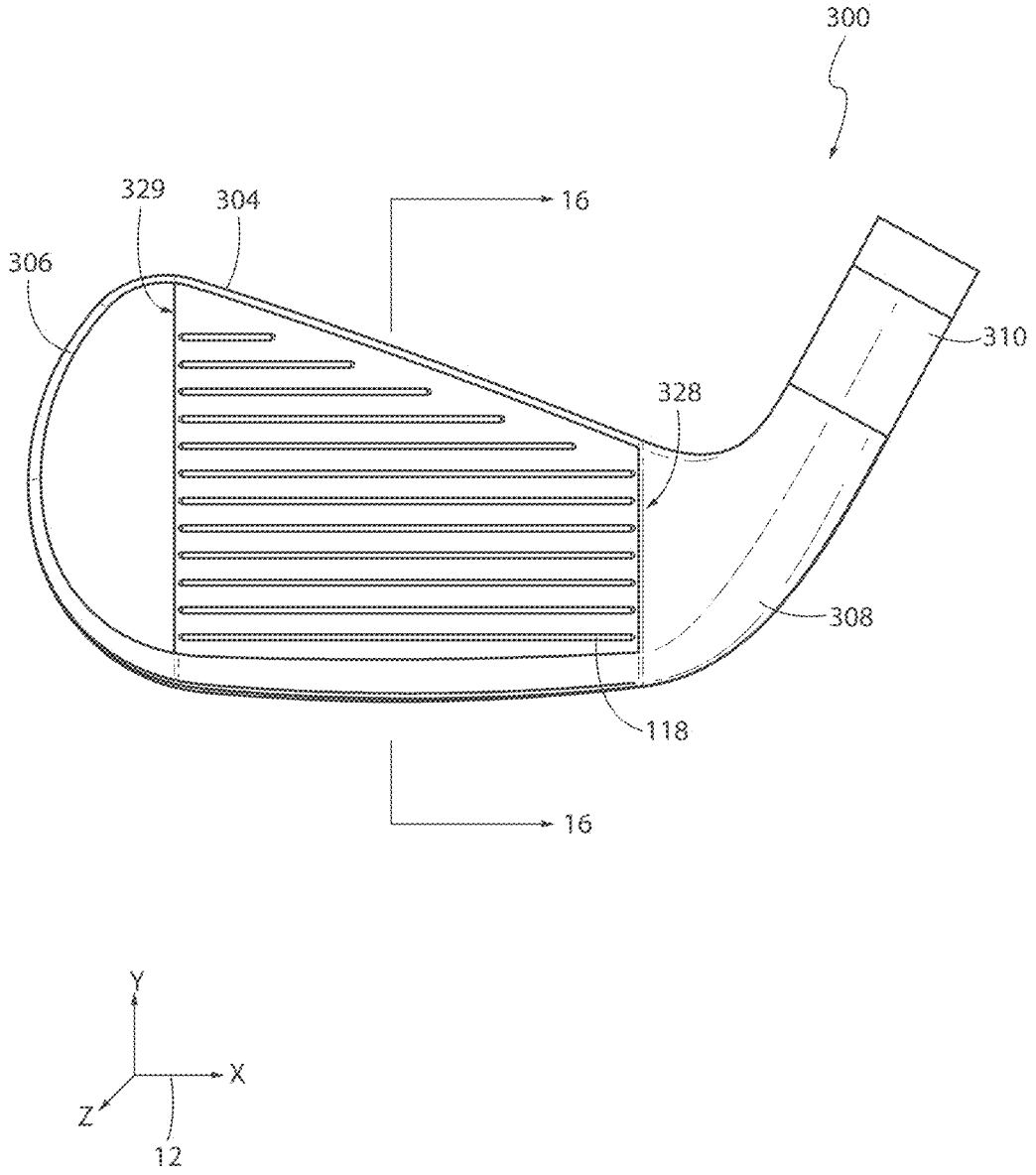
FIG. 14 of the accompanying drawings shows a front elevation view of an embodiment of the golf club head shown in FIG. 13.
Figure 15:
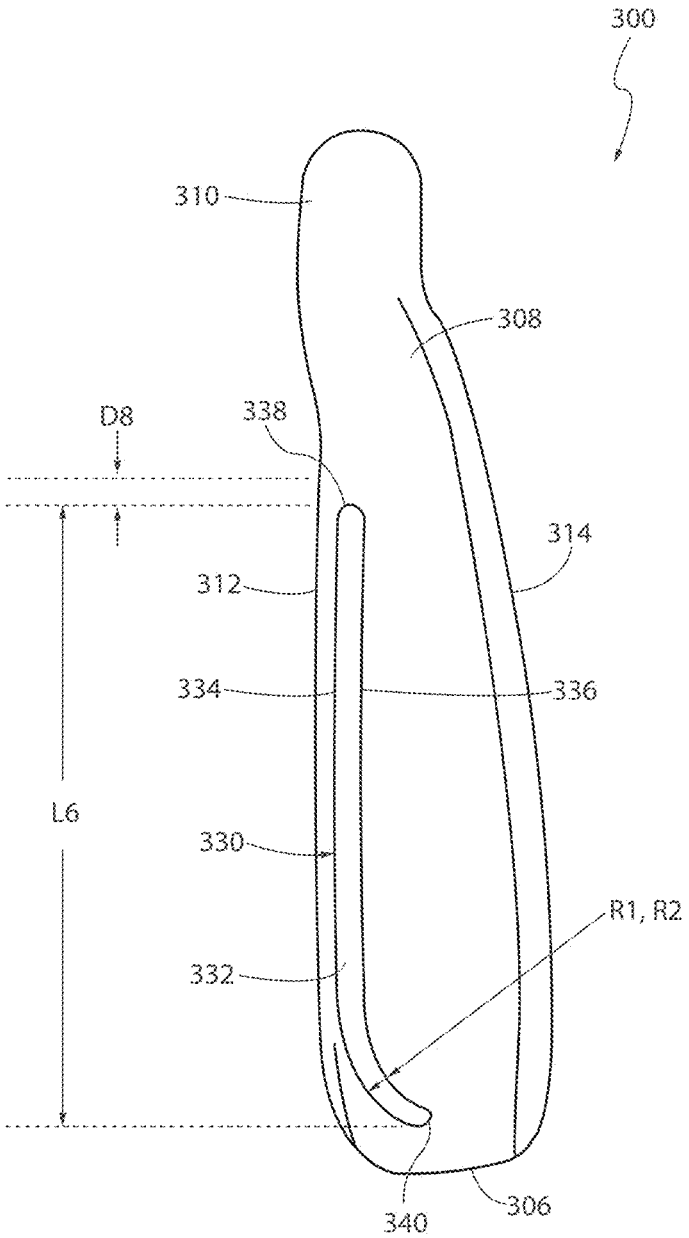
FIG. 15 of the accompanying drawings shows a bottom plan view of an embodiment of the golf club head shown in FIG. 13.

With reference to FIGS. 13-17, in another embodiment of the present invention, the golf club head 300 can have the same general configuration as the golf club heads 100, 200 shown in the embodiments of FIGS. 1-12. As such, the golf club head 200, as shown in FIGS. 13-15, can generally have a sole 302; a topline 304 opposite the sole 302; a toe portion 306 adjacent to the sole 302 and the topline 304; a heel portion 308 opposite the toe portion 306 and adjacent to the sole 302 and the topline 304; a striking face 312 adjacent to the sole 302, topline 304, toe portion 306, and heel portion 308; a back portion 314 opposite the striking face 312 and adjacent to the sole 302, topline 304, toe portion 306, and heel portion 308; and a hosel 310 adjacent to the heel portion 308 and topline 304. The hosel 310 defines a longitudinal shaft axis A3 and is configured to receive a shaft. The striking face 312 can further be characterized with a plurality of horizontal scorelines 318.

The striking face portion 312 is located at a frontal portion of the golf club head 300. As a result, the back portion 314 is located opposite the striking face portion 312; the topline 304 is located at an upper portion of the golf club head 300; the heel portion 308 is located at a proximal end of the golf club head 300; the toe portion 306 is located at a distal end of the golf club head 300 opposite the heel portion 308; and the sole 302 is located at a lower portion of the golf club head 300 opposite the topline 304. An axis of origin 12 is provided (for reference only for ease and clarity of description) indicating the x-y-z direction relative to the golf club head 300 in the examples provided.

Figure 16:
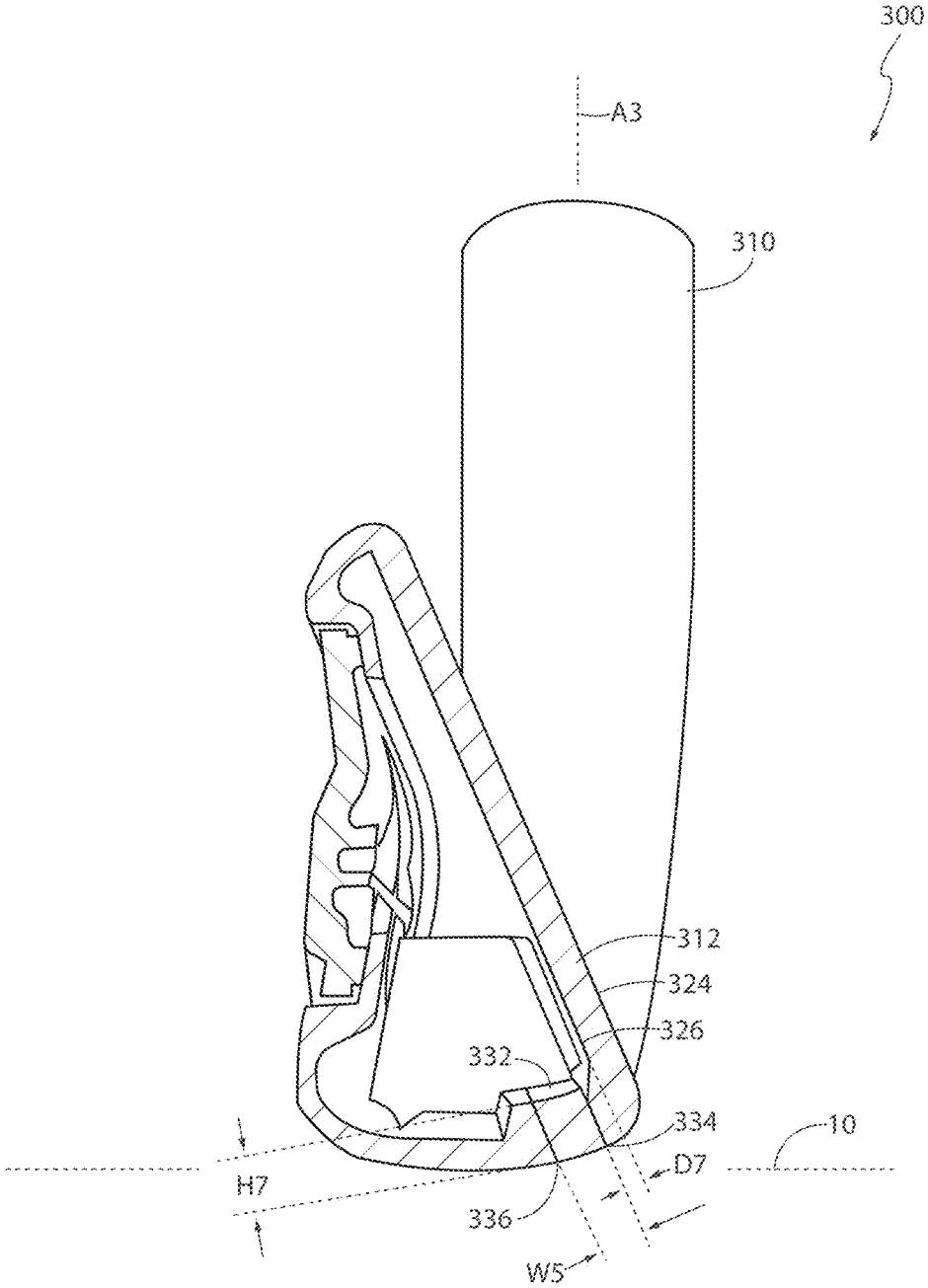
FIG. 16 of the accompanying drawings shows a cross section from a toe side view of an embodiment of the golf club head shown in FIG. 14 taken along line 16-16.
Figure 17:
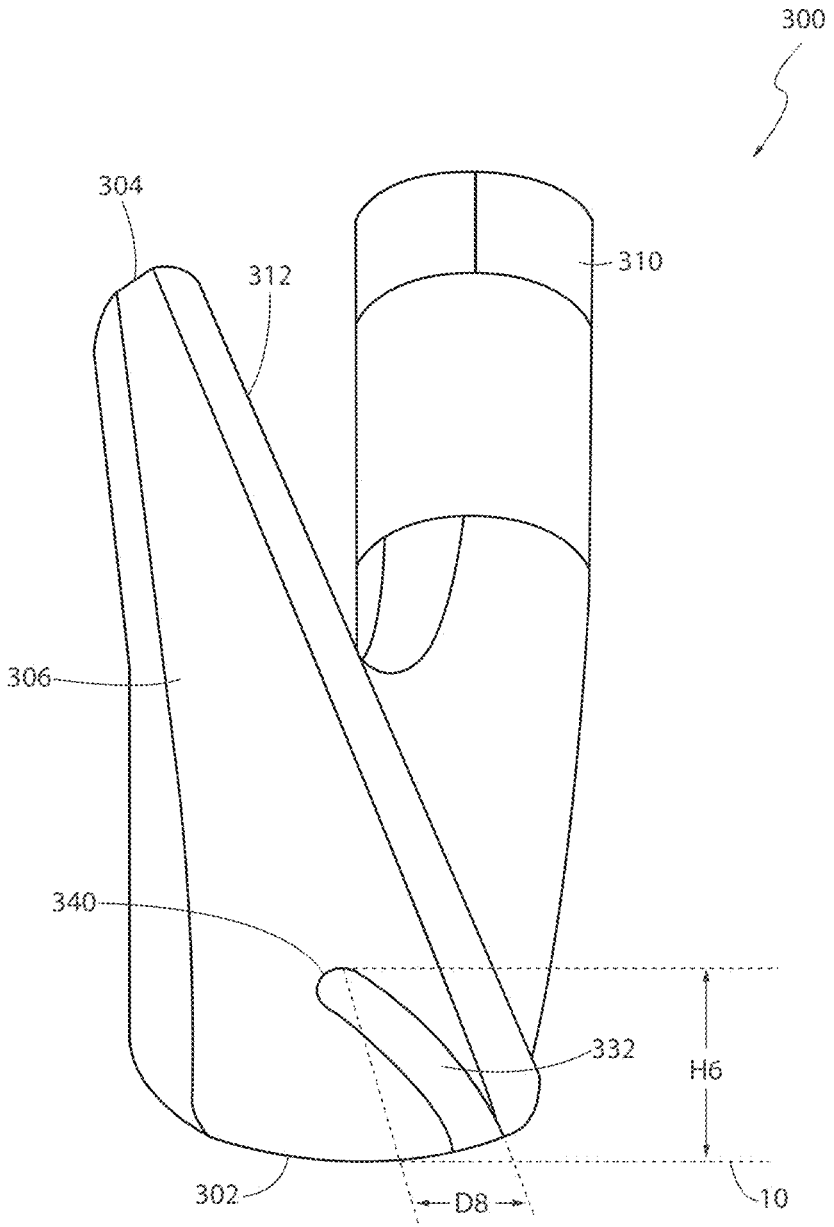
FIG. 17 of the accompanying drawings shows an elevation view from the toe side of an embodiment of the golf club head shown in FIG. 13.

The golf club head 300 further comprises a leading edge 320 located approximately where the striking face 312 meets the sole 302; a trailing edge 322 adjacent to the back portion 314 and the sole 302; and the sole 302 in between the leading edge 320 and the trailing edge 322. The leading edge 320 can be defined in the current application as approximately the most forward edge of the golf club head 300, with the hosel 310 in an upright 90 degree (perpendicular) position from a ground plane 10 (in the front-to-back, z-axis direction) as shown in FIG. 16. This leading edge 320 is then defined as approximately the forward most edge along the z-axis (as indicated by the axis of origin 12) generally where the striking face 312 meets the sole 302.

The trailing edge 322, which is defined as approximately the most rearward edge of the sole portion 302 of the golf club head 300 (in the z-direction), again with the hosel 310 in a 90 degree (perpendicular) position from the ground plane 10 (in the front-to-back, z-axis direction), is generally where the sole portion 302 and the back portion 314 meet.

The invention of the present application incorporates a strategically positioned slot 330 on the sole 302 of the golf club 300 head to improve the performance of the golf club head 300. The slot 330 houses a weighted insert 332. In the invention of the present application, the slot 330 (and therefore, the weighted insert 332) is moved forward towards the striking surface 212 compared to traditional golf clubs with inserts. As shown in FIG. 16, the striking surface 312 is defined by an outer wall 324, which actually contacts the golf ball, and an inner wall 326 behind the outer wall 324 and internal to the golf club head 300, thereby providing thickness to the striking surface 312.

As shown in FIG. 15, the slot 330 is characterized as having a front edge 334, a back edge 336 opposite the front edge 334 and towards the back relative to the front edge 334, a proximal edge 338 adjacent the heel-side of the golf club head 300, and a distal edge 340 adjacent to the toe-side of the golf club head 300. The slot 330 has a width W5 as measured from the front edge 334 to the back edge 336, and a length L7 as measured from the proximal edge 238 to the distal edge 240. The distance D7 of the slot 330 from the striking surface 312 is determined as the shortest distance from the front edge 334 of the slot 330 to a plane defined by the inner wall 326 of the striking surface 312.

As shown in FIG. 16, the distance D7 of the front edge 334 of the slot 330 to the plane of the inner wall 326 of the striking surface 312 can be about 0 mm to about 8.0 mm. A distance D7 of 0 mm means that the inner wall 326 of the striking surface 312 is in line with or makes up the front edge 334 of the slot 330. In some embodiments, the distance D7 of the front edge 334 of the slot 330 to the plane of the inner wall 326 of the striking surface 312 can be less than about 6.0 mm. In some embodiments, the distance D7 of the front edge 334 of the slot 330 to the plane of the inner wall 326 of the striking surface 312 can be less than about 4.0 mm. Preferably, the distance D7 of the front edge 334 of the slot 330 to the plane of the inner wall 326 of the striking surface 312 can be less than about 3.5 mm. For example, the distance D7 of the front edge 334 of the slot 330 to the plane of the inner wall 326 of the striking surface 312 can be 3.4 mm, 3.3 mm, 3.2 mm, or less. More preferably, preferably, the distance D7 of the front edge 334 of the slot 330 to the plane of the inner wall 326 of the striking surface 312 can be about 2.5 mm or less. Most preferably, the distance D7 of the front edge 334 of the slot 330 to the plane of the inner wall 326 of the striking surface 312 can be about 2.0 mm or less. In some embodiments, the distance D7 of the slot 230 to the striking surface 212 is generally a uniform distance throughout the length L7 of the slot 230.

The slot 330 can also be characterized by its distance from the proximal end 328 (or heel end) of the striking surface 312 (which is essentially where the bottom scoreline 318 ends at the heel portion 208). The distance D8 from the slot 330 to the proximal end 328 of the striking surface 312 is defined as the shortest distance from the proximal edge 338 of the slot 330 to a y-z plane defined by the proximal end 328 of the striking surface 312. The distance D8 from the proximal edge 338 of the slot 330 to the y-z plane of the proximal end 328 of the striking surface 312 can be about 0 mm to about 1.5 mm. Preferably, the distance D8 from the proximal edge 338 of the slot 330 to the proximal end 328 of the y-z plane of the striking surface 312 can be about 0.15 mm to about 1.2 mm. More preferably, the distance D8 from the proximal edge 338 of the slot 330 to the y-z plane of the proximal end 328 of the striking surface 312 can be about 0.3 mm to about 0.9 mm.

In some embodiments, however, the proximal edge 338 of the slot 330 can extend past the proximal end 328 of the striking surface 312 further towards or into the heel portion 308. For example, the proximal edge 338 can extend up to 10 mm past the proximal end 328 of the striking surface 312. Preferably, the proximal edge 338 can extend up to 8 mm past the proximal end 328 of the striking surface 312. More preferably, the proximal edge 338 can extend up to 5 mm past the proximal end 328 of the striking surface 312.

With respect to the distal edge 340 of the slot 330, in the preferred embodiment, the distal edge 340 can continue past the distal end 329 of the striking surface 312 up into the toe portion 306. The distal edge 340 can rise up into the toe portion 306 up to a height H6 of about 50 mm above the sole 302 (or ground plane 10). Preferably, the distal edge 340 can rise up into the toe portion 306 up to a height H6 of about 40 mm above the sole 302. More preferably, the distal edge 340 can rise up into the toe portion 306 up to a height H6 of about 30 mm above the sole 302.

In general, the slot 330 maintains a uniform distance from the striking face 312. However, in some embodiments, a distal end portion of the slot 330 encompassing the distal edge 340 can be characterized by a curvature away from the striking face 312 creating a larger distance D9 from the apex of the distal edge 340 to the inner wall 326 of the striking surface 312 compared to the distance D7 of front edge 334 of the slot 330 to the inner wall 326 of the striking surface 312. By having a distal end portion curve away from the striking face 312, the distal edge 340 can be a distance D9 of about 2.0 mm to about 12.0 mm away from the inner wall 326 of the striking surface 312. Preferably, the distal edge 340 can be a distance D9 of about 4.0 mm to about 10.0 mm away from the inner wall 326 of the striking surface 312. More preferably, the distal edge 340 can be a distance D9 of about 6.0 mm to about 8.0 mm away from the inner wall 326 of the striking surface 312.

The radius of curvature R1 of the front edge 334 of the distal end portion as it curves away from the striking surface 312 can be about 20.0 mm to about 40.0 mm. The radius of curvature R1 of the front edge 334 as it curves away from the striking surface 312 can be about 20.0 mm to about 40.0 mm. Preferably, the radius of curvature R1 of the front edge 334 as it curves away from the striking surface 312 can be about 23.0 mm to about 37.0 mm. More preferably, the radius of curvature R1 of the front edge 334 as it curves away from the striking surface 312 can be about 27.0 mm to about 33.0 mm. The radius of curvature R2 of the corresponding back edge 336 as it curves away from the striking surface 312 can be about 16.0 mm to about 39.0 mm. Preferably, the radius of curvature R2 of the back edge 336 as it curves away from the striking surface 312 can be about 19.0 mm to about 35.0 mm. More preferably, the radius of curvature R2 of the back edge 336 as it curves away from the striking surface 312 can be about 22.0 mm to about 32.0 mm.

In embodiments in which the distal edge 340 curves away from the striking surface 312 the height H6 of the distal edge 340 above the sole 302 (or the ground plane 10) may be about 4 mm to about 16 mm. Preferably, the height H6 of the distal edge 340 above the sole 302 may be about 6 mm to about 14 mm. More preferably, the height H6 of the distal edge 340 above the sole 302 may be about 8 mm to about 12 mm.

The slot 330 can also be characterized by its width W5 as measured from the front edge 334 to the back edge 336. The width W5 of the slot 330 can be about 1.0 mm to about 4.0 mm. Preferably, the width W5 of the slot 330 can be about 1.5 mm to about 3.5 mm. More preferably, the width W5 of the slot 330 can be about 2.0 mm to about 3.0 mm.

The slot 330 can further be characterized by its length L7 as measured from the proximal edge 338 to the distal edge 340. In the preferred embodiment, the slot 330 is generally stadium shape having a generally straight front edge 334 and a generally straight back edge 336 (aside from the curvature at the distal end in some embodiments) with curved proximal end 338 and distal end 340. However, the slot 330 can have other shapes, such as rectangular, oval, and other elongated shapes. The length L7 of the slot 330 can be about 55 mm to about 85 mm. Preferably, the length L7 of the slot 330 can be about 60 mm to about 80 mm. More preferably, the length L7 of the slot 330 can be about 65 mm to about 75 mm.

The insert 332 is shaped and dimensioned to fit inside the slot 330. As such, the shape and dimensions of the insert 332 is substantially the same as the slot 330. For example, the overall length L8 of the insert 332 can be about 55 mm to about 85 mm. Preferably, the overall length L8 of the insert 332 can be about 60 mm to about 80 mm. More preferably, the overall length L8 of the insert 332 can be about 65 mm to about 75 mm.

The insert 332 of the present embodiment can also have a height H7 as measured from the bottom of the insert 332 to the top of the insert 332 that can be less than about 5.0 mm. For example, the height H7 can be about 4.9 mm or less, 4.8 mm or less, 4.7 mm or less, and so on. Preferably, the height H7 of the insert 332 can be about 2.0 mm to about 4.5 mm. More preferably, the height H7 of the insert 332 can be about 2.5 mm to about 4.0 mm.

The golf club head 100 of the present invention can be manufactured using casting or forging technology according to the specification disclosed herein using materials such as titanium, steel, carbon fiber, and other typical metals used in manufacturing irons. Any of the inserts described herein can be fastened to the sole using adhesives, friction fit, catch type mechanisms, and the like. In the preferred embodiment, the insert is made with polymer material known in the art.

EXAMPLES

In one embodiment, a 3 iron was tested in which the front edge 334 of the slot 330 was approximately 2 mm or less from the inner wall 326 of the striking surface 312 (D7 less than or equal to about 2 mm). The proximal edge 338 of the slot 330 extended beyond the proximal end 328 of the striking face 312 by about 10 mm or less. The distal edge 340 of the slot 330 extended beyond the distal end 329 of the striking face 312 by about 10 mm or less. Compared to the control iron (3 iron without insert), this configuration placed the center of gravity in the x-direction (CGx) closer to the face center (by about 2 mm), in the y-direction (CGy) slightly lower (by about 0.4 mm), and in the z-direction (CGz) about the same. The coefficient of restitution (COR) was slightly higher in the present embodiment (0.823-0.825) compared to that of control (0.819).

The ball speed of the this embodiment was generally higher than control. The largest difference in ball speed was found at the lower toe region of the striking face 312. The middle (y direction) toe (x direction) region, the lower center region, and the middle center region also showed increase in ball speed. The heel region showed inconsistent results.

With respect to backspin on a golf ball struck with the current embodiment, the present embodiment showed increased backspin at the toe, center, and heel region of the striking face 312. In one comparison, the present invention generated a backspin that was more than 1000 rpm faster than control when measured at the lower and middle toe region, the lower and middle center region, and the lower and middle heel region.

In another 3 iron example in which the slot 330 extended from about the proximal end 328 of the striking surface 312 well into the toe portion 306, and approaching the topline 304 (i.e. the distal edge 340 of the slot 330 was above the face center), a comparison against a control 3 iron showed a slight increase in ball speed, particularly at the lower and middle toe region, and lower and middle center region, a slightly lower launch angle at the toe, center, and heel region, and increased backspin at the toe and center region.

As such, configurations of the present invention increased ball speed, increased backspin, and decreased loft angles.

Any of the features and characterizations of the example embodiments are not necessarily exclusive to the embodiments in which the features and characterizations were disclosed. The disclosure provides descriptions based on exemplary embodiments, and it is contemplated that features and characteristics in one exemplary embodiment can apply to any other embodiment.

Other than in the operating examples, or unless otherwise expressly specified, all of the numerical ranges, amounts, values and percentages such as those for radius of curvature, angles, and others in the aforementioned portions of the specification may be read as if prefaced by the word "about" or "approximately" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values, and any values in between any ranges cited, may be used.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

In some embodiments, the presently disclosed technology described herein contemplates a golf club head, such as for an iron, a fairway wood, a driver, or another type of golf club head, that includes a leading edge insert. The leading edge insert can improve performance, including, for example, increased distance and reduced spin. The leading edge insert may allow for reduced stress on a leading edge of the golf club head.

The presently disclosed technologies may provide a golf club head including a body. The body may include an interior cavity, a face, a back extending rearward from at least a part of the face, and a sole. The sole may include a leading edge, a leading edge slot rearward of the face, a central region rearward of the leading edge slot, and a trailing edge rearward of the central region. The golf club head may include a leading edge insert to fit into the leading edge slot. The leading edge insert may include an insert body and an insert channel. The leading edge insert may be made of a compliant material, as will be discussed herein, such that impacts on the striking face compress the leading edge insert which may increase distance and reduce spin.

Establishing a reference coordinate system for the presently disclosed technology, an x-axis may refer to the axis that is horizontal to the face from a heel to toe direction, a y-axis may refer to the vertical axis through the club in a crown to sole direction, a z-axis may refer to the horizontal axis that is horizontal front to back in a forward and rear direction. Alternatively speaking, it can be the x-axis is defined as a horizontal axis tangent to a geometric center of the face with the positive direction towards a heel of the golf club head, a y-axis is a vertical axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions. Herein, faceward or frontward may mean toward a face of a golf club head, rearward or backward may mean toward a rear of a golf club head, toeward may mean toward a toe of a golf club head, heelward may mean toward a heel of a golf club head, upward or topward may mean toward a top of a golf club head, downward, soleward, or bottomward may mean toward a bottom of a golf club head.

Figure 18:
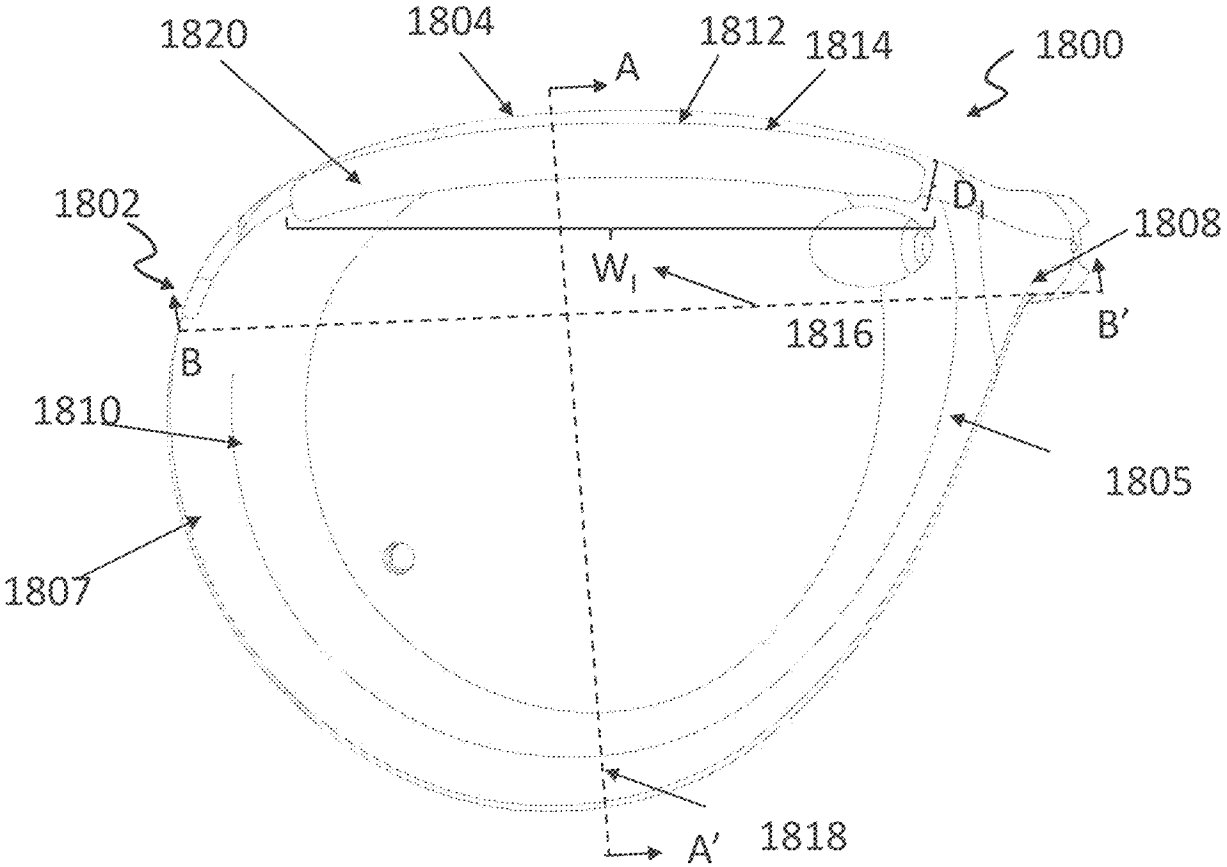
FIG. 18 illustrates a bottom view of a golf club head in accordance with one or more embodiments of the presently disclosed technology.
Figure 19:
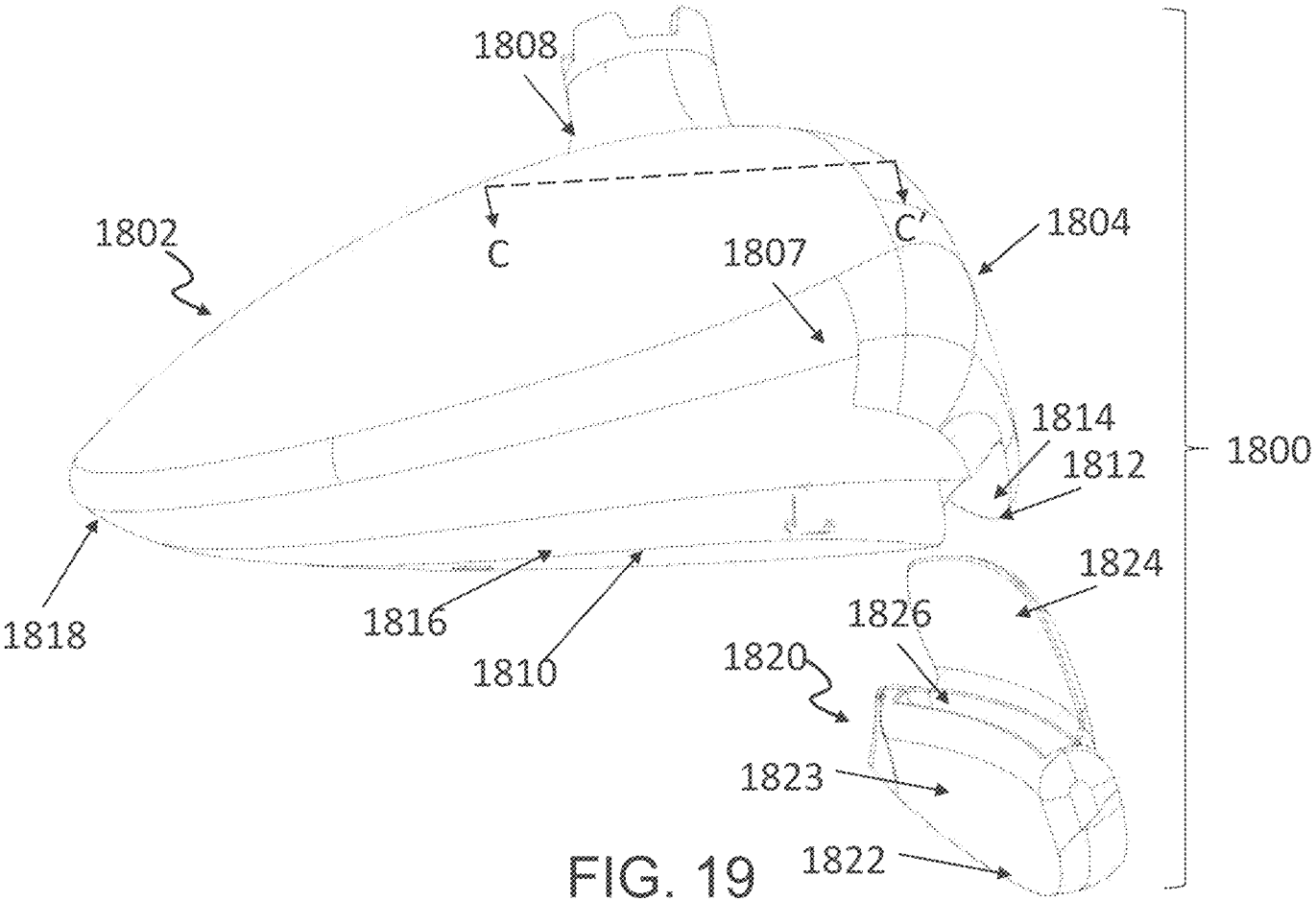
FIG. 19 illustrates an exploded side view of a golf club head in accordance with one or more embodiments of the presently disclosed technology.
Figure 20:
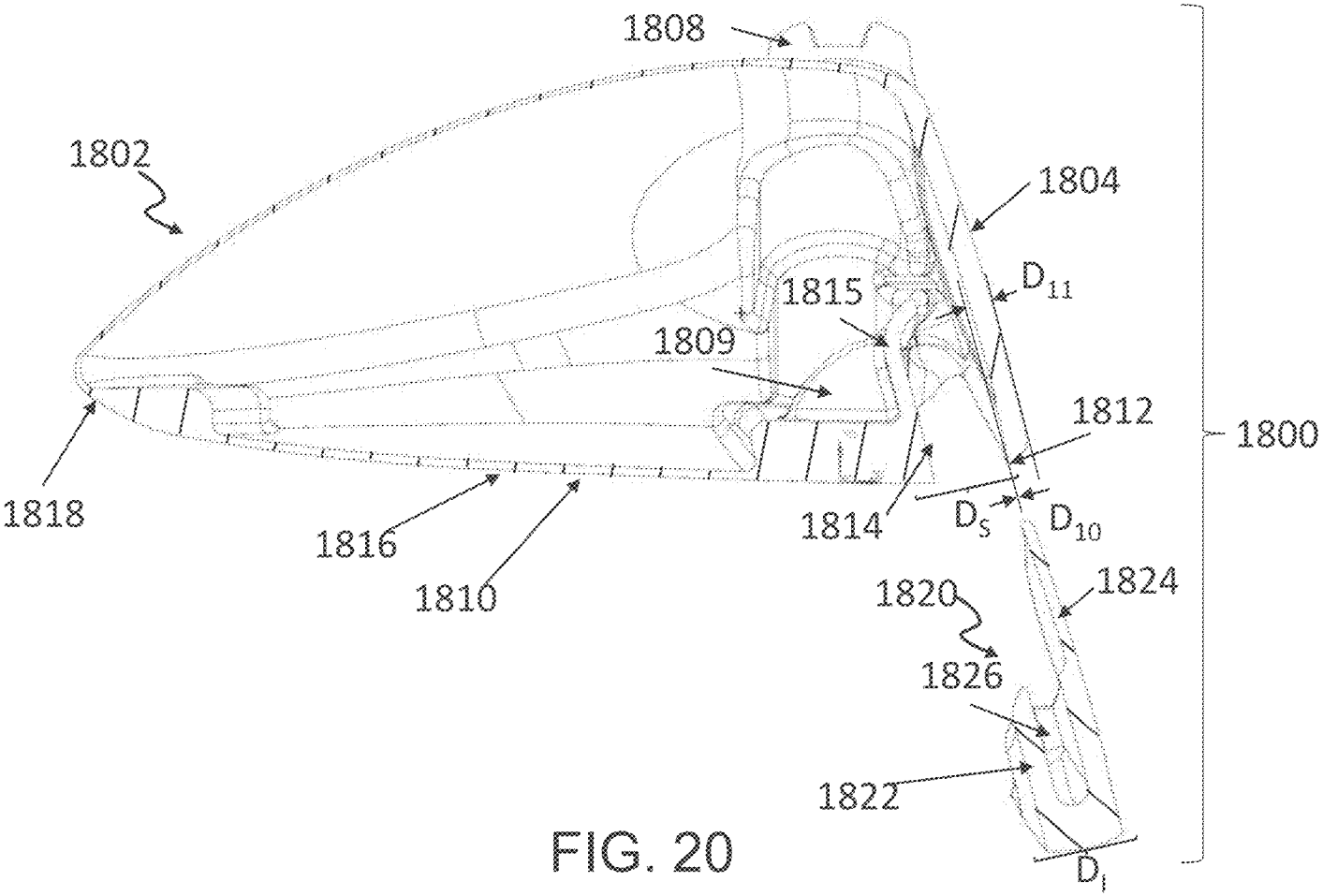
FIG. 20 illustrates a cross-sectional exploded view of a golf club head in accordance with one or more embodiments of the presently disclosed technology, taken approximately along cross-sectional line A-A' shown in FIG. 18.
Figure 21:
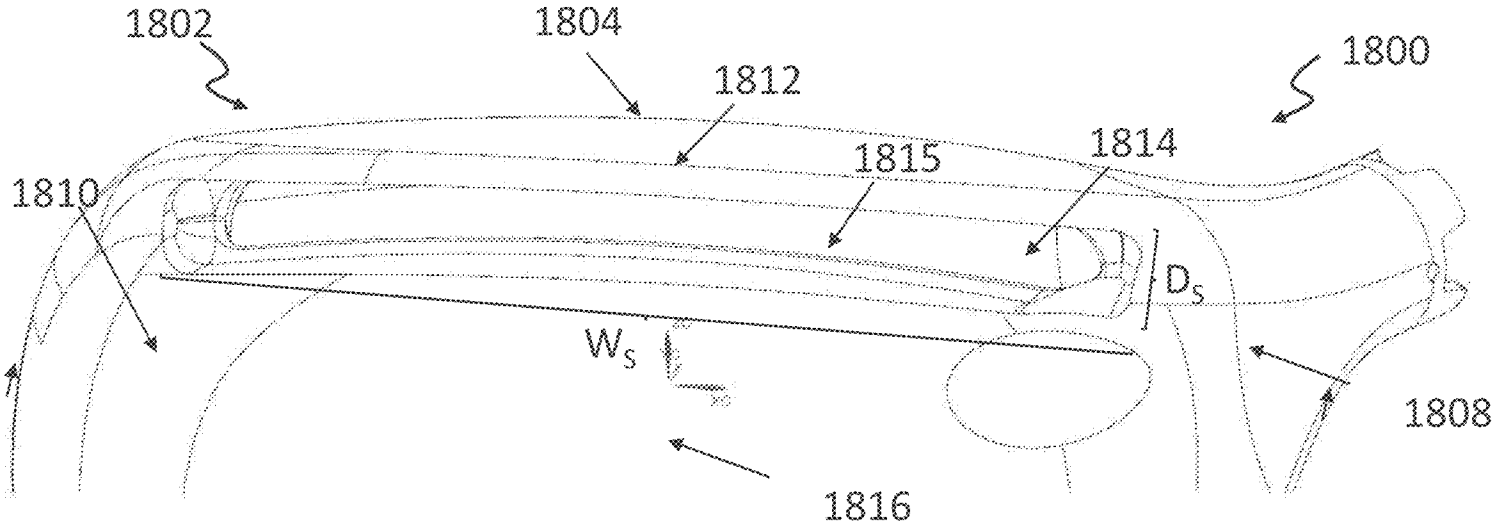
FIG. 21 illustrates a partial bottom view of a golf club head in accordance with one or more embodiments of the presently disclosed technology, taken approximately along cross-sectional line B-B' shown in FIG. 18.
Figure 22:
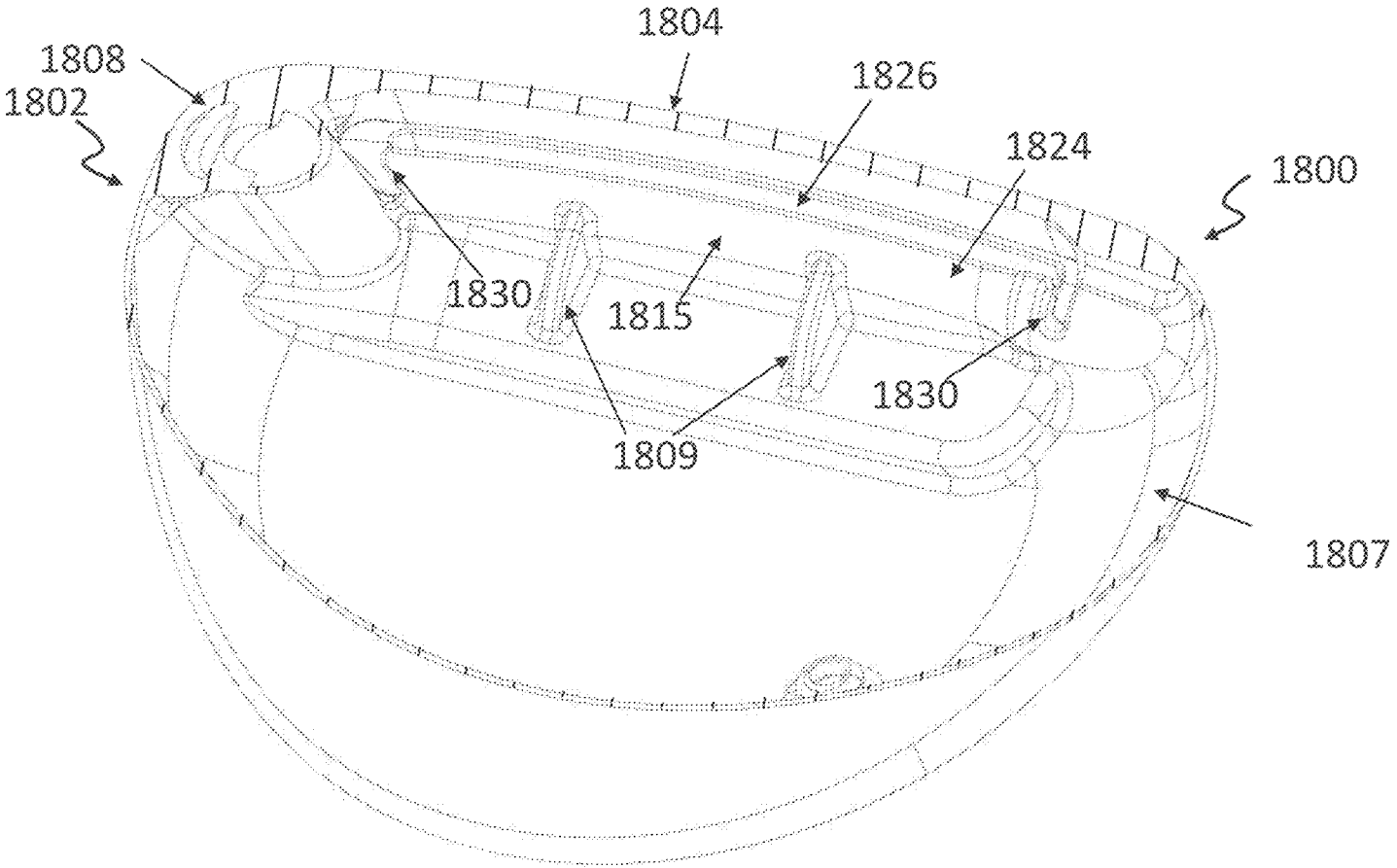
FIG. 22 illustrates a cross-sectional top view of a golf club head in accordance with one or more embodiments of the presently disclosed technology, taken approximately along cross-sectional line C-C' shown in FIG. 19.
Figure 23:
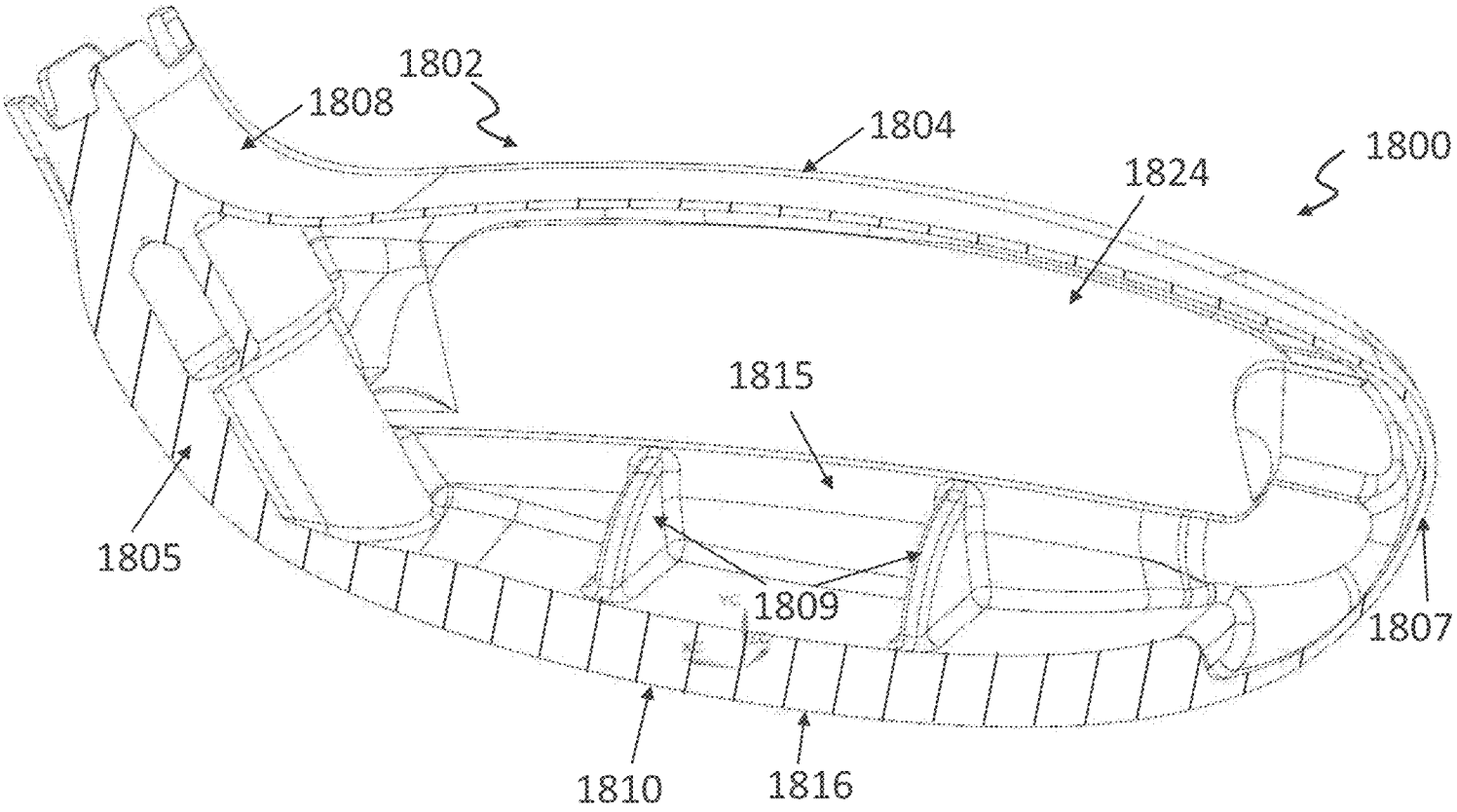
FIG. 23 illustrates a cross-sectional rear view of a golf club head in accordance with one or more embodiments of the presently disclosed technology, taken approximately along cross-sectional line B-B' shown in FIG. 21.
Figure 24:
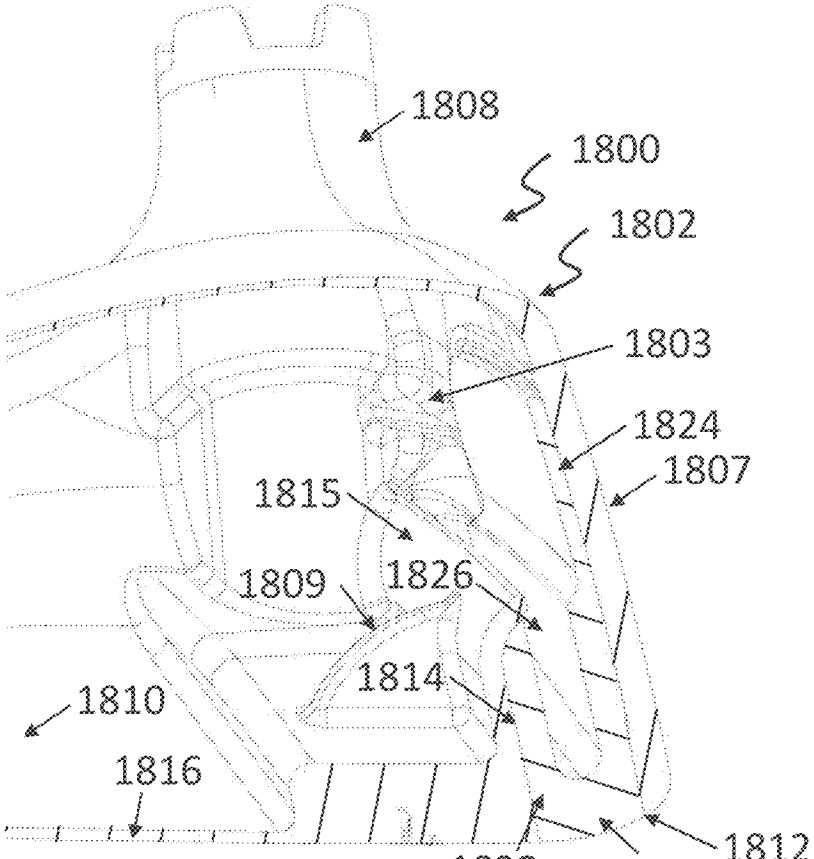
FIG. 24 illustrates a cross-sectional side view of a golf club head in accordance with one or more embodiments of the presently disclosed technology, taken approximately along cross-sectional line A-A' shown in FIG. 18.

FIGS. 18-24 illustrate a golf club head in accordance with one or more embodiments of the presently disclosed technology. For example, FIG. 18 illustrates a bottom view of a golf club head in accordance with one or more embodiments of the presently disclosed technology. FIG. 19 illustrates an exploded side view of a golf club head in accordance with one or more embodiments of the presently disclosed technology. FIG. 20 illustrates a cross-sectional exploded view of a golf club head in accordance with one or more embodiments of the presently disclosed technology, taken approximately along cross-sectional line A-A' shown in FIG. 18. FIG. 21 illustrates a partial bottom view of a golf club head with focus on the frontal portion of the sole in accordance with one or more embodiments of the presently disclosed technology. FIG. 22 illustrates a cross-sectional top view of a golf club head in accordance with one or more embodiments of the presently disclosed technology, taken approximately along cross-sectional line C-C' shown in FIG. 19. FIG. 23 illustrates a cross-sectional rear view of a golf club head in accordance with one or more embodiments of the presently disclosed technology, taken approximately along cross-sectional line B-B' shown in FIG. 21. FIG. 24 illustrates a cross-sectional side view of a golf club head in accordance with one or more embodiments of the presently disclosed technology, taken approximately along cross-sectional line A-A' shown in FIG. 18. Each of these figures may provide different views of the same or similar components, and may be discussed together herein. Referring first to FIG. 18, golf club head 1800 may include body 1802 and/or leading edge insert 1820. Body 1802 may include face 1804, heel 1805, toe 1807, hosel 1808, ribs 1809, and/or sole 1810. Sole 1810 may include leading edge 1812, leading edge slot 1814, central region 1816, and/or trailing edge 1818. Golf club head 1800 may reduce stress on leading edge 1812, increase distance on a struck golf ball, lower spin on a struck golf ball, and/or otherwise improve performance. Golf club head 1800 may be made out of metal, polymer, composite, and/or other materials. For example, heel 1805, toe 1807, hosel 1808, and/or sole 1810 may be made out of composite and face 1804 may be made out of a metallic material such a titanium.

Face 1804 may refer to the striking face of golf club head 1800, that is, the surface on which a golf ball is intended to be struck. Face 1804 may refer to the portion of golf club head 1800 that is substantially planar and located at the frontal portion of golf club head 1800. Face 1804 may be adapted to strike a golf ball. Face 1804 may be separated by sole 1810 by leading edge 1812. Heel 1805 may refer to a heel end of golf club head 1800. This may be a region of golf club head 1800 that is nearest to a user at address. Toe 1807 may refer to a toe end of golf club head 1800. This may be the region of golf club head 1800 that is furthest from a user at address. This may include a surface intended to strike a golf ball. Hosel 1808 may refer to a hollow section of golf club head 1800 where a shaft (not shown) can be inserted. Sole 1810 may refer to a sole or bottom of golf club head 1800. Sole 1810 may extend from face 1804 on a bottom of golf club head 1800. At least a portion of sole 1810 may be intended to interact with a playing surface (e.g., turf, grass, sand, etc.) as golf club head 1800 contacts a golf ball.

Ribs 1809 may extend from an interior surface of sole 1810 to a rear surface of rear slot wall 1815. In some embodiments, ribs 1809 may be arcuate, thought it should be appreciated that ribs 1809 may be otherwise shaped, sized, and/or dimensioned without departing from the spirit and scope of the presently disclosed technology. Ribs 1809 may provide support and/or rigidity to face 1804 and/or rear slot wall 1815. For example, ribs 1809 may prevent rear slot wall 1815 from collapsing onto sole 1810. As illustrated, there may be two ribs 1809, however, it should be appreciated that there may be more or fewer ribs 1809 without departing from the spirit and scope of the presently disclosed technology.

Sole 1810 may include leading edge 1812, leading edge slot 1814, central region 1816, and/or trailing edge 1818. Leading edge 1812 may refer to a region of golf club head 1800 where face 1804 meets sole 1810. Leading edge 1812 may also be understood as a boundary between face 1804 and sole 1810 such that a surface of golf club head 1800 deviates from a substantially planar vertical orientation towards a substantially horizontal orientation. When the particular golf club is a fairway wood type golf club, leading edge 1812 may be a region of golf club head 1800 that is intended to contact a playing surface (e.g., turf, sand, etc.) first when striking the ball. Leading edge slot 1814 may be a slot or opening in an exterior surface of sole 1810 exposing an interior cavity of golf club head 1800. Leading edge slot 1814 may be rectangular when viewed from below, thought it should be appreciated that leading edge slot 1814 may be differently shaped, sized, and/or dimensioned without departing from the spirit and scope of the presently disclosed technology. Leading edge slot 1814 may include rear slot wall 1815. A top of rear slot wall 1815 may be curved toward face 1804 to receive leading edge insert 1820. It should be appreciated that that rear slot wall 1815 may be otherwise shaped, sized, and/or dimensioned without departing from the spirit and scope of the presently disclosed technology. Referring to FIGS. 19, 20, and 21, leading edge slot 1814 may be fully revealed before leading edge insert 1820 is installed. In some embodiments, leading edge insert 1820 may be removable. This may allow adjustability of performance characteristics associated with leading edge insert 1820. In embodiments, leading edge insert 1820 may be adhered into the installed position. Leading edge insert 1820 may allow for a thinner face. For example, a thickness of a region of face 1804, which may be referred to as $D_{11}$, may be closest to leading edge 1812 may be between about 0.2 mm to about 1.5 mm. Leading edge insert 1820 may provide the necessary support while reducing stress by about 20% in face 1804 and about 25% in leading edge 1812. Leading edge slot 1814 may be positioned behind leading edge 1812. In some embodiments, a frontal surface of leading edge slot 1814 may be within about 5.0 mm along a z-axis of an internal surface of face 1804, this distance may be referred to as $D_{10}$. In embodiments, the frontal surface of leading edge slot 1814 may be within about 2.0 mm along a z-axis of an internal surface of face 1804. For example, the frontal surface of leading edge slot 1814 may be within 1.0 mm along a z-axis of an internal surface of face 1804. In some embodiments, the frontal surface of leading edge slot 1814 may be approximately on leading edge 1812, that is about 0.0 mm from a z-axis of an internal surface of face 1804 as shown in FIG. 20. Leading edge slot 1814 may be otherwise located rearward of face 1804. In embodiments, leading edge slot 1814 may be in contact with an interior surface, or rear surface, of face 1804. In some embodiments, leading edge slot 1814 may include an undercut to help retain leading edge insert 1820.

A slot width $W_S$ of leading edge slot 1814 may be greater than a slot depth $D_S$ of leading edge slot 1814. Slot width $W_S$ may be greater than about fifty percent of a sole width. In some embodiments, slot width $W_S$ may be greater than about seventy-five percent of a sole width. In embodiments, slot width $W_S$ may be greater than about ninety percent of a sole width. Widths, depths, and other dimensions may be measured along a horizontal plane or along a surface of the component. For example, along a horizontal plane, slot depth $D_S$ may be between about 3.0 mm and about 10.0 mm. The corresponding surface distance, the distance measured along the surface of leading edge slot 2514, may be between about 3.4 mm and about 11.4 mm. In embodiments, a horizontal distance of slot depth $D_S$ may be between about 5.0 mm and about 8.0 mm. In some embodiments, a horizontal distance of slot depth $D_S$ may be about 7.0 mm. For example, along a horizontal plane, slot width $W_S$ may be between about 70.0 mm and about 100.0 mm. The surface distance for this example of a slot width $W_S$ may be between about 80.0 mm and about 110.0 mm. In some embodiments, a horizontal distance of slot width $W_S$ may be between about 90.0 mm and about 110.0 mm. In embodiments, a horizontal distance of slot width $W_S$ may be about 94.0 mm or about 105.0 mm.

Referring back to FIG. 18, central region 1816 may refer to a region of sole 1810 rearward of leading edge slot 1814. In some embodiments, central region 1816 may be defined as a region of sole 1810 between leading edge 1812 and trailing edge 1818. Trailing edge 1818 may refer to a region of golf club head 1800 where sole 1810 terminates. Trailing edge 1818 may also be understood as boundary between such that a surface of sole 1810 deviates from a substantially horizontal orientation.

Leading edge insert 1820 may fit within leading edge slot 1814. An insert width $W_I$ of leading edge insert 1820 may be greater than an insert depth $D_I$ of leading edge insert 1820. Insert width $W_I$ may be about the same width as slot width $W_S$. For example, a horizontal distance of insert width $W_I$ may be between about 70.0 mm and about 100.0 mm, and so on, as discussed herein. In some embodiments, insert width $W_I$ may be slightly wider to pressure fit leading edge insert 1820 into leading edge slot 1814. In embodiments, insert width $W_I$ may be slightly less wide to be able to fit within leading edge slot 1814, including any adhesive. Insert depth $D_I$ may be about the same depth as slot depth $D_S$. For example, a horizontal distance of insert depth $D_I$ may be between about 3.0 mm and about 10.0 mm, and so on, as discussed herein. In some embodiments, insert depth $D_I$ may be slightly deeper to pressure fit leading edge insert 1820 into leading edge slot 1814. In embodiments, insert depth $D_I$ may be slightly less deep to be able to fit within leading edge slot 1814, including any adhesive. Leading edge insert 1820 may be installed into an installed position. The installed position, as illustrated in at least FIGS. 18, 19, and 20, may have leading edge insert 1820 fully inserted into leading edge slot 1814. In the installed position, an exterior surface of leading edge insert 1820 may be flush with regions of sole 1810 surrounding leading edge slot 1814, including, for example, leading edge 1812 and/or central region 1816. In the installed position, at least a part of an exterior surface of leading edge insert 1820 may form a part of sole 1810.

Referring to FIGS. 22, 23, and 24, leading edge insert 1820 may include insert body 1822, rear portion 1823, face portion 1824, insert channel 1826, and/or notches 1830. Insert body 1822 may be a lower portion or a bottom of leading edge insert 1820. Leading edge insert 1820 may include a first material. The first material may include a polymer. The polymer may include a polyurethane, a urethane, a polycarbonate, a rubber, an aromatic polymer, a plastic, a thermoplastic, a thermoset, and/or other polymers. In embodiments, the first material may be a metal. In some embodiments, leading edge insert 1820 may be a multi-material component, as will be discussed herein. A lower exterior surface of insert body 1822 may form a part of sole 1810 in an installed position. Rear portion 1823 may be a part of leading edge insert 1820 in contact with a frontal surface of rear slot wall 1815. Rear portion 1823 may extend upward at a rear of insert body 1822 as shown in FIG. 24. Face portion 1824 may be a part of leading edge insert 1820 in contact with an interior surface of face 1804 in an installed position. Face portion 1824 may generally extend upwards at a frontal portion of insert body 1822 as shown in FIG. 24. Insert channel 1826 may be formed between insert body 1822, rear portion 1823, and face portion 1824. Insert channel 1826 may be accessible or exposed to an interior cavity of body 1802. Alternatively speaking, insert channel 1826 may be oriented toward the interior cavity of body 1802. The interior cavity may include the volume encapsulated by body 1802. The interior cavity may be the volume encapsulated by body 1802 and leading edge insert 1820 in the installed position. While illustrated as u-shaped from a side cross-sectional view, insert channel 1826 may be otherwise shaped, sized, and/or dimensioned without departing from the spirit and scope of the presently disclosed technology. In embodiments, there may not be insert channel 1826 without departing from the spirit and scope of the presently disclosed technology. Notches 1830 may reduce stress at the nearby regions of golf club head 1800. In some embodiments, as illustrated in FIG. 21, there may be no notches 1830.

Figure 25:
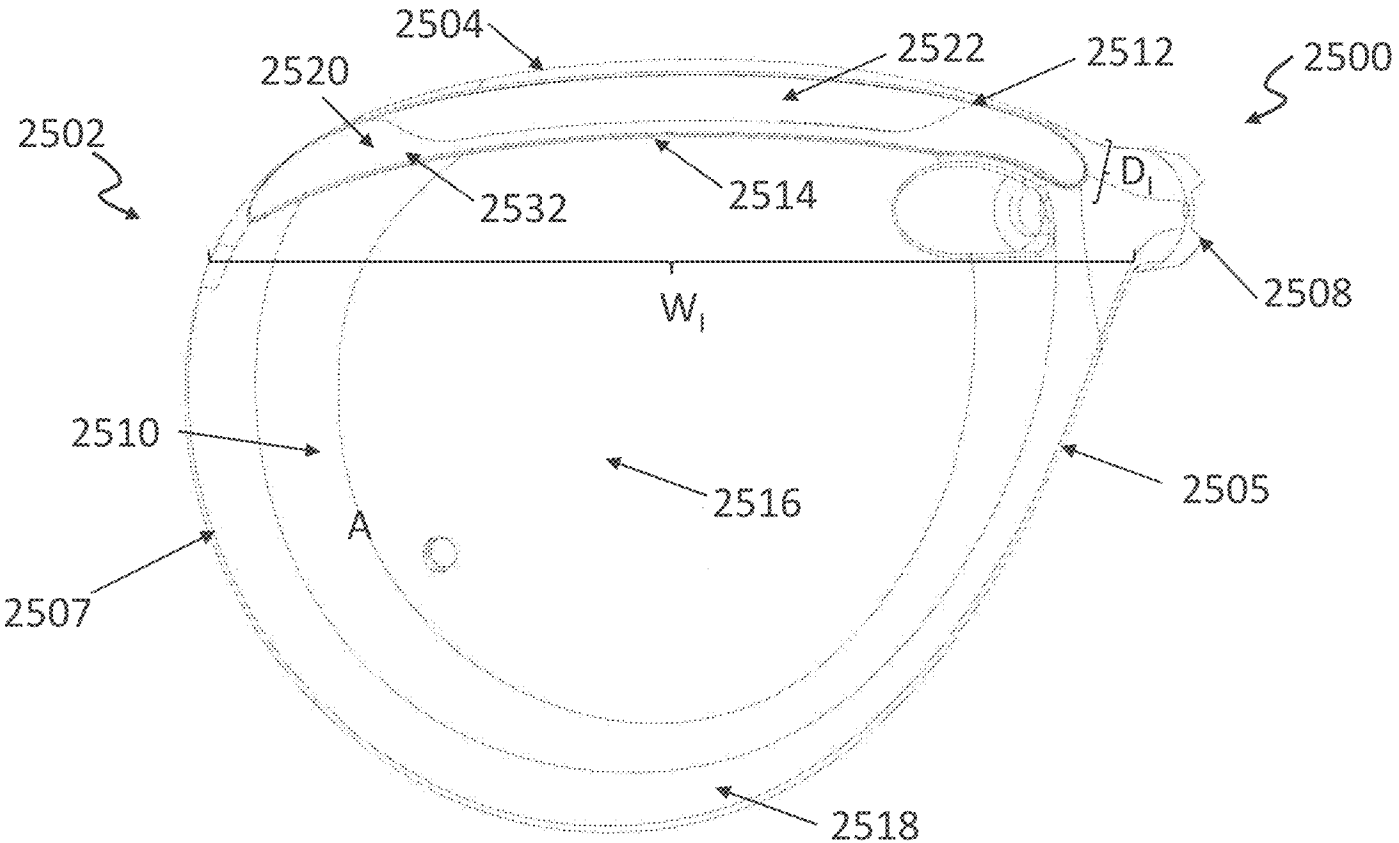
FIG. 25 illustrates a bottom view of a golf club head in accordance with one or more embodiments of the presently disclosed technology.
Figure 26:
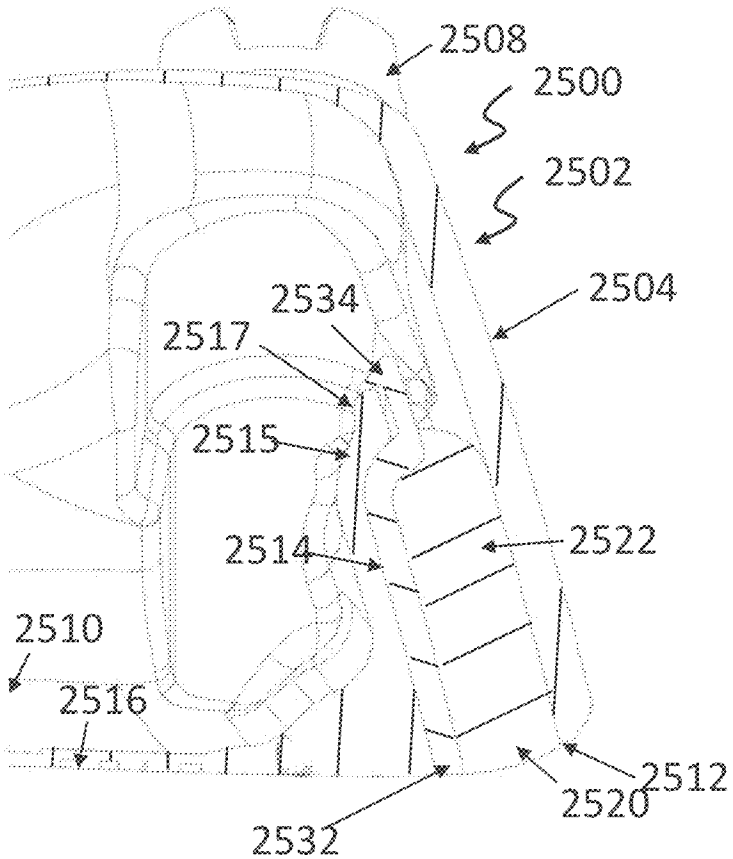
FIG. 26 illustrates a cross-sectional side view of a golf club head in accordance with one or more embodiments of the presently disclosed technology, taken approximately along cross-sectional line A-A' shown in FIG. 18.
Figure 27:
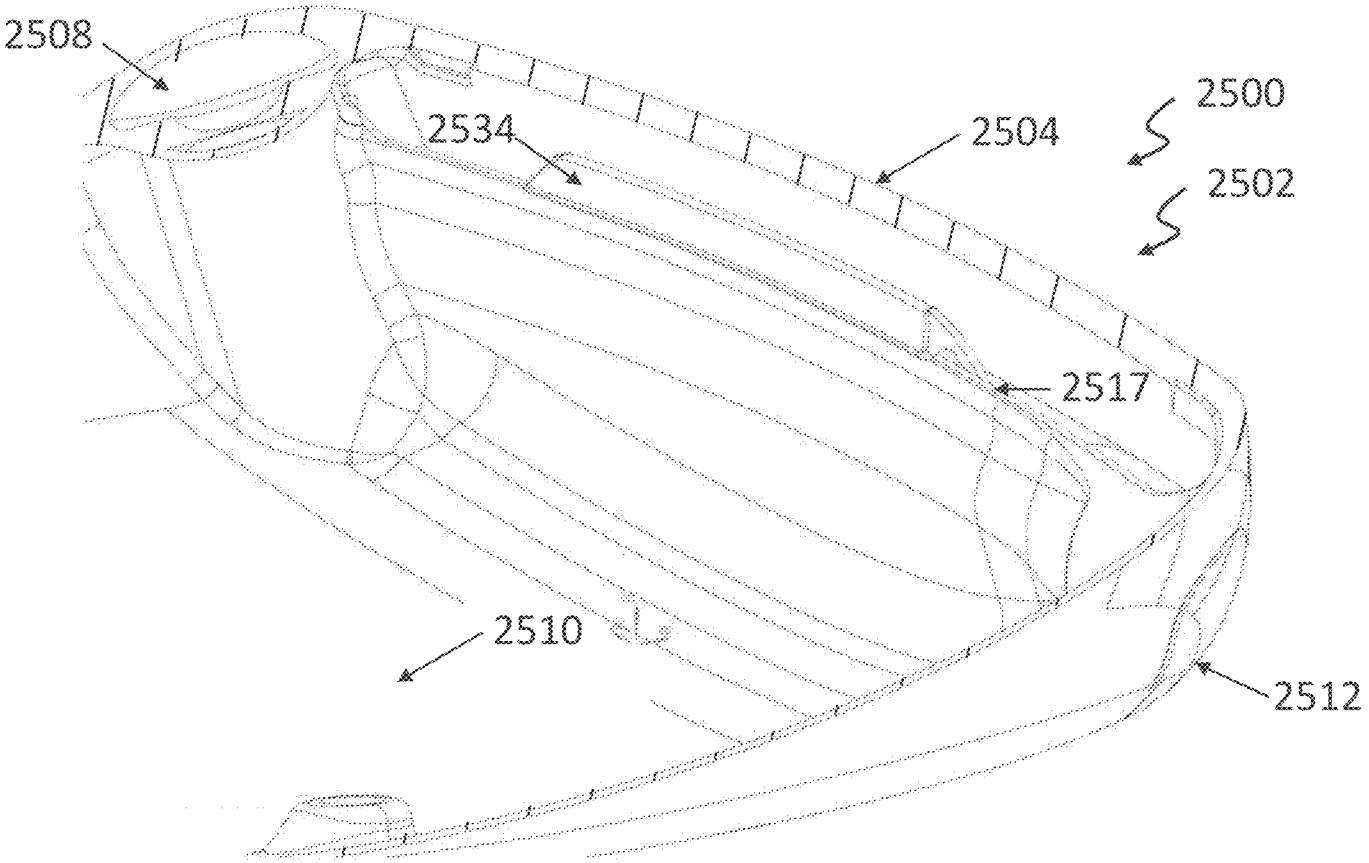
FIG. 27 illustrates a cross-sectional perspective view of a golf club head in accordance with one or more embodiments of the presently disclosed technology, taken approximately along cross-sectional line C-C' shown in FIG. 19.

FIGS. 25-27 illustrate a golf club head in accordance with one or more embodiments of the presently disclosed technology. For example, FIG. 25 illustrates a bottom view of a golf club head in accordance with one or more embodiments of the presently disclosed technology. FIG. 26 illustrates a cross-sectional side view of a golf club head in accordance with one or more embodiments of the presently disclosed technology, taken approximately along cross-sectional line A-A' shown in FIG. 18. FIG. 27 illustrates a cross-sectional perspective view of a golf club head in accordance with one or more embodiments of the presently disclosed technology, taken approximately along cross-sectional line C-C' shown in FIG. 19. Each of these figures may provide different views of the same or similar components, and may be discussed together herein. Referring first to FIG. 25, golf club head 2500 may include body 2502 and/or leading edge insert 2520. Body 2502 may be the same as, or substantially similar to, body 1802. For example, face 2504, heel 2505, toe 2507, hosel 2508, sole 2510, leading edge 2512, central region 2516, and/or trailing edge 2518 may be the same as, or substantially similar to, face 1804, heel 1805, toe 1807, hosel 1808, sole 1810, leading edge 1812, central region 1816, and/or trailing edge 1818.

Leading edge slot 2514 may be differently shaped, sized, and/or dimensioned than leading edge slot 1814 without departing from the spirit and scope of the presently disclosed technology. For example, leading edge slot 2514 may be wider. Leading edge slot 2514 may include rear slot wall 2515. Rear slot wall 2515 may include lip 2517. Lip 2517, as illustrated in at least FIGS. 26 and 27, may be located on a top of rear slot wall 2515 to engage retaining component 2534. Lip 2517 may extend upward from a top of rear slot wall 2515, though it should be appreciated that lip 2517 may be otherwise shaped, sized, and/or dimensioned to engage retaining component 2534 without departing from the spirit and scope of the presently disclosed technology.

Referring to FIG. 26, leading edge insert 2520 may include insert body 2522 and/or rear portion 2523. Insert body 2522 may form a frontal portion of leading edge insert 2520. Alternatively, insert body 2522 may be understood to be positioned faceward on leading edge insert 2520. Rear portion 2523 may be rearward of insert body 2522. Rear portion 2523 may include retaining component 2534. Insert body 2522 may be positioned faceward on leading edge insert 2520. Insert body 2522 may include the first material. Rear portion 2523 may be positioned rearward on leading edge insert 2520. For example, rear portion 2523 may be rearward of insert body 2522. Insert body 2522 may be faceward of rear portion 2523. Rear portion 2523 may include a second material. The second material may include a metal. The metal may be aluminum, titanium, steel, and/or other metals without departing from the spirit and scope of the presently disclosed technology. In some embodiments, it should be appreciated that insert body 2522 may include a second material and rear portion 2523 may include a first material. Insert body 2522 and rear portion 2523 may each include bottom surfaces that are part of sole 2510 in an installed position. In some embodiments, one of insert body 2522 or rear portion 2523 may include surfaces that are part of sole 2510 in an installed position. Referring back to FIG. 25, while illustrated with rear portion 2523 may be deeper by having a larger depth $D_I$ at the heel and toe terminus of the rear portion 2523. That deeper heel and toe terminus allows the rear portion 2523 to touch the leading edge 2512 at those extremities, while the central portion of the rear portion 2523 is separated from the leading edge 2512 by the insert body 2522. It should be appreciated that rear portion 2523 and insert body 2522 may be otherwise shaped, sized, and/or dimensioned without departing from the spirit and scope of the presently disclosed technology. Referring to FIG. 27, retaining component 2534 may be illustrated as engaging with lip 2517. Retaining component 2534 may be illustrated as a tab-like mechanism, though it should be appreciated that retaining component 2534 may be another retaining component or mechanism to help secure leading edge insert 2520 to leading edge slot 2514.

Figure 28:
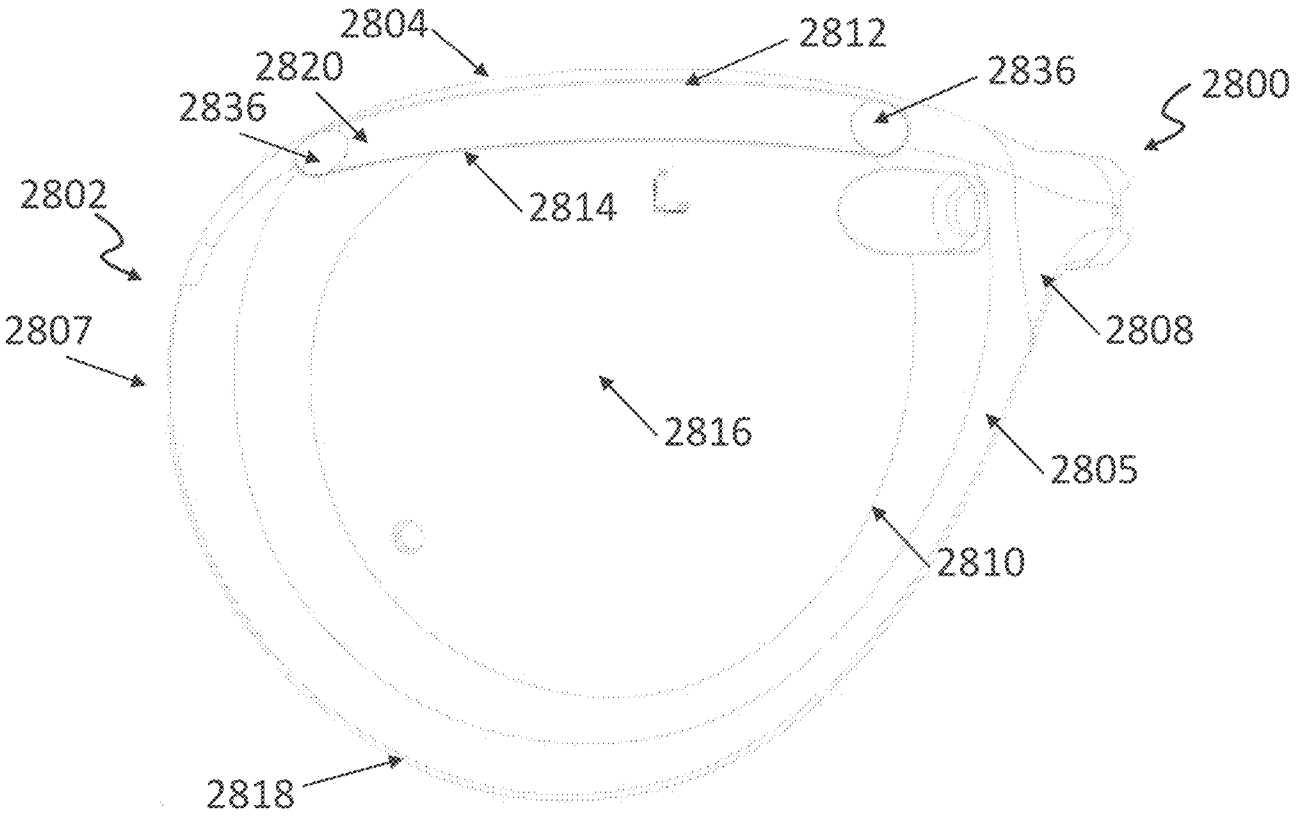
FIG. 28 illustrates a bottom view of a golf club head in accordance with one or more embodiments of the presently disclosed technology.
Figure 29:
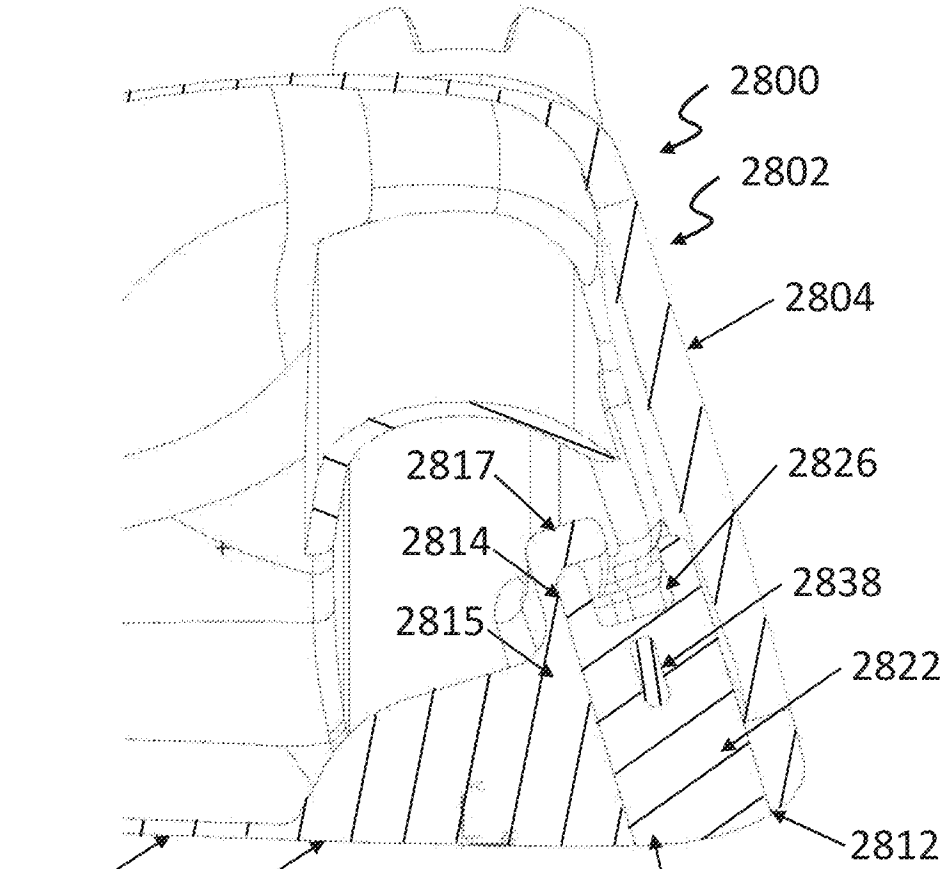
FIG. 29 illustrates a cross-sectional side view of a golf club head in accordance with one or more embodiments of the presently disclosed technology, taken approximately along cross-sectional line A-A' shown in FIG. 18.
Figure 30:
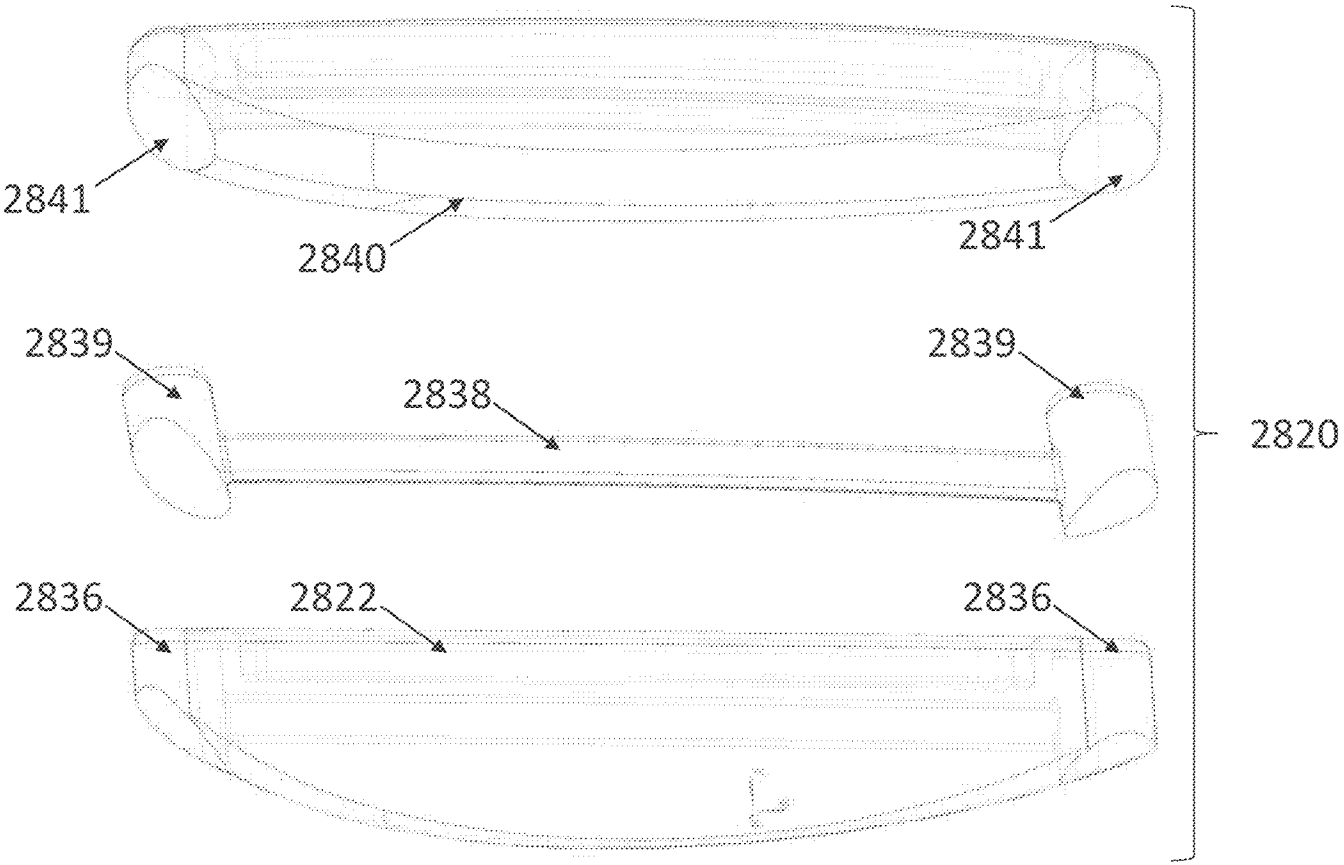
FIG. 30 illustrates an exploded view of a leading edge insert in accordance with one or more embodiments of the presently disclosed technology.

FIGS. 28-30 illustrate a golf club head in accordance with one or more embodiments of the presently disclosed technology. For example, FIG. 28 illustrates a bottom view of a golf club head in accordance with one or more embodiments of the presently disclosed technology. FIG. 29 illustrates a cross-sectional side view of a golf club head in accordance with one or more embodiments of the presently disclosed technology, taken approximately along cross-sectional line A-A' shown in FIG. 18. FIG. 30 illustrates an exploded view of a leading edge insert in accordance with one or more embodiments of the presently disclosed technology. Each of these figures may provide different views of the same or similar components, and may be discussed together herein. Referring first to FIG. 28, golf club head 2800 may include body 2802 and/or leading edge insert 2820. Body 2802 may be the same as, or substantially similar to, body 1802. For example, face 2804, heel 2805, toe 2807, hosel 2808, sole 2810, leading edge 2812, central region 2816, and/or trailing edge 2818 may be the same as, or substantially similar to, face 1804, heel 1805, toe 1807, hosel 1808, sole 1810, leading edge 1812, central region 1816, and/or trailing edge 1818.

Leading edge slot 2814 may include insert body 2822, first supporting members 2836, central layer 2838, second supporting members 2839, top layer 2840, and/or third supporting members 2841. Leading edge slot 2814 may be differently shaped, sized, and/or dimensioned than leading edge slot 1814 without departing from the spirit and scope of the presently disclosed technology. For example, leading edge slot 2814 may be wider and include different components.

Referring to FIG. 30, insert body 2822 may be a lowest layer of leading edge insert 2820. In an installed position, a bottom surface of insert body 2822 may form part of sole 2810. Insert body 2822 may include first supporting members 2836. First supporting members 2836 may be illustrated as cylindrical regions on a toe- and heel-edge of insert body 2822. First supporting members 2836 may support second supporting members 2839 and/or third supporting members 2841. First supporting members 2836 may include a third material. The third material may be a different material than the first material and/or the second material. For example, the third material may be another polymer. In some embodiments, the third material may be the same as the first material. First supporting members 2836 may include recessed regions to receive second supporting members 2839. In some embodiments, insert body 2822 and first supporting members 2836 may be integrated as a unitary component. For example, they may be molded together as a single piece. In embodiments, insert body 2822 and first supporting members 2836 may be separate components.

Central layer 2838 may be a second layer of leading edge insert 2820. Central layer 2838 may be positioned above insert body 2822. Central layer 2838 may include second supporting members 2839. Central layer 2838 may include a fourth material. The fourth material may be different from the first material, the second material, and/or the third material. For example, the fourth material may be another metal. In some embodiments, the fourth material may be the same as the first material, the second material, and/or the third material. For example, the second material may be the same as the second material. Second supporting members 2839 may include a fifth material. The fifth material may be different from the first material, the second material, the third material, and/or the fourth material. For example, the fifth material may be another polymer. In some embodiments, the fifth material may be the same as one of the first material, the second material, the third material, and/or the fourth material. For example, it may be the same as the first material. Second supporting members 2839 may be illustrated as cylindrical regions on a toe- and heel-edge of central layer 2838. In embodiments, second supporting members 2839 may engage with first supporting members 2836. For example, a bottom of second supporting members 2839 may engage with a top of first supporting members 2836. Second supporting members 2839 may include protruded members on a top and a bottom of second supporting members 2839 to fit into recessed regions on a top of first supporting members 2836 and/or a bottom of third supporting members 2841. Second supporting members 2839 may be glued, pressure fit, adhered, fastened, or otherwise secured to first supporting members 2836. In some embodiments, central layer 2838 and second supporting members 2839 may be integrated as a unitary component. In embodiments, central layer 2838 and second supporting members 2839 may be separate components. In some embodiments, central layer 2838 and second supporting members 2839 may be secured together. For example, central layer 2838 and second supporting members 2839 may be secured by glue, pressure fit, or other mechanisms or adhesive substances.

Top layer 2840 may be a third layer of leading edge insert 2820. Top layer 2840 may be positioned above central layer 2838. Top layer 2840 may include third supporting members 2841. Top layer 2840 may include a sixth material. The sixth material may be different from the first material, the second material, the third material, the fourth material, and/or the fifth material. For example, the sixth material may be another polymer. In some embodiments, the sixth material may be the same as the first material, the second material, the third material, the fourth material, and/or the fifth material. Third supporting members 2841 may be illustrated as cylindrical regions on a toe- and heel-edge of top layer 2840. Third supporting members 2841 may include recessed regions on a bottom part of third supporting members 2841 to receive a top of second supporting members 2839. Third supporting members 2841 may include a seventh material. The seventh material may be different from the first material, the second material, the third material, the fourth material, the fifth material, and/or the sixth material. For example, it may be another polymer. In some embodiments, the seventh material may be the same as one of the first material, the second material, the third material, the fourth material, the fifth material, and/or the sixth material. For example, it may be the first material. In embodiments, third supporting members 2841 may engage with first supporting members 2836. For example, a bottom of third supporting members 2841 may engage with a top of second supporting members 2839. Third supporting members 2841 may be glued, pressure fit, adhered or otherwise secured to second supporting members 2839. In some embodiments, top layer 2840 and third supporting members 2841 may be integrated as a unitary component, as discussed herein. In embodiments, top layer 2840 and third supporting members 2841 may be separate components. In some embodiments, top layer 2840 and third supporting members 2841 may be secured together. For example, top layer 2840 and third supporting members 2841 may be secured by glue, fastener, or other mechanisms or adhesive substances. In some embodiments, top layer 2840 and insert body 2822 may be molded onto central layer 2838. Top layer 2840 and insert body 2822 may be a single piece that may be referred to collectively as insert body 2822.

Referring to FIG. 29, rear slot wall 2815 may include lip 2817 at the top of rear slot wall 2815. Lip 2817 may protrude perpendicularly toward face 2804 from a main body of rear slot wall 2815. Lip 2817 may engage with a rear of leading edge insert 2820. In some embodiments, lip 2817 may be otherwise shaped, sized, and/or dimensioned to secure leading edge insert 2820. For example, lip 2817 may be located to help fit leading edge insert 2820 into the installed position. The top of leading edge insert 2820 may be in contact with lip 2817 in the installed position. Insert channel 2826 may be accessible or exposed to an interior cavity of body 1802. Insert channel 2826 may be rectangular when viewed from a side cross-sectional view, though it should be appreciated that insert channel 2826 may be otherwise shaped, sized, and/or dimensioned without departing from the spirit and scope of the presently disclosed technology.

Figure 31:
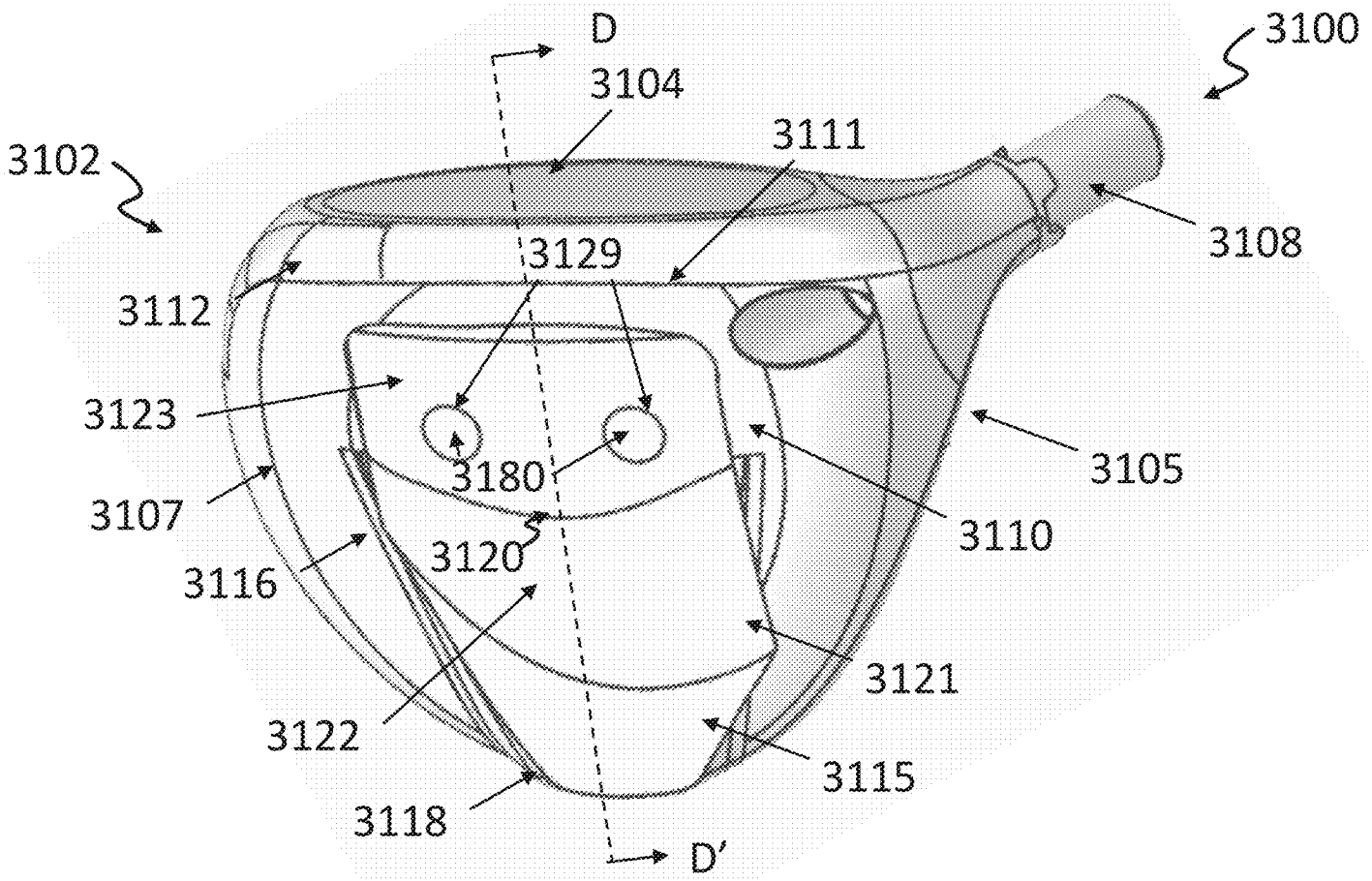
FIG. 31 illustrates a perspective view of a golf club head in accordance with one or more embodiments of the presently disclosed technology.
Figure 32:
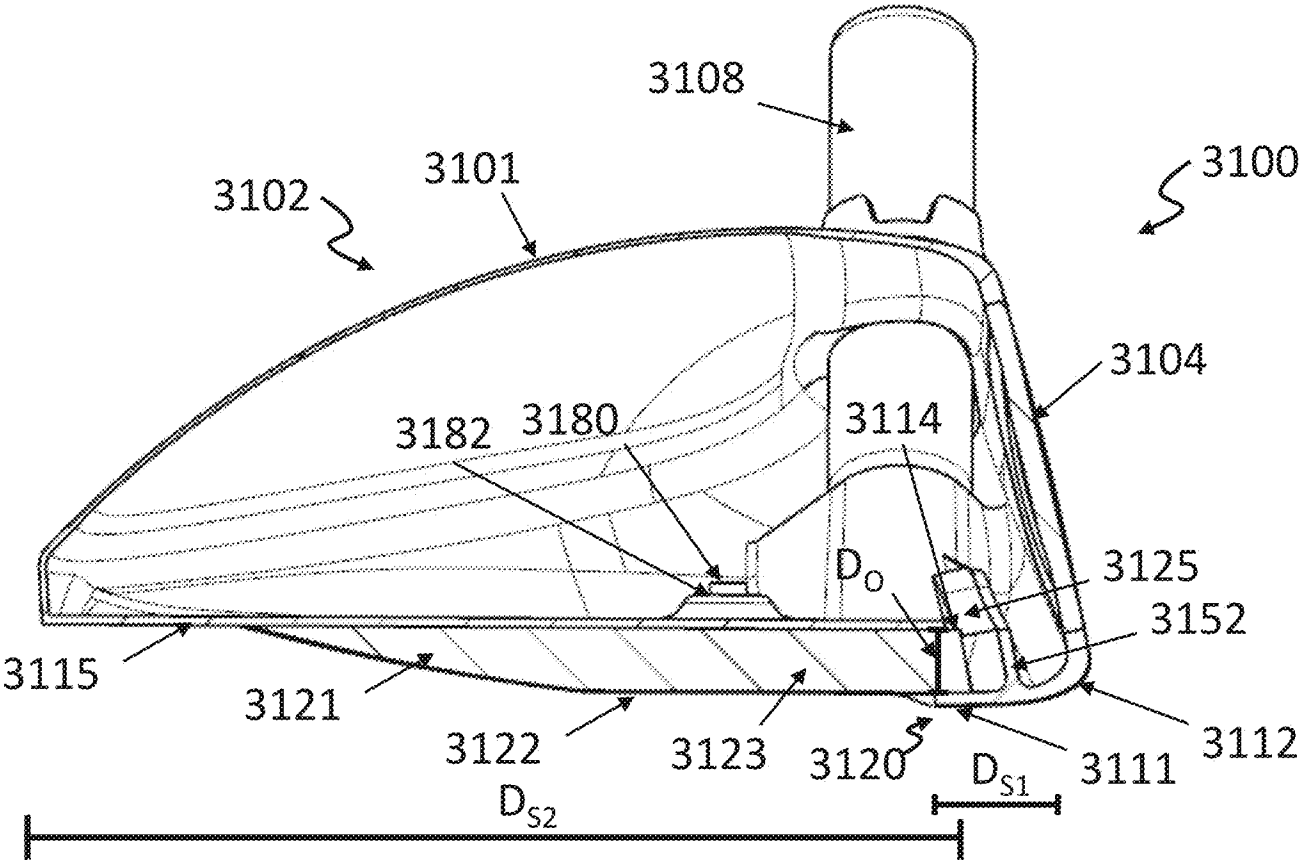
FIG. 32 illustrates a cross-sectional side view of a golf club head in accordance with one or more embodiments of the presently disclosed technology, taken approximately along cross-sectional line D-D' shown in FIG. 31.
Figure 33:
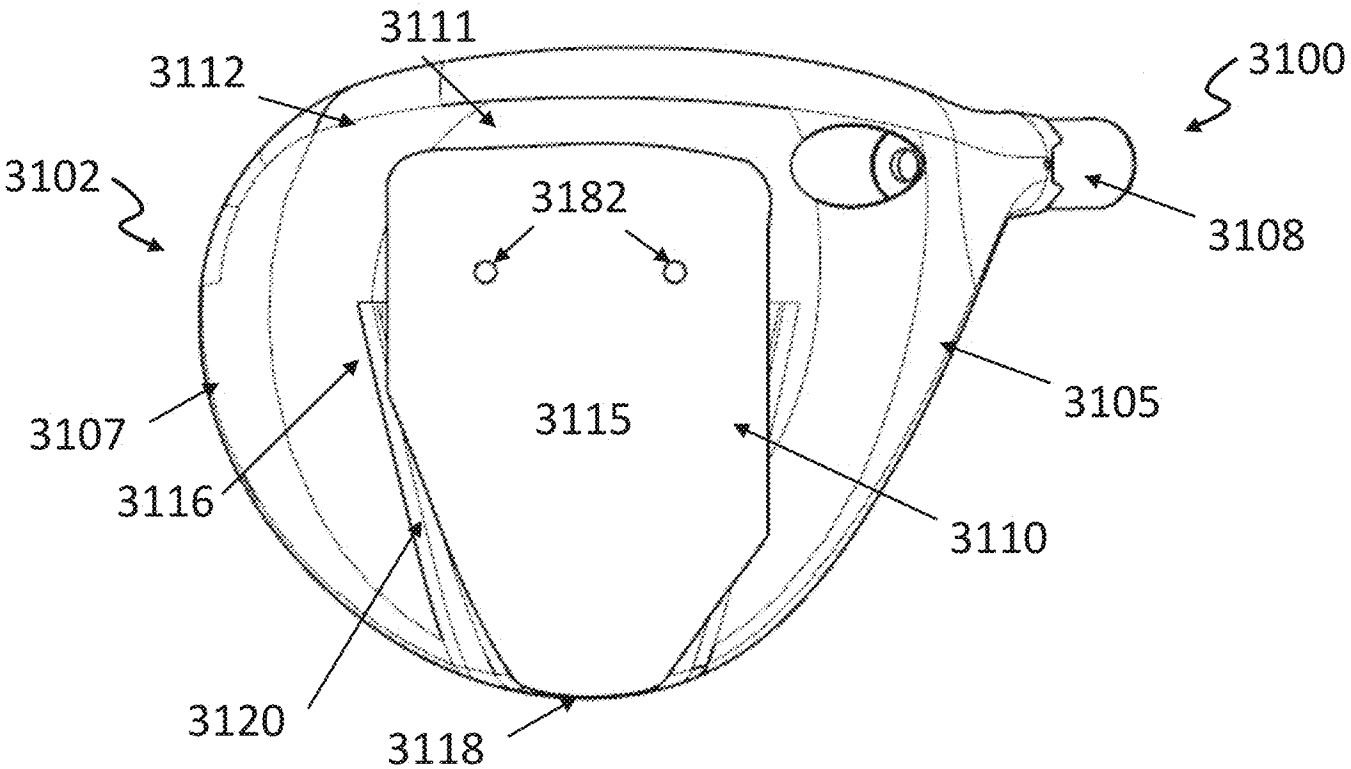
FIG. 33 illustrates a perspective view of a body in accordance with one or more embodiments of the presently disclosed technology.

FIGS. 31-33 illustrate a golf club head in accordance with one or more embodiments of the presently disclosed technology. For example, FIG. 31 illustrates a perspective view of a golf club head in accordance with one or more embodiments of the presently disclosed technology. FIG. 32 illustrates a cross-sectional side view of a golf club head in accordance with one or more embodiments of the presently disclosed technology, taken approximately along cross-sectional line D-D' shown in FIG. 31. FIG. 33 illustrates a perspective view of a body in accordance with one or more embodiments of the presently disclosed technology. Each of these figures may provide different views of the same or similar components, and may be discussed together herein.

Referring first to FIG. 31, golf club head 3100 may include body 3102 and/or insert 3120. Body 3102 may include crown 3101, face 3104, heel 3105, toe 3107, hosel 3108, and/or sole 3110. Face 3104, heel 3105, toe 3107, and/or hosel 3108 may be the same as, or substantially similar to, face 1804, heel 1805, toe 1807, and/or hosel 1808. Crown 3101 may be a top of golf club head 3100. Crown 3101 may extend backward from a top of face 3104. Sole 3110 may include first sole portion 3111, second sole portion 3115, and/or central region 3116. Central region 3116 may refer to the portion of sole 3110 outside of first sole portion 3111 and second sole portion 3115. Sole 3110 may also include leading edge 3112, sole opening 3114 (at least shown in FIG. 32), trailing edge 3118, and/or sole through holes 3182 (at least shown in FIG. 33). Leading edge 3112 and/or trailing edge 3118 may be the same as, or substantially similar to, leading edge 1812 and/or trailing edge 1818. Golf club head 3100 may be made out of metal, polymer, composite, and/or other materials. For example, crown 3101, heel 3105, toe 3107, hosel 3108, and/or sole 3110 may be made out of composite, face 3104 may be made out of a metallic material such a titanium, and insert 3120 may include polymer and metal components.

Referring to FIG. 32, first sole portion 3111 may include leading edge 3112. In some embodiments, first sole portion 3111 may extend backward a first sole distance $D_{S1}$ from an interior surface of face 3104. In some embodiments, first sole portion 3111 may be substantially planar. First sole distance $D_{S1}$ may be less than about 15 mm. In some embodiments, first sole distance $D_{S1}$ may be less than about 10 mm. In embodiments, first sole distance $D_{S1}$ may be less than about 5 mm. Referring to FIG. 33, first sole portion 3111 may include vertical portion 3152. Vertical portion 3152 may extend vertically upward from an interior surface of first sole portion 3111 toward crown 3101. In some embodiments, vertical portion 3452 may be parallel to face 3104. A height and/or thickness of vertical portion 3152 may vary without departing from the spirit and scope of the presently disclosed technology. For example, vertical portion 3152 may extend to about halfway up along face 3104. In some embodiments, vertical portion 3152 may extend below center of face 3104. In embodiments, vertical portion 3152 may extend beyond the center of face 3104. In some embodiments, vertical portion 3152 may be closer or further from face 3104 without departing from the spirit and scope of the presently disclosed technology. In embodiments, vertical portion 3152 may not be necessary and may be removed. In such embodiments, frontal sole insert 3125 may be in contact with an interior surface of face 3104.

Referring to FIG. 33, second sole portion 3115 may include trailing edge 3118 and/or sole through holes 3182. Second sole portion 3115 may extend backward a second sole distance $D_{S2}$ from a back of crown 3101. Second sole portion 3115 may be substantially planar. Second sole distance $D_{S2}$ may be less than about 115 mm. In some embodiments, second sole distance $D_{S2}$ may be less than about 100 mm. In embodiments, second sole distance $D_{S2}$ may be less than about 80 mm. Second sole portion 3115 may be vertically offset from first sole portion 3111 an offset distance $D_O$. For example, a horizontal plane of first sole portion 3111 may be above a horizontal plane of second sole portion 3115. In some embodiments, offset distance $D_O$ may be less than about 10 mm. In embodiments, offset distance $D_O$ may be less than about 5 mm. In some embodiments, the plane of first sole portion 3111 may be below the plane of second sole portion 3115. Sole through holes 3182 may receive at least part of fastener 3180 (at least shown in FIG. 32). The rest of sole 3110 may be substantially similar to a traditional golf club head sole.

Sole opening 3114 may separate first sole portion 3111 and second sole portion 3115. Sole opening 3114 may be an opening in an exterior surface of sole 3110 exposing an interior cavity of golf club head 3100.

Figure 36:
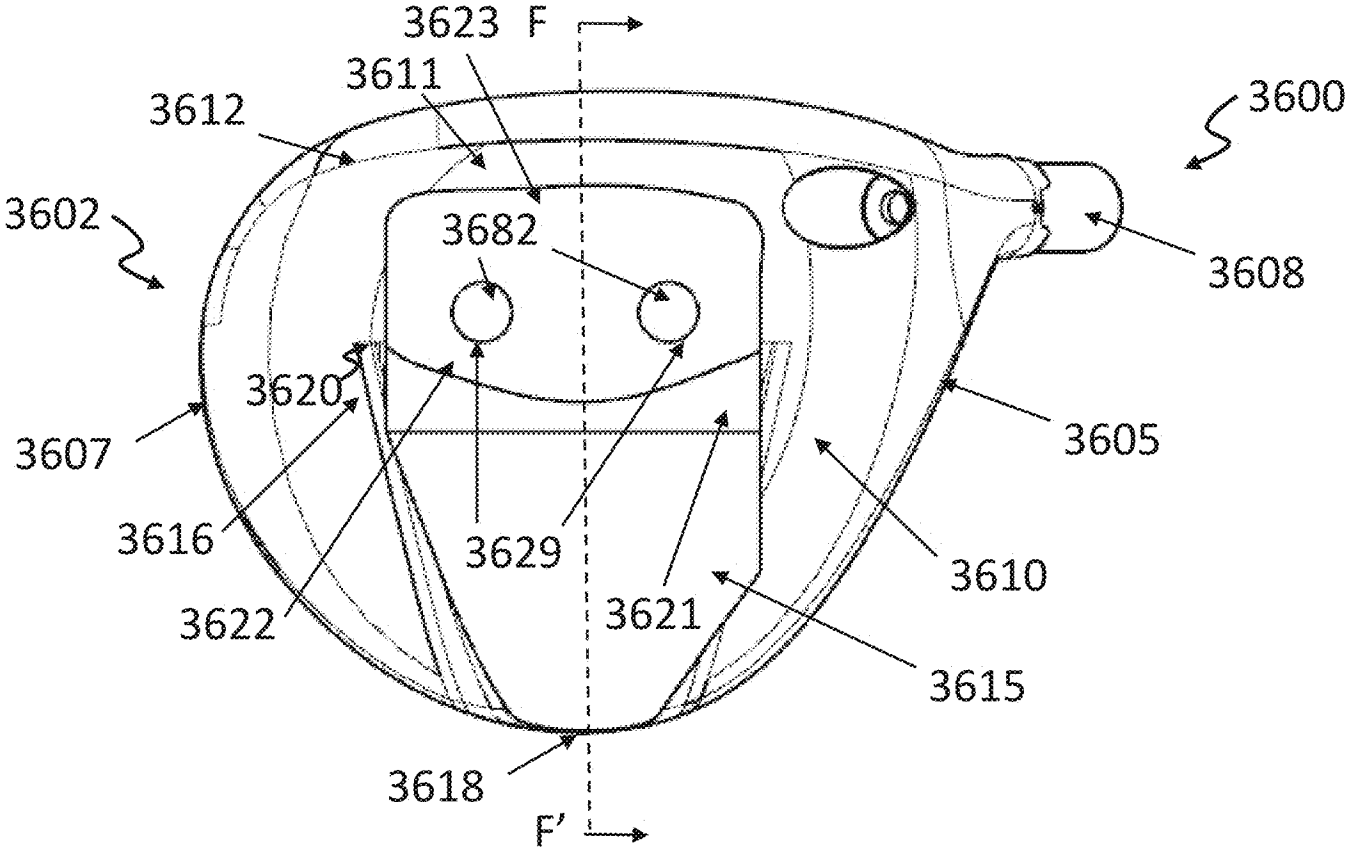
FIG. 36 illustrates a bottom view of a golf club head in accordance with one or more embodiments of the presently disclosed technology.

Referring back to FIG. 32, insert 3120 may include sole insert 3122 and/or frontal sole insert 3125. Insert 3120 may fit into sole opening 3114. Sole insert 3122 may be detachably connected to second sole portion 3115. Sole insert 3122 may be detachably connectable via fastener 3180 though it should be appreciated that other system may be used to detachably connect sole insert 3122 to second sole portion 3115. Unfastening fastener 3180 may allow detachment of sole insert 3122 and/or frontal sole insert 3125. In some embodiments, in an installed position, sole insert 3122 may appear continuous with first sole portion 3111. In embodiments, sole insert 3122 may be flush in the installed position with the surrounding surfaces. In some embodiments, sole insert 3122 may be vertically offset above first sole portion 3111. Sole insert 3122 may include first sole piece 3121 and/or second sole piece 3123. First sole piece 3121 may include a variable thickness. For example, first sole piece 3121 may taper from a backward-most edge of second sole piece 3123 to a bottom surface of second sole portion 3115. In some embodiments, the thickness may vary or taper linearly. In some embodiments, the thickness may vary non-linearly. In some embodiments, first sole piece 3121 may be shorter from front to back, as illustrated in FIG. 36, or longer without departing from the spirit and scope of the presently disclosed technology. Second sole piece 3123 may be substantially planar. Second sole piece 3123 may include insert through holes 3129 (at least shown in FIG. 31). Insert through holes 3129 (at least shown in FIG. 31) may receive part of fastener 3180.

Frontal sole insert 3125 may be in contact with an interior surface of face 3104. In some embodiments, frontal sole insert 3125 may be in contact with a rear surface of vertical portion 3152. Frontal sole insert 3125 may be different heights without departing from the spirit and scope of the presently disclosed technology. In some embodiments, frontal sole insert 3125 may extend above or below vertical portion 3152. Frontal sole insert 3125 may fit between a faceward end of second sole portion 3115 and a backward surface of vertical portion 3152 or an interior surface of face 3104. Frontal sole insert 3125 may have a thickness corresponding to the distance between a faceward end of second sole portion 3115 and a backward surface of vertical portion 3152 or an interior surface of face 3104. In some embodiments, frontal sole insert 3125 may be less thick and sole insert 3122 may press against frontal sole insert 3125 to help retain frontal sole insert 3125. Frontal sole insert 3125 may be adhered or otherwise fixed against the backward surface of vertical portion 3152 or the interior surface of face 3104.

Figure 34:
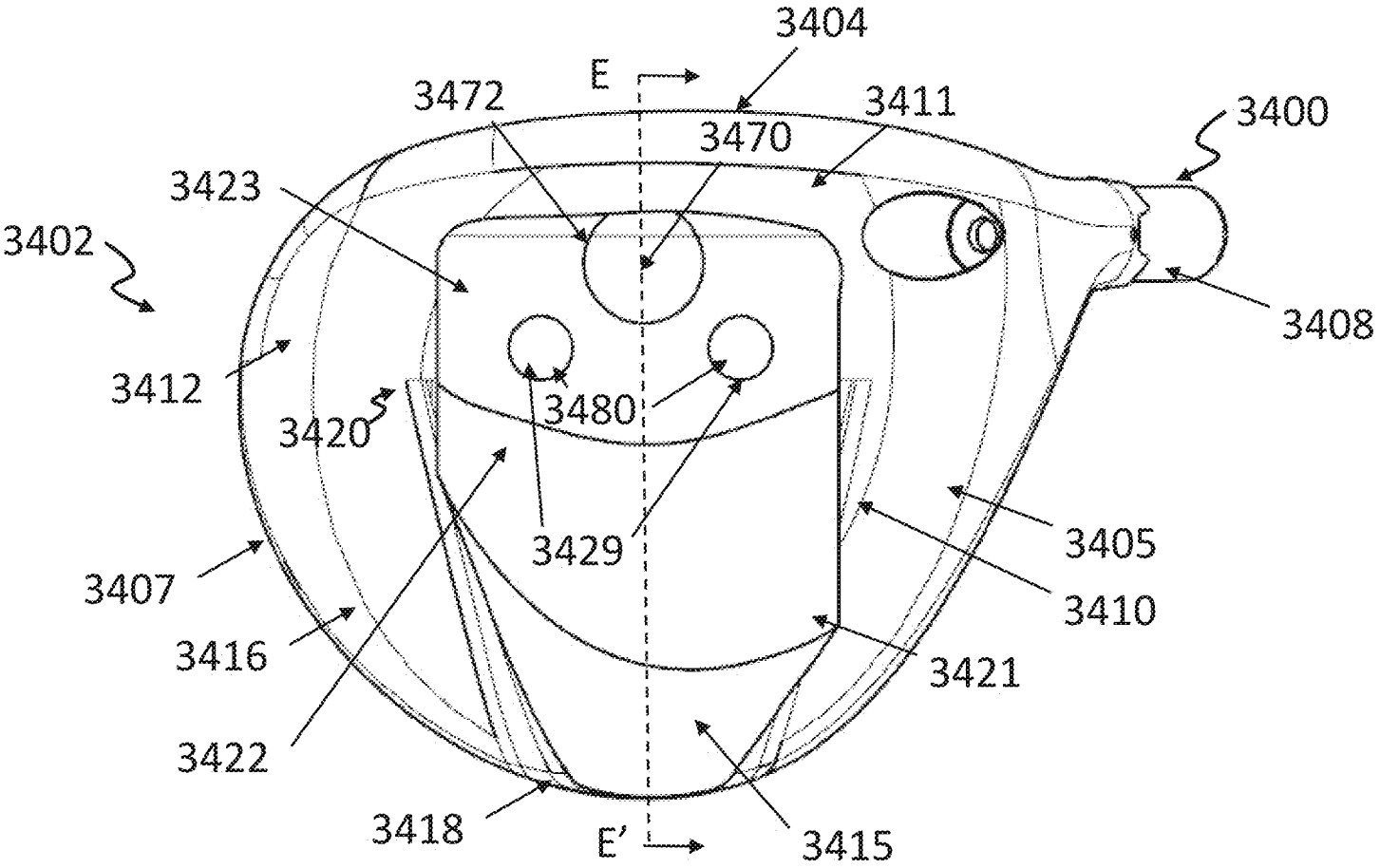
FIG. 34 illustrates a bottom view of a golf club head in accordance with one or more embodiments of the presently disclosed technology.
Figure 35:
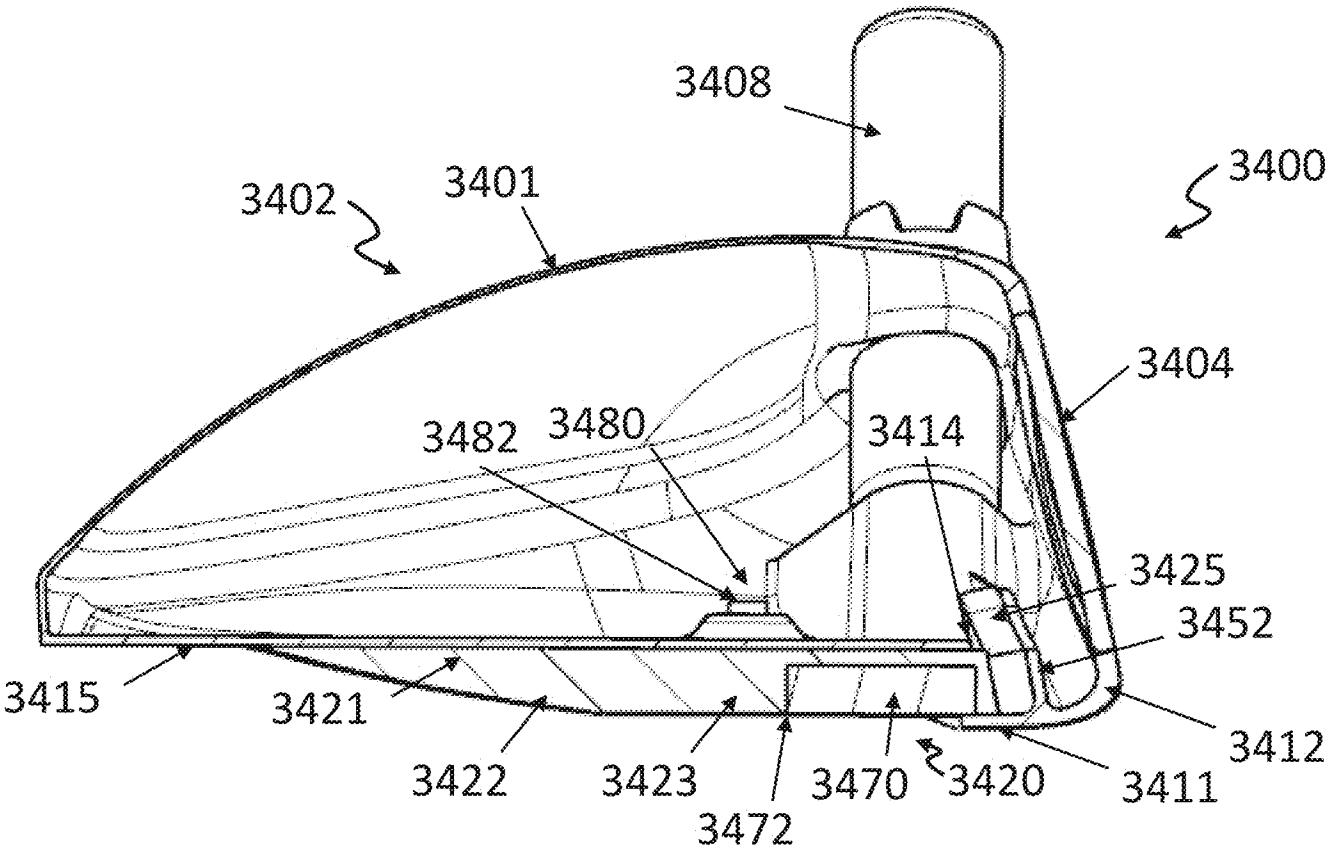
FIG. 35 illustrates a cross-sectional side view of a golf club head in accordance with one or more embodiments of the presently disclosed technology, taken approximately along cross-sectional line E-E' shown in FIG. 34.

FIGS. 34-35 illustrate a golf club head in accordance with one or more embodiments of the presently disclosed technology. For example, FIG. 34 illustrates a bottom view of a golf club head in accordance with one or more embodiments of the presently disclosed technology. FIG. 35 illustrates a cross-sectional side view of a golf club head in accordance with one or more embodiments of the presently disclosed technology, taken approximately along cross-sectional line E-E' shown in FIG. 34. Each of these figures may provide different views of the same or similar components, and may be discussed together herein.

Referring first to FIG. 34, golf club head 3400 may include body 3402 and/or insert 3420. Body 3402, including crown 3401, face 3404, heel 3405, toe 3407, hosel 3408, and/or sole 3410, including first sole portion 3411, leading edge 3412, sole opening 3414 (at least shown in FIG. 35), second sole portion 3415, central region 3416, trailing edge 3418, insert through holes 3429, fastener 3480, and/or sole through holes 3482 (at least shown in FIG. 35) may be the same as, or substantially similar to, body 3102, including crown 3101, face 3104, heel 3105, toe 3107, hosel 3108, and/or sole 3110, including first sole portion 3111, leading edge 3112, sole opening 3114 (at least shown in FIG. 32), second sole portion 3115, central region 3116, trailing edge 3118, insert through holes 3129, fastener 3180, and/or sole through holes 3182 (at least shown in FIG. 32). Insert 3420 may include sole insert 3422, frontal sole insert 3425, and/or weight 3470. Sole insert 3422 may include first sole piece 3421, second sole piece 3423, and/or weight 3470. First sole piece 3421 may be the same as, or substantially similar to, first sole piece 3121.

Second sole piece 3423 may include weight 3470 and/or weight recess 3472. Weight recess 3472 may be a section recessed from surrounding regions of second sole piece 3423 to receive weight 3470. Weight 3470 may be integrated into weight recess 3472. For example, weight 3470 may be adhered into weight recess 3472. In some embodiments, weight 3470 may be removably couplable to weight recess 3472. This may allow for different weights to be used to affect the characteristics of a golf club head's performance. For example, weights 3470 may be about 5 g, to about 10 g, to about 15 g, and so on, including any values in between. Weight 3470 may be press fit into an installed position, weight 3470 may be fastened into the installed position into weight recess 3472, and/or other systems may be used to help retain weight 3470 into weight recess 3472. While weight 3470 may be viewed as circular from below, though it should be appreciated that weight 3470 may be differently shaped, sized, and/or dimensioned without departing from the spirit and scope of the presently disclosed technology.

Figure 37:
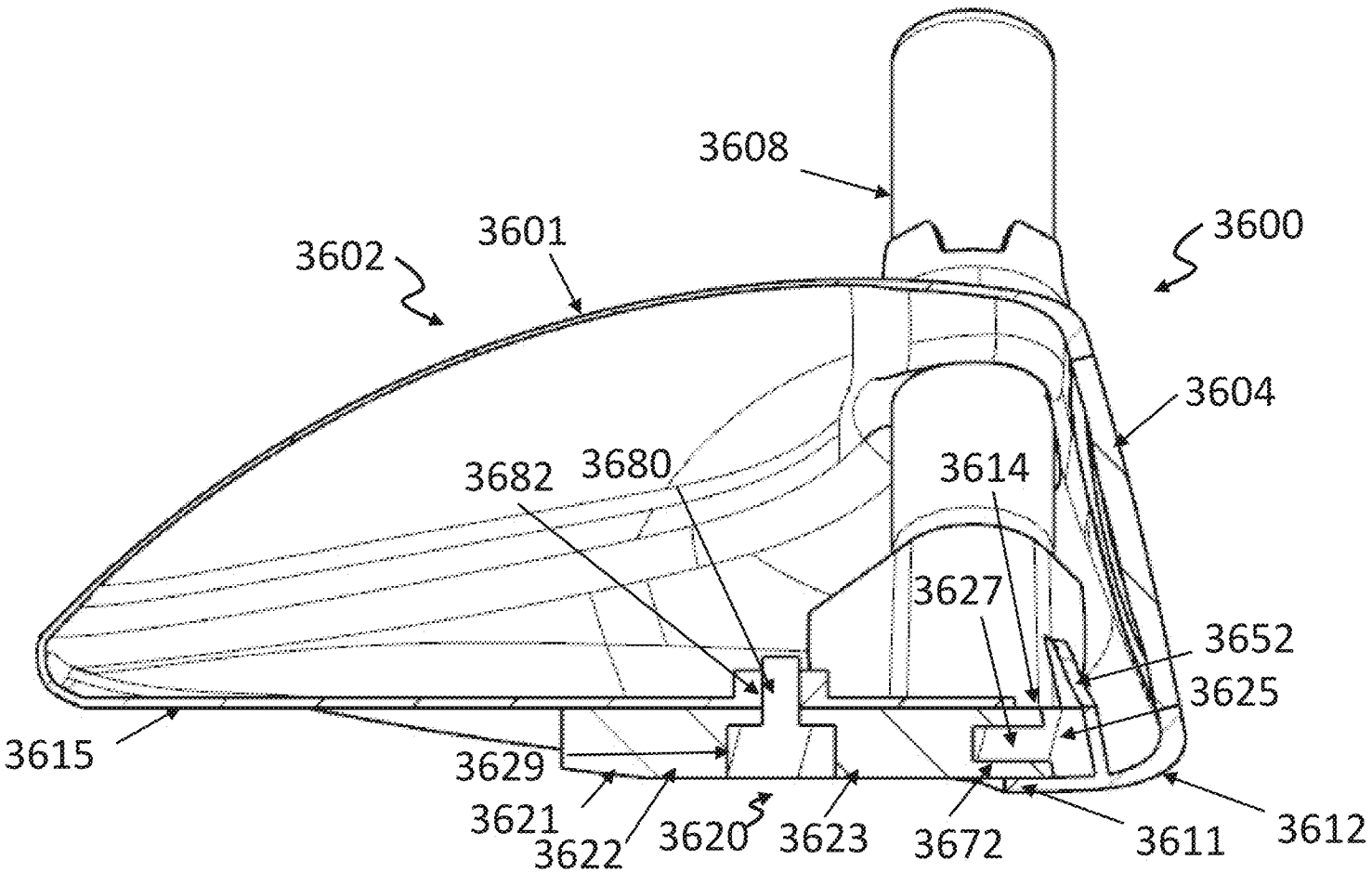
FIG. 37 illustrates a cross-sectional side view of a golf club head in accordance with one or more embodiments of the presently disclosed technology, taken approximately along cross-sectional line F-F' shown in FIG. 36.
Figure 38:
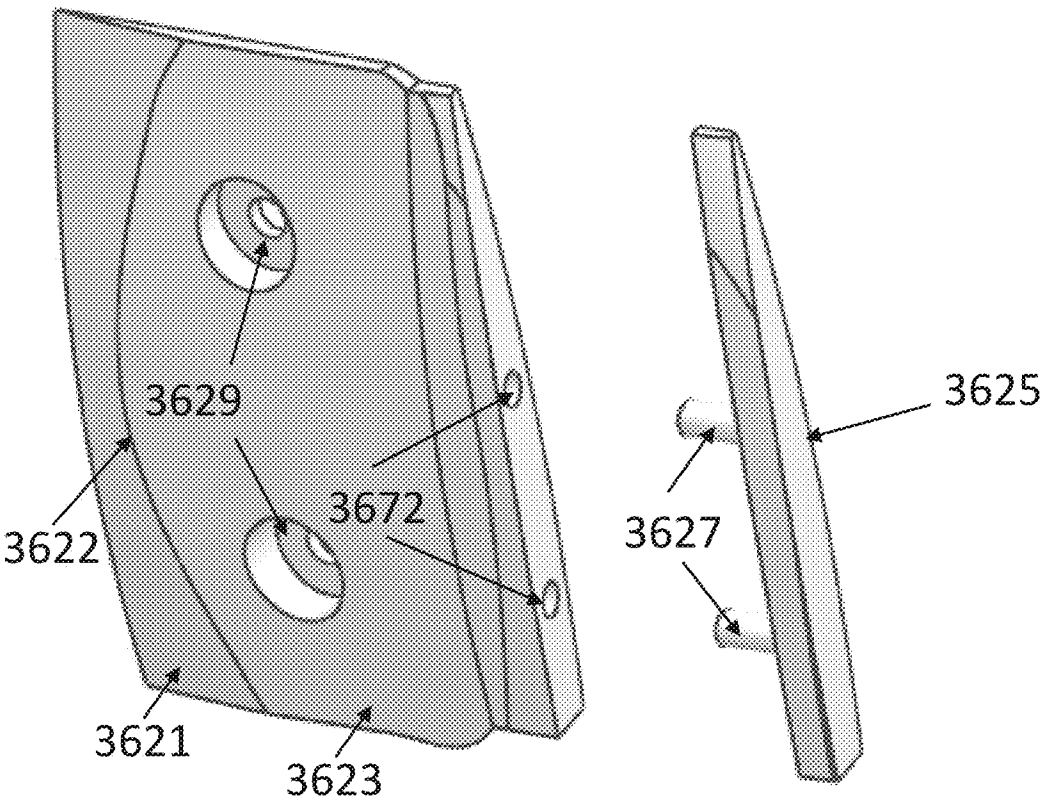
FIG. 38 illustrates an exploded perspective view of a sole insert in accordance with one or more embodiments of the presently disclosed technology.

FIGS. 36-38 illustrate a golf club head in accordance with one or more embodiments of the presently disclosed technology. For example, FIG. 36 illustrates a bottom view of a golf club head in accordance with one or more embodiments of the presently disclosed technology. FIG. 37 illustrates a cross-sectional side view of a golf club head in accordance with one or more embodiments of the presently disclosed technology, taken approximately along cross-sectional line F-F' shown in FIG. 36. FIG. 38 illustrates an exploded perspective view of a sole insert in accordance with one or more embodiments of the presently disclosed technology. Each of these figures may provide different views of the same or similar components, and may be discussed together herein.

Referring first to FIG. 36, golf club head 3600 may include body 3602 and/or insert 3620. Body 3602, including crown 3601, face 3604, heel 3605, toe 3607, hosel 3608, and/or sole 3610, including first sole portion 3611, leading edge 3612, sole opening 3614 (at least shown in FIG. 35), second sole portion 3615, central region 3616, trailing edge 3618, insert through holes 3629, fastener 3680, and/or sole through holes 3682 (at least shown in FIG. 35) may be the same as, or substantially similar to, body 3102, including crown 3101, face 3104, heel 3105, toe 3107, hosel 3108, and/or sole 3110, including first sole portion 3111, leading edge 3112, sole opening 3114 (at least shown in FIG. 32), second sole portion 3115, central region 3116, trailing edge 3118, insert through holes 3129, fastener 3180, and/or sole through holes 3182 (at least shown in FIG. 32). Insert 3620 may include sole insert 3622 and/or frontal sole insert 3625. Sole insert 3622 may include first sole piece 3621 and/or second sole piece 3623. Second sole piece 3623 may be the same as, or substantially similar to, second sole piece 3123. First sole piece 3621 may be shorter than first sole piece 3121, though it should be appreciated that first sole piece 3621 may be otherwise substantially similar to first sole piece 3121. For example, vertical portion 3652 may be the same as, or substantially similar to, vertical portion 3152. In embodiments, first sole piece 3621 may be differently shaped, sized, and/or dimensioned without departing from the spirit and scope of the presently disclosed technology.

Referring to FIG. 37, sole insert 3622 may include first sole piece 3621, second sole piece 3623, insert through holes 3629, and/or post holes 3672. Insert through holes 3629 may receive part of fastener 3680. In some embodiments, insert through holes 3629 may include recessed portions to receive a head of fastener 3180. This may allow the head of fastener 3180 to be flush with the rest of sole 3110. Referring to FIG. 38, post holes 3672 may receive posts 3627. Frontal sole insert 3625 may include posts 3627. Posts 3627 may fit into post holes 3672. While illustrated as cylindrical posts, it should be appreciated that posts 3627 may be differently shaped, sized, and/or dimensioned without departing from the spirit and scope of the presently disclosed technology. For example, posts 3627 may be a rail, a tongue, a fastener, and/or others while post holes 3672 may be a groove, a fastener through hole, and/or others. Posts 3627 and post holes 3672 may form a system to allow insert 3620 to be interchangeable, such that worn components of insert 3620 can be replaced (e.g., sole insert 3622, and/or frontal sole insert 3625), or components with different material properties (e.g., hardness, tensile/compressive stiffness, and so on) can be used to affect the performance of golf club head 3600. This may allow weighted components to be added or used in lieu of sole insert 3622 and/or frontal sole insert 3625.

Frontal sole insert 3625 may not be adhered in such an embodiment to allow for frontal sole insert 3625 to be interchangeable.

Other than in at least some of the operating examples, or unless otherwise expressly specified, all of the numerical ranges, amounts, values and percentages such as those for amounts of materials, moment of inertias, center of gravity locations, loft, angles, various ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and appended claims are approximations that may vary depending upon the desired properties sought to be obtained by the presently disclosed technology. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the presently disclosed technology are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While various embodiments of the disclosed technology have been described above, it should be appreciated these are examples only, and not limiting. Likewise, the various figures may depict an example configuration or structure to aid in understanding the features and functionality that can be included in the disclosed technology. The presently disclosed technology is not intended to be restricted to the illustrated example configurations and structures, and the desired features can be implemented with a variety of alternative configurations and structures. It may be apparent to one of skill in the art how alternative embodiments can be implemented to impart the desired features of the presently disclosed technology. Therefore, it will be understood that the appended claims are intended to cover all such modifications and embodiments, which would come within the spirit and scope of the presently disclosed technology.

While the presently disclosed technology may be described herein in terms of various exemplary embodiments, it should be understood that the various features described in any individual embodiment is not limited to its particular embodiment, and can be applied, whether alone or in combinations with features of other embodiments, to another embodiment, whether or not such an embodiment is described herein or described as part of a single embodiment. Thus, the breadth and scope of the presently disclosed technology should not be limited to any of the above-described exemplary embodiments.

Words, phrases, and their variations that are used herein, unless otherwise expressly stated, should be construed as open ended, not as limiting. For example, the term "include" should be read to mean "include, without limitation"; the term "example" should be read to mean the following provides exemplary instances, not an exhaustive or limiting list thereof; "a" or "an" should be read as meaning "at least one," "one or more" etc.; and "traditional," "normal," and similar terms should not be construed as limiting to a given time period, but should be read to encompass traditional, normal, like technologies that may be known now or at any future point. In addition, references herein to technologies that would be apparent or known to one of ordinary skill in the art includes such technologies that are apparent or known to one of ordinary skill in the art now or at any time in the future.

The presence of words and phrases such as "one or more," "at least," "not limited to," or other similar phrases shall not be read to necessarily mean that the narrower case is intended in instances where such broadening phrases may be absent. The presence of words such as "first," "second," or other similar words shall not be read to mean that there can only be one or two elements.

What is claimed is:

1. A golf club head comprising:

a body comprising:

a face;

a crown extending backward from a top of the face;

a first sole portion extending a first sole distance backward from a bottom of the face;

a leading edge defined as a first boundary between the face and the first sole portion;

a second sole portion extending forward a second sole distance from a back of the crown;

a trailing edge defined as a second boundary between the back of the crown and the second sole portion; and a sole opening between the first sole portion and the second sole portion exposing an interior cavity of the golf club head; and an insert to fit into the sole opening, wherein the insert comprises:

a sole insert detachably connected to the second sole portion, wherein the sole insert covers at least a part of the second sole portion; and a frontal sole insert in contact with at least a faceward surface of the sole insert, wherein the frontal sole insert separates the sole insert from the face, wherein the frontal sole insert is removably couplable to the sole insert.

2. The golf club head of claim 1, wherein the second sole portion is substantially planar, and wherein the second sole portion is offset above the first sole portion by an offset distance; and wherein the frontal sole insert separates the second sole portion from the face.

3. The golf club head of claim 1, wherein the first sole portion comprises a vertical portion separated from the face by a first distance, and wherein the vertical portion extends from the first sole portion within the interior cavity to the crown.

4. The golf club head of claim 3, wherein the frontal sole insert is in contact with a backward surface of the vertical portion, and wherein the frontal sole insert separates the sole insert and the second sole portion from the vertical portion.

5. The golf club head of claim 1, wherein the second sole portion comprises a sole through hole to receive a first part of a fastener, wherein the sole insert comprises an insert through hole to receive a second part of the fastener, and wherein the golf club head further comprises the fastener.

6. The golf club head of claim 1, wherein a top surface of the sole insert is substantially planar.

7. The golf club head of claim 1, wherein the sole insert comprises a first sole piece, and wherein the first sole piece comprises a variable thickness.

8. The golf club head of claim 1, wherein the sole insert comprises a weight.

9. The golf club head of claim 8, wherein the weight is integrated into the sole insert.

10. The golf club head of claim 1, wherein the sole insert comprises a post hole, and wherein the frontal sole insert comprises a post to fit into the post hole.

11. A golf club head comprising:

a body comprising:

a face;

a crown extending backward from a top of the face;

a first sole portion extending backward from a bottom of the face a first sole distance, wherein the first sole portion is substantially planar;

a second sole portion extending forward from a back of the crown a second sole distance, wherein the second sole portion is substantially planar, and wherein the second sole portion is offset above the first sole portion by an offset distance; and a sole opening between the first sole portion and the second sole portion exposing an interior cavity of the golf club head; and an insert to fit into the sole opening, wherein the insert comprises:

a sole insert detachably connected to the second sole portion, wherein the sole insert covers at least a part of the second sole portion, wherein the sole insert comprises a first sole piece, and wherein the first sole piece comprises a variable thickness; and a frontal sole insert in contact with at least a faceward surface of the sole insert, wherein the frontal sole insert separates the sole insert from the face.

12. The golf club head of claim 11, wherein the first sole portion comprises a vertical portion separated from the face by a first distance, and wherein the vertical portion extends from the first sole portion within the interior cavity to the crown.

13. The golf club head of claim 12, wherein the frontal sole insert is in contact with a backward surface of the vertical portion, and wherein the frontal sole insert separates the sole insert and the second sole portion from the vertical portion.

14. The golf club head of claim 11, wherein the second sole portion comprises a sole through hole to receive a first part of a fastener, wherein the sole insert comprises an insert through hole to receive a second part of the fastener, and wherein the golf club head further comprises the fastener.

15. The golf club head of claim 11, wherein a top surface of the sole insert is substantially planar.

16. The golf club head of claim 11, wherein the sole insert comprises a weight.

17. The golf club head of claim 16, wherein the weight is integrated into the sole insert.

18. A golf club head comprising:

a body comprising:

a face;

a crown extending backward from a top of the face;

a first sole portion extending backward from a bottom of the face a first sole distance;

a second sole portion extending forward from a back of the crown a second sole distance; and a sole opening between the first sole portion and the second sole portion exposing an interior cavity of the golf club head; and an insert to fit into the sole opening, wherein the insert comprises:

a sole insert detachably connected to the second sole portion, wherein the sole insert covers at least a part of the second sole portion, and wherein the sole insert comprises a post hole; and a frontal sole insert in contact with at least a faceward surface of the sole insert, wherein the frontal sole insert separates the sole insert and the second sole portion from the face, and wherein the frontal sole insert comprises a post to fit into the post hole.

* * * * *